US009928850B2

(12) United States Patent
Kamamoto et al.

(10) Patent No.: US 9,928,850 B2
(45) **Date of Patent: *Mar. 27, 2018**

(54) LINEAR PREDICTIVE ANALYSIS APPARATUS, METHOD, PROGRAM AND RECORDING MEDIUM

(71) Applicant: NIPPON TELEGRAPH AND TELEPHONE CORPORATION, Chiyoda-ku (JP)

(72) Inventors: Yutaka Kamamoto, Atsugi (JP); Takehiro Moriya, Atsugi (JP); Noboru Harada, Atsugi (JP)

(73) Assignee: NIPPON TELEGRAPH AND TELEPHONE CORPORATION, Chiyoda-ku (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/112,318

(22) PCT Filed: Jan. 20, 2015

(86) PCT No.: PCT/JP2015/051352

§ 371 (c)(1),
(2) Date: Jul. 18, 2016

(87) PCT Pub. No.: WO2015/111569

PCT Pub. Date: Jul. 30, 2015

(65) Prior Publication Data

US 2016/0343387 A1 Nov. 24, 2016

(30) Foreign Application Priority Data

Jan. 24, 2014 (JP) ..... 2014-011318
Jul. 28, 2014 (JP) ..... 2014-152525

(51) Int. Cl.
*G10L 19/00* (2013.01)
*G10L 21/00* (2013.01)
(Continued)

(52) U.S. Cl.
CPC ..... *G10L 25/12* (2013.01); *G10L 19/06* (2013.01); *G10L 25/06* (2013.01); *G10L 25/90* (2013.01)

(58) Field of Classification Search
CPC ..... G10L 19/06; G10L 19/12; G10L 19/032; G10L 19/08; G10L 19/083; G10L 19/125;
(Continued)

(56) References Cited

U.S. PATENT DOCUMENTS 5,243,685 A * 9/1993 Laurent ..... G10L 19/06 704/200
5,781,880 A * 7/1998 Su ..... G10L 19/09 704/207

(Continued)

OTHER PUBLICATIONS

P. Papamichalis and T. Barnwell, "Variable rate speech compression by encoding subsets of the PARCOR coefficients," in IEEE Transactions on Acoustics, Speech, and Signal Processing, vol. 31, No. 3, pp. 706-713, Jun. 1983.*

(Continued)

*Primary Examiner* — Edgar Guerra-Erazo
(74) *Attorney, Agent, or Firm* — Oblon, McClelland, Maier & Neustadt, L.L.P.

(57) ABSTRACT

An autocorrelation calculating part calculates autocorrelation $R_o(i)$ from an input signal. A predictive coefficient calculating part performs linear predictive analysis using modified autocorrelation $R'_o(i)$ obtained by multiplying the autocorrelation $R_o(i)$ by a coefficient $w_o(i)$. Here, it is assumed that a case where, for at least part of each order i, the coefficient $w_o(i)$ corresponding to each order i monotonically increases as a value having negative correlation (Continued)

with a fundamental frequency of an input signal in a current frame or a past frame increases and a case where the coefficient $w_o(i)$ monotonically decreases as a value having positive correlation with a pitch gain in a current frame or a past frame increases, are included.

5 Claims, 16 Drawing Sheets

(51) Int. Cl.
*G10L 25/12* (2013.01)
*G10L 25/06* (2013.01)
*G10L 19/06* (2013.01)
*G10L 25/90* (2013.01)

(58) Field of Classification Search
CPC ..... G10L 19/04; G10L 2019/0016; G10L 2019/0011; G10L 21/04
USPC ..... 704/216–225, 501–504
See application file for complete search history.

(56) References Cited

U.S. PATENT DOCUMENTS 7,155,386 B2 * 12/2006 Gao ..... G10L 19/005 704/207
2004/0002856 A1 1/2004 Bhaskar et al.
2004/0181397 A1 * 9/2004 Gao ..... G10L 19/005 704/207
2013/0117030 A1 5/2013 Qi et al.
2016/0336019 A1 * 11/2016 Kamamoto ..... G10L 25/12

OTHER PUBLICATIONS

"Series G: Transmission Systems and Media, Digital Systems and Networks, Digital terminal equipments—Coding of voice and audio signals; Frame error robust narrow-band and wideband embedded variable bit-rate coding of speech and audio from 8-32 kbit/s," Recommendation ITU-T G.718, International Telecommunication Union, Jun. 2008, (255 pages).
"General Aspects of Digital Transmission Systems; Coding of speech at 8kbit/s using conjugate-structure algebraic-code-excited linear-prediction (CS-ACELP)," ITU-T Recommendation G.729, International Telecommunication Union, Mar. 1996, (38 pages).
Yoh'ichi Tohkura, et al., "Spectral Smoothing Technique in PARCOR Speech Analysis-Synthesis," IEEE Transactions on Acoustics, Speech, and Signal Processing, vol. ASSP-26, No. 6, Dec. 1978, pp. 587-596.
International Search Report dated Apr. 7, 2015 in PCT/JP2015/051352 filed Jan. 20, 2015.
Extended European Search Report dated Jul. 5, 2017 in Patent Application No. 15740985.5.
"5 Functional description of the encoder," 3GPP TS 26.445 V12.00, Release 12, XP50907035A, 2014, pp. 31-140.
Office Action dated Jun. 29, 2017 in Korean Patent Application No. 10-2016-7019614 (with English translation).

* cited by examiner

| | FUNDAMENTAL FREQUENCY IS HIGH | FUNDAMENTAL FREQUENCY IS MEDIUM | FUNDAMENTAL FREQUENCY IS LOW |
|---|---|---|---|
| PITCH GAIN IS LARGE | $w_h(i)$ | $w_m(i)$ | $w_l(i)$ |
| PITCH GAIN IS MEDIUM | $w_m(i)$ | $w_m(i)$ | $w_l(i)$ |
| PITCH GAIN IS SMALL | $w_m(i)$ | $w_l(i)$ | $w_l(i)$ |

Fig. 5

| | PERIOD IS SHORT | PERIOD IS MEDIUM | PERIOD IS LONG |
|---|---|---|---|
| PITCH GAIN IS LARGE | $w_h(i)$ | $w_m(i)$ | $w_l(i)$ |
| PITCH GAIN IS MEDIUM | $w_m(i)$ | $w_m(i)$ | $w_l(i)$ |
| PITCH GAIN IS SMALL | $w_m(i)$ | $w_l(i)$ | $w_l(i)$ |

Fig. 6

| | FUNDAMENTAL FREQUENCY IS HIGH | FUNDAMENTAL FREQUENCY IS MEDIUM | FUNDAMENTAL FREQUENCY IS LOW |
|---|---|---|---|
| PITCH GAIN IS LARGE | t0 | t1 | t2 |
| PITCH GAIN IS MEDIUM | t1 | t1 | t2 |
| PITCH GAIN IS SMALL | t1 | t2 | t2 |

Fig. 10

LINEAR PREDICTIVE ANALYSIS APPARATUS, METHOD, PROGRAM AND RECORDING MEDIUM

TECHNICAL FIELD

The present invention relates to a technique of analyzing a digital time series signal such as an audio signal, an acoustic signal, an electrocardiogram, an electroencephalogram, magnetic encephalography and a seismic wave.

BACKGROUND ART

In coding of an audio signal and an acoustic signal, a method for performing coding based on a predictive coefficient obtained by performing linear predictive analysis on the inputted audio signal and acoustic signal is widely used (see, for example, Non-patent literatures 1 and 2).

In Non-patent literatures 1 to 3, a predictive coefficient is calculated by a linear predictive analysis apparatus illustrated in FIG. 16. The linear predictive analysis apparatus 1 comprises an autocorrelation calculating part 11, a coefficient multiplying part 12 and a predictive coefficient calculating part 13.

An input signal which is an inputted digital audio signal or digital acoustic signal in a time domain is processed for each frame of N samples. An input signal of a current frame which is a frame to be processed at current time is set at $X_o(n)$ (n=0, 1, . . . , N−1). n indicates a sample number of each sample in the input signal, and N is a predetermined positive integer. Here, an input signal of the frame one frame before the current frame is $X_o(n)$ (n=−N, −N+1, . . . , −1), and an input signal of the frame one frame after the current frame is $X_o(n)$ (n=N, N+1, . . . , 2N−1).

[Autocorrelation Calculating Part 11]

The autocorrelation calculating part 11 of the linear predictive analysis apparatus 1 obtains autocorrelation $R_o(i)$ (i=0, 1 . . . . , $P_{max}$, where $P_{max}$ is a prediction order) from the input signal $X_o(n)$ using equation (11) and outputs the autocorrelation. $P_{max}$ is a predetermined positive integer less than N.

[Formula 1]

$$R_o(i) = \sum_{n=i}^{N-1} X_o(n) \times X_o(n-i) \tag{11}$$

[Coefficient Multiplying Part 12]

Next, the coefficient multiplying part 12 obtains modified autocorrelation $R'_o(i)$ by multiplying the autocorrelation $R_o(i)$ outputted from the autocorrelation calculating part 11 by a coefficient $w_o(i)$ (i=0, 1, . . . , $P_{max}$) defined in advance for each of the same i. That is, the modified autocorrelation $R'_o(i)$ is obtained using equation (12).

[Formula 2]

$$R'_o(i)=R_o(i)\times w_o(i) \tag{12}$$

[Predictive Coefficient Calculating Part 13]

Then, the predictive coefficient calculating part 13 obtains a coefficient which can be converted into linear predictive coefficients from the first-order to the $P_{max}$-order which is a prediction order defined in advance using the modified autocorrelation $R'_o(i)$ outputted from the coefficient multiplying part 12 through, for example, a Levinson-Durbin method, or the like. The coefficient which can be converted into the linear predictive coefficients comprises a PARCOR coefficient $K_o(1)$, $K_o(2)$, . . . , $K_o(P_{max})$, linear predictive coefficients $a_o(1)$, $a_o(2)$, . . . , $a_o(P_{max})$, or the like.

International Standard ITU-T G.718 which is Non-patent literature 1 and International Standard ITU-T G.729, or the like, which is Non-patent literature 2 use a fixed coefficient having a bandwidth of 60 Hz obtained in advance as a coefficient $w_o(i)$.

Specifically, the coefficient $w_o(i)$ is defined using an exponent function as in equation (13), and in equation (13), a fixed value of $f_0$=60 Hz is used. $f_s$ is a sampling frequency.

[Formula 3]

$$w_o(i) = \exp\left(-\frac{1}{2}\left(\frac{2\pi f_0 i}{f_s}\right)^2\right),\ i = 0, 1, \ldots, P \tag{13}$$

Non-patent literature 3 discloses an example where a coefficient based on a function other than the above-described exponent function is used. However, the function used here is a function based on a sampling period τ (corresponding to a period corresponding to $f_s$) and a predetermined constant a, and a coefficient of a fixed value is used.

PRIOR ART LITERATURE

Non-Patent Literature

Non-patent literature 1: ITU-T Recommendation G.718, ITU, 2008.

Non-patent literature 2: ITU-T Recommendation G.729, ITU, 1996

Non-patent literature 3: Yoh'ichi Tohkura, Fumitada Itakura, Shin'ichiro Hashimoto, "Spectral Smoothing Technique in PARCOR Speech Analysis-Synthesis", IEEE Trans. on Acoustics, Speech, and Signal Processing, Vol. ASSP-26, No. 6, 1978

SUMMARY OF THE INVENTION

Problems to be Solved by the Invention

In a linear predictive analysis method used in conventional coding of an audio signal or an acoustic signal, a coefficient which can be converted into linear predictive coefficients is obtained using modified autocorrelation $R'_o(i)$ obtained by multiplying autocorrelation function $R_o(i)$ by a fixed coefficient $w_o(i)$. Therefore, even if a coefficient which can be converted into linear predictive coefficients is obtained without the need of modification through multiplication of autocorrelation $R_o(i)$ by the coefficient $w_o(i)$, that is, using the autocorrelation $R_o(i)$ itself instead of using the modified autocorrelation $R'_o(i)$, in the case of an input signal whose spectral peak does not become too high in a spectral envelope corresponding to the coefficient which can be converted into the linear predictive coefficients, precision of approximation of the spectral envelope corresponding to the coefficient which can be converted into the linear predictive coefficients obtained using the modified autocorrelation $R'_o(i)$ to a spectral envelope of the input signal $X_o(n)$ may degrade due to multiplication of the autocorrelation $R_o(i)$ by the coefficient $w_o(i)$. That is, there is a possibility that precision of linear predictive analysis may degrade.

An object of the present invention is to provide a linear predictive analysis method, apparatus, a program and a recording medium with higher analysis precision than conventional one.

Means to Solve the Problems

A linear predictive analysis method according to one aspect of the present invention is a linear predictive analysis method for obtaining a coefficient which can be converted into a linear predictive coefficient corresponding to an input time series signal for each frame which is a predetermined time interval, the linear predictive analysis method comprising an autocorrelation calculating step of calculating autocorrelation $R_o(i)$ ($i=0, 1, \ldots, P_{max}$) between an input time series signal $X_o(n)$ of a current frame and an input time series signal $X_o(n-i)$ i sample before the input time series signal $X_o(n)$ or an input time series signal $X_o(n+i)$ i sample after the input time series signal $X_o(n)$ for each of at least $i=0, 1, \ldots, P_{max}$, and a predictive coefficient calculating step of obtaining a coefficient which can be converted into linear predictive coefficients from the first-order to the $P_{max}$-order using modified autocorrelation $R'_o(i)$ obtained by multiplying the autocorrelation $R_o(i)$ ($i=0, 1, \ldots, P_{max}$) by a coefficient $w_o(i)$ ($i=0, 1, \ldots, P_{max}$) for each corresponding i, and a case where, for at least part of each order i, a coefficient $w_o(i)$ corresponding to each order i monotonically increases as a period, a quantization value of the period or a value having negative correlation with a fundamental frequency based on an input time series signal in the current frame or a past frame increases, and a case where the coefficient $w_o(i)$ corresponding to each order i monotonically decreases as a value having positive correlation with intensity of periodicity or a pitch gain of the input time series signal in the current frame or the past frame increases, are comprised.

A linear predictive analysis method according to one aspect of the present invention is a linear predictive analysis method for obtaining a coefficient which can be converted into a linear predictive coefficient corresponding to an input time series signal for each frame which is a predetermined time interval, the linear predictive analysis method comprising an autocorrelation calculating step of calculating autocorrelation $R_o(i)$ ($i=0, 1, \ldots, P_{max}$) between an input time series signal $X_o(n)$ of a current frame and an input time series signal $X_o(n-i)$ i sample before the input time series signal $X_o(n)$ or an input time series signal $X_o(n+i)$ i sample after the input time series signal $X_o(n)$ for each of at least $i=0, 1, \ldots, P_{max}$, a coefficient determining step of acquiring a coefficient $w_o(i)$ ($i=0, 1, \ldots, P_{max}$) from one coefficient table among two or more coefficient tables using a period, a quantization value of the period or a value having negative correlation with a fundamental frequency based on an input time series signal in the current frame or a past frame, and a value having positive correlation with intensity of periodicity or a pitch gain of an input time series signal in the current frame or the past frame assuming that each order i where $i=0, 1, \ldots, P_{max}$ and a coefficient $w_o(i)$ corresponding to each order i are stored in association with each other in each of the two or more coefficient tables, and a predictive coefficient calculating step of obtaining a coefficient which can be converted into linear predictive coefficients from the first-order to the $P_{max}$-order using modified autocorrelation $R'_o(i)$ ($i=0, 1, \ldots, P_{max}$) obtained by multiplying the autocorrelation $R_o(i)$ ($i=0, 1, \ldots, P_{max}$) by the acquired coefficient $w_o(i)$ ($i=0, 1, \ldots, P_{max}$) for each corresponding i, and, assuming that, among the two or more coefficient tables, a coefficient table from which the coefficient $w_o(i)$ ($i=0, 1, \ldots, P_{max}$) is acquired in the coefficient determining step when the value having negative correlation with the period, the quantization value of the period or the fundamental frequency is a first value and the value having positive correlation with the intensity of the periodicity or the pitch gain is a third value is a first coefficient table, and, among the two or more coefficient tables, a coefficient table from which the coefficient $w_o(i)$ ($i=0, 1, \ldots, P_{max}$) is acquired in the coefficient determining step when the value having negative correlation with the period, the quantization value of the period or the fundamental frequency is a second value which is greater than the first value, and the value having positive correlation with the intensity of the periodicity or the pitch gain is a fourth value which is smaller than the third value, is a second coefficient table, for at least part of each order i, a coefficient corresponding to each order i in the second coefficient table is greater than a coefficient corresponding to each order i in the first coefficient table.

A linear predictive analysis method according to one aspect of the present invention is a linear predictive analysis method for obtaining a coefficient which can be converted into a linear predictive coefficient corresponding to an input time series signal for each frame which is a predetermined time interval, the linear predictive analysis method comprising an autocorrelation calculating step of calculating autocorrelation $R_o(i)$ ($i=0, 1, \ldots, P_{max}$) between an input time series signal $X_o(n)$ of a current frame and an input time series signal $X_o(n-i)$ i sample before the input time series signal $X_o(n)$ or an input time series signal $X_o(n+i)$ i sample after the input time series signal $X_o(n)$ for each of at least $i=0, 1, \ldots, P_{max}$, a coefficient determining step of acquiring a coefficient from one coefficient table among coefficient tables t0, t1 and t2 using a period, a quantization value of the period or a value having negative correlation with a fundamental frequency based on an input time series signal in the current frame or a past frame, and a value having positive correlation with a pitch gain of an input time series signal in the current frame or the past frame assuming that a coefficient $w_{t0}(i)$ ($i=0, 1, \ldots, P_{max}$) is stored in the coefficient table t0, a coefficient $w_{t1}(i)$ ($i=0, 1, \ldots, P_{max}$) is stored in the coefficient table t1, and a coefficient $w_{t2}(i)$ ($i=0, 1, \ldots, P_{max}$) is stored in the coefficient table t2, and a predictive coefficient calculating step of obtaining a coefficient which can be converted into linear predictive coefficients from the first-order to the $P_{max}$-order using modified autocorrelation $R'_o(i)$ ($i=0, 1, \ldots, P_{max}$) obtained by multiplying the autocorrelation $R_o(i)$ ($i=0, 1, \ldots, P_{max}$) by the acquired coefficient for each corresponding i, and, for at least part of i, $w_{t0}(i)<w_{t1}(i)\leq w_{t2}(i)$, and, for at least part of each i among other i, $w_{t0}(i)\leq w_{t1}(i)<w_{t2}(i)$, and, for the remaining each i, $w_{t0}(i)\leq w_{t1}(i)\leq w_{t2}(i)$, and, in the coefficient determining step, a coefficient table is selected and a coefficient stored in the selected coefficient table is acquired so as to comprise a case where, for at least two ranges among three ranges constituting a possible range of the value having negative correlation with the period, the quantization value of the period or the fundamental frequency, a coefficient determined when the value having positive correlation with the pitch gain is small is greater than a coefficient determined when the value having the positive correlation with the pitch gain is great, and a cased where, for at least two ranges among three ranges constituting a possible range of the value having positive correlation with the pitch gain, a coefficient determined when the value having negative correlation with the period, the quantization value of the period or the fundamental frequency is great is greater than a coefficient determined when the value having negative correlation with the period, the quantization value of the period or the fundamental frequency is small.

A linear predictive analysis method according to one aspect of the present invention is a linear predictive analysis method for obtaining a coefficient which can be converted into a linear predictive coefficient corresponding to an input time series signal for each frame which is a predetermined time interval, the linear predictive analysis method comprising an autocorrelation calculating step of calculating autocorrelation $R_o(i)$ (i=0, 1, . . . , $P_{max}$) between an input time series signal $X_o(n)$ of a current frame and an input time series signal $X_o(n-i)$ i sample before the input time series signal $X_o(n)$ or an input time series signal $X_o(n+i)$ i sample after the input time series signal $X_o(n)$ for each of at least i=0, 1, . . . , $P_{max}$, a coefficient determining step of acquiring a coefficient from one coefficient table among coefficient tables t0, t1 and t2 using a period, a quantization value of the period or a value having negative correlation with a fundamental frequency based on an input time series signal in the current frame or a past frame, and a value having positive correlation with a pitch gain assuming that a coefficient $w_{t0}(i)$ (i=0, 1, . . . , $P_{max}$) is stored in the coefficient table t0, a coefficient $w_{t1}(i)$ (i=0, 1, . . . , $P_{max}$) is stored in the coefficient table t1, and a coefficient $w_{t2}(i)$ (i=0, 1, . . . , $P_{max}$) is stored in the coefficient table t2, and a predictive coefficient calculating step of obtaining a coefficient which can be converted into linear predictive coefficients from the first-order to the $P_{max}$-order using modified autocorrelation $R'_o(i)$ (i=0, 1, . . . , $P_{max}$) obtained by multiplying the autocorrelation $R_o(i)$ (i=0, 1, . . . , $P_{max}$) by the acquired coefficient for each corresponding i, and, for at least part of i, $w_{t0}(i)<w_{t1}(i)\leq w_{t2}(i)$, and, for at least part of each i among other i, $w_{t0}(i)\leq w_{t1}(i)<w_{t2}(i)$, and, for the remaining each i, $w_{t0}(i)\leq w_{t1}(i)\leq w_{t2}(i)$, according to the value having negative correlation with the period, the quantization value of the period or the fundamental frequency and the value having positive correlation with the pitch gain, (1) when the period is short and the pitch gain is large, a coefficient is acquired from the coefficient table t0 in the coefficient determining step, (9) when the period is long and the pitch gain is small, a coefficient is acquired from the coefficient table t2 in the coefficient determining step, (2) when the period is short and the pitch gain is medium, (3) when the period is short and the pitch gain is small, (4) when the period is medium and the pitch gain is large, (5) when the period is medium and the pitch gain is medium, (6) when the period is medium and the pitch gain is small, (7) when the period is long and the pitch gain is large, and (8) when the period is long and the pitch gain is medium, a coefficient is acquired from any of the coefficient tables t0, t1 and t2 in the coefficient determining step, in the case of at least one of (2), (3), (4), (5), (6), (7) and (8), a coefficient is acquired from the coefficient table t1 in the coefficient determining step, and, assuming that an identification number of a coefficient table $tj_k$ from which a coefficient is acquired in the coefficient determining step in the case of (k) where k=1, 2, . . . , 9, is $j_k$, $j_1\leq j_2\leq j_3$, $j_4\leq j_5\leq j_6$, $j_7\leq j_8\leq j_9$, $j_1\leq j_4\leq j_7$, $j_2\leq j_5\leq j_8$, and $j_3\leq j_6\leq j_9$.

A linear predictive analysis method according to one aspect of the present invention is a linear predictive analysis method for obtaining a coefficient which can be converted into a linear predictive coefficient corresponding to an input time series signal for each frame which is a predetermined time interval, the linear predictive analysis method comprising an autocorrelation calculating step of calculating autocorrelation $R_o(i)$ (i=0, 1, . . . , $P_{max}$) between an input time series signal $X_o(n)$ of a current frame and an input time series signal $X_o(n-i)$ i sample before the input time series signal $X_o(n)$ or an input time series signal $X_o(n+i)$ i sample after the input time series signal $X_o(n)$ for each of at least i=0, 1, . . . , $P_{max}$, and a predictive coefficient calculating step of obtaining a coefficient which can be converted into linear predictive coefficients from the first-order to the $P_{max}$-order using modified autocorrelation $R'_o(i)$ obtained by multiplying the autocorrelation $R_o(i)$ (i=0, 1, . . . , $P_{max}$) by a coefficient $w_o(i)$ (i=0, 1, . . . , $P_{max}$) for each corresponding i, and, for at least part of each other i, a case where the coefficient $w_o(i)$ corresponding to each order i monotonically decreases as a value having positive correlation with a fundamental frequency based on an input time series signal in the current frame or a past frame increases, and a case where the coefficient $w_o(i)$ corresponding to each order i monotonically decreases as a value having positive correlation with a pitch gain increases, are comprised.

A linear predictive analysis method according to one aspect of the present invention is a linear predictive analysis method for obtaining a coefficient which can be converted into a linear predictive coefficient corresponding to an input time series signal for each frame which is a predetermined time interval, the linear predictive analysis method comprising an autocorrelation calculating step of calculating autocorrelation $R_o(i)$ (i=0, 1, . . . , $P_{max}$) between an input time series signal $X_o(n)$ of a current frame and an input time series signal $X_o(n-i)$ i sample before the input time series signal $X_o(n)$ or an input time series signal $X_o(n+i)$ i sample after the input time series signal $X_o(n)$ for each of at least i=0, 1, . . . , $P_{max}$, a coefficient determining step of acquiring a coefficient $w_o(i)$ (i=0, 1, . . . , $P_{max}$) from one coefficient table among two or more coefficient tables using a value having positive correlation with a fundamental frequency based on an input time series signal in the current frame or a past frame and a value having positive correlation with a pitch gain of an input signal in the current frame or a past frame assuming that each order i where i=0, 1, . . . , $P_{max}$ and a coefficient $w_o(i)$ corresponding to each order i are stored in association with each other in each of the two or more coefficient tables, and a predictive coefficient calculating step of obtaining a coefficient which can be converted into linear predictive coefficients from the first-order to the $P_{max}$-order using modified autocorrelation $R'_o(i)$ (i=0, 1, . . . , $P_{max}$) obtained by multiplying the autocorrelation $R_o(i)$ (i=0, 1, . . . , $P_{max}$) by the acquired coefficient $w_o(i)$ (i=0, 1, . . . , $P_{max}$) for each corresponding i, and, assuming that, among the two or more coefficient tables, a coefficient table from which the coefficient $w_o(i)$ (i=0, 1, . . . , $P_{max}$) is acquired in the coefficient determining step when the value having positive correlation with the fundamental frequency is a first value, and the value having positive correlation with the pitch gain is a third value, is a first coefficient table, and, among the two or more coefficient tables, a coefficient table from which the coefficient $w_o(i)$ (i=0, 1, . . . , $P_{max}$) is acquired in the coefficient determining step when the value having positive correlation with the fundamental frequency is a second value which is smaller than the first value, and the value having positive correlation with the pitch gain is a fourth value which is smaller than the third value, is a second coefficient table, for at least part of each order i, a coefficient corresponding to each order i in the second coefficient table is greater than a coefficient corresponding to each order i in the first coefficient table.

A linear predictive analysis method according to one aspect of the present invention is a linear predictive analysis method for obtaining a coefficient which can be converted into a linear predictive coefficient corresponding to an input time series signal for each frame which is a predetermined time interval, the linear predictive analysis method comprising an autocorrelation calculating step of calculating autocorrelation $R_o(i)$ (i=0, 1, . . . , $P_{max}$) between an input time series signal $X_o(n)$ of a current frame and an input time series signal $X_o(n-i)$ i sample before the input time series signal $X_o(n)$ or an input time series signal $X_o(n+i)$ i sample after the input time series signal $X_o(n)$ the current frame for each of at least i=0, 1, . . . , $P_{max}$, a coefficient determining step of acquiring a coefficient from one coefficient table among coefficient tables t0, t1 and t2 using a value having positive correlation with a fundamental frequency based on an input time series signal in the current frame or a past frame and a value having positive correlation with a pitch gain assuming that a coefficient $w_{t0}(i)$ (i=0, 1, . . . , $P_{max}$) is stored in the coefficient table t0, a coefficient $w_{t1}(i)$ (i=0, 1, . . . , $P_{max}$) is stored in the coefficient table t1, and a coefficient $w_{t2}(i)$ (i=0, 1, . . . , $P_{max}$) is stored in the coefficient table t2, and a predictive coefficient calculating step of obtaining a coefficient which can be converted into linear predictive coefficients from the first-order to the $P_{max}$-order using modified autocorrelation $R'_o(i)$ (i=0, 1, . . . , $P_{max}$) obtained by multiplying the autocorrelation $R_o(i)$ (i=0, 1, . . . , $P_{max}$) by the acquired coefficient for each corresponding i, and, for at least part of i, $w_{t0}(i)<w_{t1}(i)\leq w_{t2}(i)$, and, for at least part of each i among other i, $w_{t0}(i)\leq w_{t1}(i)<w_{t2}(i)$, and, for the remaining each i, $w_{t0}(i)\leq w_{t1}(i)\leq w_{t2}(i)$, and, in the coefficient determining step, a coefficient table is selected and a coefficient stored in the selected coefficient table is acquired so as to comprise a case where, for at least two ranges among three ranges constituting a possible range of the value having positive correlation with the fundamental frequency, a coefficient determined when the value having positive correlation with the pitch gain is small is greater than a coefficient determined when the value having the positive correlation with the pitch gain is great, and a case where, for at least two ranges among three ranges constituting a possible range of the value having positive correlation with the pitch gain, a coefficient determined when the value having positive correlation with the fundamental frequency is small is greater than a coefficient determined when the value having positive correlation with the fundamental frequency is great.

A linear predictive analysis method according to one aspect of the present invention is a linear predictive analysis method for obtaining a coefficient which can be converted into a linear predictive coefficient corresponding to an input time series signal for each frame which is a predetermined time interval, the linear predictive analysis method comprising an autocorrelation calculating step of calculating autocorrelation $R_o(i)$ (i=0, 1, . . . , $P_{max}$) between an input time series signal $X_o(n)$ of a current frame and an input time series signal $X_o(n-i)$ i sample before the input time series signal $X_o(n)$ or an input time series signal $X_o(n+i)$ i sample after the input time series signal $X_o(n)$ for each of at least i=0, 1, . . . , $P_{max}$, a coefficient determining step of acquiring a coefficient from one coefficient table among coefficient tables t0, t1 and t2 using a value having positive correlation with a fundamental frequency based on an input time series signal in the current frame or a past frame and a value having positive correlation with a pitch gain assuming that a coefficient $w_{t0}(i)$ (i=0, 1, . . . , $P_{max}$) is stored in the coefficient table t0, a coefficient $w_{t1}(i)$ (i=0, 1, . . . , $P_{max}$) is stored in the coefficient table t1, and a coefficient $w_{t2}(i)$ (i=0, 1, . . . , $P_{max}$) is stored in the coefficient table t2, and a predictive coefficient calculating step of obtaining a coefficient which can be converted into linear predictive coefficients from the first-order to the $P_{max}$-order using modified autocorrelation $R'_o(i)$ (i=0, 1, . . . , $P_{max}$) obtained by multiplying the autocorrelation $R_o(i)$ (i=0, 1, . . . , $P_{max}$) by the acquired coefficient for each corresponding i, and, for at least part of i, $w_{t0}(i)<w_{t1}(i)\leq w_{t2}(i)$, and, for at least part of each i among other i, $w_{t0}(i)\leq w_{t1}(i)<w_{t2}(i)$, and, for the remaining each i, $w_{t0}(i)\leq w_{t1}(i)\leq w_{t2}(i)$, and, according to the value having positive correlation with the fundamental frequency and the value having positive correlation with the pitch gain, (1) when the fundamental frequency is high and the pitch gain is large, a coefficient is acquired from the coefficient table t0 in the coefficient determining step, (9) when the fundamental frequency is low and the pitch gain is small, a coefficient is acquired from the coefficient table t2 in the coefficient determining step, (2) when the fundamental frequency is high and the pitch gain is medium, (3) when the fundamental frequency is high and the pitch gain is small, (4) when the fundamental frequency is medium and the pitch gain is large, (5) when the fundamental frequency is medium and the pitch gain is medium, (6) when the fundamental frequency is medium and the pitch gain is small, (7) when the fundamental frequency is low and the pitch gain is large, and (8) when the fundamental frequency is low and the pitch gain is medium, a coefficient is acquired from any of the coefficient tables t0, t1 and t2 in the coefficient determining step, in the case of at least one of (2), (3), (4), (5), (6), (7) and (8), a coefficient is acquired from the coefficient table t1 in the coefficient determining step, and, assuming that an identification number of a coefficient table $tj_k$ from which a coefficient is acquired in the coefficient determining step in the case of (k) where k=1, 2, . . . , 9 is $j_k$, $j_1\leq j_2\leq j_3$, $j_4\leq j_5\leq j_6$, $j_7\leq j_8\leq j_9$, $j_1\leq j_4\leq j_7$, $j_2\leq j_5\leq j_8$, and $j_3\leq j_6\leq j_9$.

Effects of the Invention

It is possible to realize linear prediction with higher analysis precision that of a conventional one.

BRIEF DESCRIPTION OF THE DRAWINGS

FIG. 5 is a diagram illustrating an example of relationship between a fundamental frequency and a pitch gain, and a coefficient;

FIG. 6 is a diagram illustrating an example of relationship between a period and a pitch gain, and a coefficient;

FIG. 10 is a diagram illustrating an example of relationship between a fundamental frequency and a pitch gain, and a selected coefficient table;

DETAILED DESCRIPTION OF THE EMBODIMENTS

Each embodiment of a linear predictive analysis apparatus and method will be described below with reference to the drawings.

First Embodiment

Figure 1:
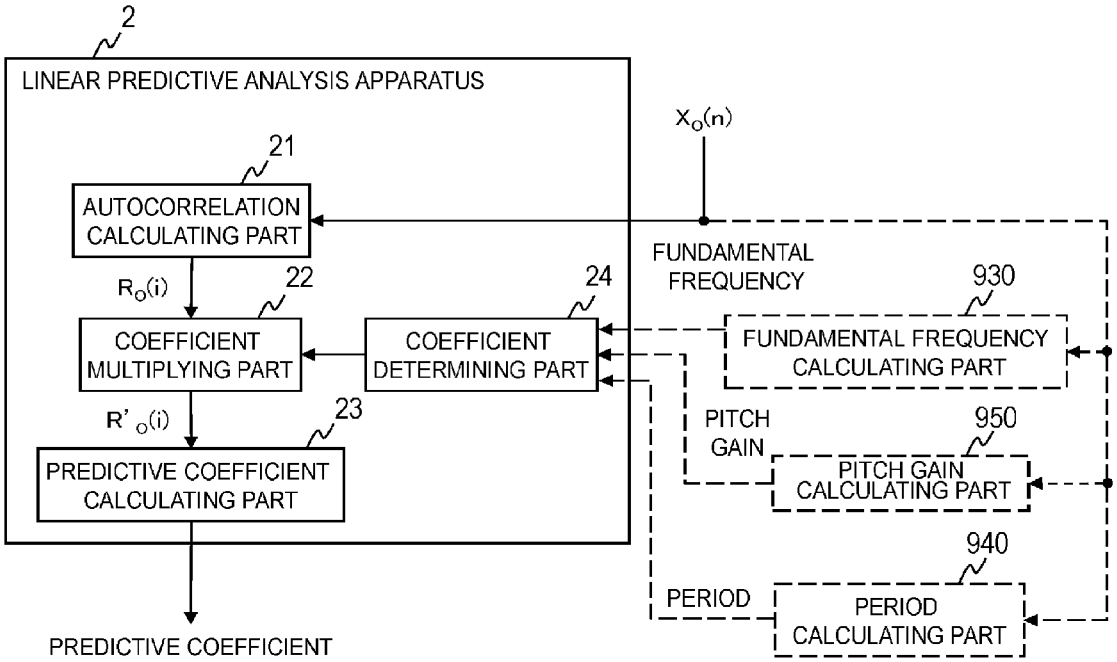
FIG. 1 is a block diagram for explaining an example of a linear predictive apparatus according to a first embodiment and a second embodiment.

As illustrated in FIG. 1, a linear predictive analysis apparatus 2 of the first embodiment comprises, for example, an autocorrelation calculating part 21, a coefficient determining part 24, a coefficient multiplying part 22 and a predictive coefficient calculating part 23. Each operation of the autocorrelation calculating part 21, the coefficient multiplying part 22 and the predictive coefficient calculating part 23 is the same as each operation of an autocorrelation calculating part 11, a coefficient multiplying part 12 and a predictive coefficient calculating part 13 in a conventional linear predictive analysis apparatus 1.

To the linear predictive analysis apparatus 2, an input signal $X_o(n)$ which is a digital audio signal or a digital acoustic signal in a time domain for each frame which is a predetermined time interval, or a digital signal such as an electrocardiogram, an electroencephalogram, magnetic encephalography and a seismic wave is inputted. The input signal is an input time series signal. An input signal of the current frame is set at $X_o(n)$ (n=0, 1, . . . , N−1). n indicates a sample number of each sample in the input signal, and N is a predetermined positive integer. Here, an input signal of the frame one frame before the current frame is $X_o(n)$ (n=−N, −N+1, . . . , −1), and an input signal of the frame one frame after the current frame is $X_o(n)$ (n=N, N+1, . . . , 2N−1). In the following, a case will be described where the input signal $X_o(n)$ is a digital audio signal or a digital acoustic signal. The input signal $X_o(n)$ (n=0, 1, . . . , N−1) may be a picked up signal itself, a signal whose sampling rate is converted for analysis, a signal subjected to pre-emphasis processing or a signal multiplied by a window function.

Further, to the linear predictive analysis apparatus 2, information regarding a fundamental frequency of a digital audio signal or a digital acoustic signal and information regarding a pitch gain for each frame are also inputted. The information regarding the fundamental frequency is obtained at a fundamental frequency calculating part 930 located outside the linear predictive analysis apparatus 2. The information regarding the pitch gain is obtained at a pitch gain calculating part 950 located outside the linear predictive analysis apparatus 2.

The pitch gain is intensity of periodicity of an input signal for each frame. The pitch gain is, for example, normalized correlation between signals between which there is a time difference corresponding to a pitch period for an input signal or a linear predictive residual signal of the input signal.

[Fundamental Frequency Calculating Part 930]

The fundamental frequency calculating part 930 obtains a fundamental frequency P from all or part of the input signal $X_o(n)$ (n=0, 1, . . . , N−1) of the current frame and/or input signals of frames near the current frame. The fundamental frequency calculating part 930, for example, obtains the fundamental frequency P of the digital audio signal or the digital acoustic signal in a signal section comprising all or part of the input signal $X_o(n)$ (n=0, 1, . . . , N−1) of the current frame and outputs information which can specify the fundamental frequency P as the information regarding the fundamental frequency. Because there are various publicly known methods for obtaining a fundamental frequency, any publicly known method may be used. Further, it is also possible to employ a configuration where the obtained fundamental frequency P is encoded to obtain a fundamental frequency code, and output the fundamental frequency code as the information regarding the fundamental frequency. Still further, it is also possible to employ a configuration where a quantization value ˆP of the fundamental frequency corresponding to the fundamental frequency code is obtained, and output the quantization value ˆP of the fundamental frequency as the information regarding the fundamental frequency. A specific example of the fundamental frequency calculating part 930 will be described below.

<Specific Example 1 of Fundamental Frequency Calculating Part 930>

Specific example 1 of the fundamental frequency calculating part 930 is an example in the case where the input signal $X_o(n)$ (n=0, 1, . . . , N−1) of the current frame is constituted with a plurality of subframes, and in the case where the fundamental frequency calculating part 930 performs operation prior to the linear predictive analysis apparatus 2 for the same frame. The fundamental frequency calculating part 930 first obtains fundamental frequencies $P_{s1}$, . . . , $P_{sM}$ of M subframes $X_{Os1}(n)$ (n=0, 1, . . . , N/M−1), . . . , $X_{OsM}(n)$ (n=(M−1)N/M, (M−1)N/M+1, . . . , N−1) where M is an integer equal to or greater than two. It is assumed that N is divisible by M. The fundamental frequency calculating part 930 outputs information which can specify a maximum value max($P_{s1}$, . . . , $P_{sM}$) among the fundamental frequencies $P_{s1}$, . . . , $P_{sM}$ of M subframes which constitute the current frame as the information regarding the fundamental frequency.

<Specific Example 2 of Fundamental Frequency Calculating Part 930>

Specific example 2 of the fundamental frequency calculating part 930 is an example in the case where a signal section comprising a look-ahead portion is constituted with the input signal $X_o(n)$ (n=0, 1, . . . , N−1) of the current frame and an input signal $X_o(n)$ (n=N, N+1, . . . , N+Nn−1) (where Nn is a predetermined positive integer which satisfies relationship of Nn<N) of part of the frame one frame after the current frame as a signal section of the current frame, and, in the case where the fundamental frequency calculating part 930 performs operation after the linear predictive analysis apparatus 2 for the same frame. The fundamental frequency calculating part 930 obtains respective fundamental frequencies $P_{now}$ and $P_{next}$ of the input signal $X_o(n)$ (n=0, 1, . . . , N−1) of the current frame and the input signal $X_o(n)$ (n=N, N+1, . . . , N+Nn−1) of part of the frame one frame after the current frame and stores the fundamental frequency $P_{next}$ in the fundamental frequency calculating part 930 for a signal section of the current frame. Further, the fundamental frequency calculating part 930 outputs information which can specify the fundamental frequency $P_{next}$ which is obtained for a signal section of the frame one frame before the current frame and stored in the fundamental frequency calculating part 930, that is, a fundamental frequency obtained for the input signal $X_o(n)$ (n=0, 1, . . . , Nn−1) of part of the current frame among the signal section of the frame one frame before the current frame as the information regarding the fundamental frequency. It should be noted that, as with specific example 1, it is also possible to obtain a fundamental frequency for each of a plurality of subframes for the current frame.

<Specific Example 3 of Fundamental Frequency Calculating Part 930>

Specific example 3 of the fundamental frequency calculating part 930 is an example in the case where the input signal $X_o(n)$ (n=0, 1, . . . , N−1) of the current frame itself is constituted as the signal section of the current frame, and in the case where the fundamental frequency calculating part 930 performs operation after the linear predictive analysis apparatus 2 for the same frame. The fundamental frequency calculating part 930 obtains the fundamental frequency P of the input signal $X_o(n)$ (n=0, 1, . . . , N−1) of the current frame which is the signal section of the current frame and stores the fundamental frequency P in the fundamental frequency calculating part 930. Further, the fundamental frequency calculating part 930 outputs information which can specify the fundamental frequency P which is obtained for the signal section of the frame one frame before the current frame, that is, the input signal $X_o(n)$ (n=−N, −N+1, . . . , −1) of the frame one frame before the current frame and stored in the fundamental frequency calculating part 930 as the information regarding the fundamental frequency.

[Pitch Gain Calculating Part 950]

The pitch gain calculating part 950 obtains a pitch gain G from all or part of an input signal $X_o(n)$ (n=0, 1, . . . , N−1) of the current frame and/or input signals of frames near the current frame. The pitch gain calculating part 950 obtains, for example, a pitch gain G of a digital audio signal or a digital acoustic signal in a signal section comprising all or part of the input signal $X_o(n)$ (n=0, 1, . . . , N−1) of the current frame and outputs information which can specify the pitch gain G as information regarding the pitch gain. There are various publicly known methods for obtaining a pitch gain, and any publicly known method may be employed. Further, it is also possible to employ a configuration where the obtained pitch gain G is encoded to obtain a pitch gain code, and the pitch gain code is outputted as the information regarding the pitch gain. Still further, it is also possible to employ a configuration where a quantization value ˆG of the pitch gain corresponding to the pitch gain code is obtained and the quantization value ˆG of the pitch gain is outputted as the information regarding the pitch gain. A specific example of the pitch gain calculating part 950 will be described below.

<Specific Example 1 of Pitch Gain Calculating Part 950>

A specific example 1 of the pitch gain calculating part 950 is an example where the input signal $X_o(n)$ (n=0, 1, . . . , N−1) of the current frame is constituted with a plurality of subframes, and the pitch gain calculating part 950 performs operation before the linear predictive analysis apparatus 2 performs operation for the same frame. The pitch gain calculating part 950 first obtains $G_{s1}$, . . . , $G_{sM}$ which are respectively pitch gains of $X_{Os1}(n)$ (n=0, 1, . . . , N/M−1), . . . , $X_{OsM}(n)$ (n=(M−1)N/M, (M−1)N/M+1, . . . , N−1) which are M subframes where M is an integer of two or greater. It is assumed that N is divisible by M. The pitch gain calculating part 950 outputs information which can specify a maximum value max ($G_{s1}$, . . . , $G_{sM}$) among $G_{s1}$, . . . , $G_{sM}$ which are pitch gains of M subframes constituting the current frame as the information regarding the pitch gain.

<Specific Example 2 of Pitch Gain Calculating Part 950>

A specific example 2 of the pitch gain calculating part 950 is an example where a signal section comprising a look-ahead portion is constituted with the input signal $X_o(n)$ (n=0, 1, . . . , N−1) of the current frame and the input signal $X_o(n)$ (n=N, N+1, . . . , N+Nn−1) of part of the frame one frame after the current frame as a signal section of the current frame, and the pitch gain calculating part 950 performs operation after the linear predictive analysis apparatus 2 performs operation for the same frame. The pitch gain calculating part 950 obtains $G_{now}$ and $G_{next}$ which are respectively pitch gains of the input signal $X_o(n)$ (n=0, 1, . . . , N−1) of the current frame and the input signal $X_o(n)$ (n=N, N+1, . . . , N+Nn−1) of part of the frame one frame after the current frame for a signal section of the current frame and stores the pitch gain $G_{next}$ in the pitch gain calculating part 950. Further, the pitch gain calculating part 950 outputs information which can specify the pitch gain $G_{next}$ which is obtained for a signal section of the frame one frame before the current frame and stored in the pitch gain calculating part 950, that is, a pitch gain obtained for the input signal $X_o(n)$ (n=0, 1, . . . , Nn−1) of part of the current frame in the signal section of the frame one frame before the current frame as the information regarding the pitch gain. It should be noted that as in the specific example 1, it is also possible to obtain a pitch gain for each of a plurality of subframes for the current frame.

<Specific Example 3 of Pitch Gain Calculating Part 950>

A specific example 3 of the pitch gain calculating part 950 is an example where the input signal $X_o(n)$ (n=0, 1, . . . , N−1) itself of the current frame is constituted as a signal section of the current frame, and the pitch gain calculating part 950 performs operation after the linear predictive analysis apparatus 2 performs operation. The pitch gain calculating part 950 obtains a pitch gain G of the input signal $X_o(n)$ (n=0, 1, . . . , N−1) of the current frame which is a signal section of the current frame and stores the pitch gain G in the pitch gain calculating part 950. Further, the pitch gain calculating part 950 outputs information which can specify the pitch gain G which is obtained for a signal section of the frame one frame before the current frame, that is, the input signal $X_o(n)$ (n=−N, −N+1, . . . , −1) of the frame one frame before the current frame and stored in the pitch gain calculating part 950 as the information regarding the pitch gain.

Figure 2:
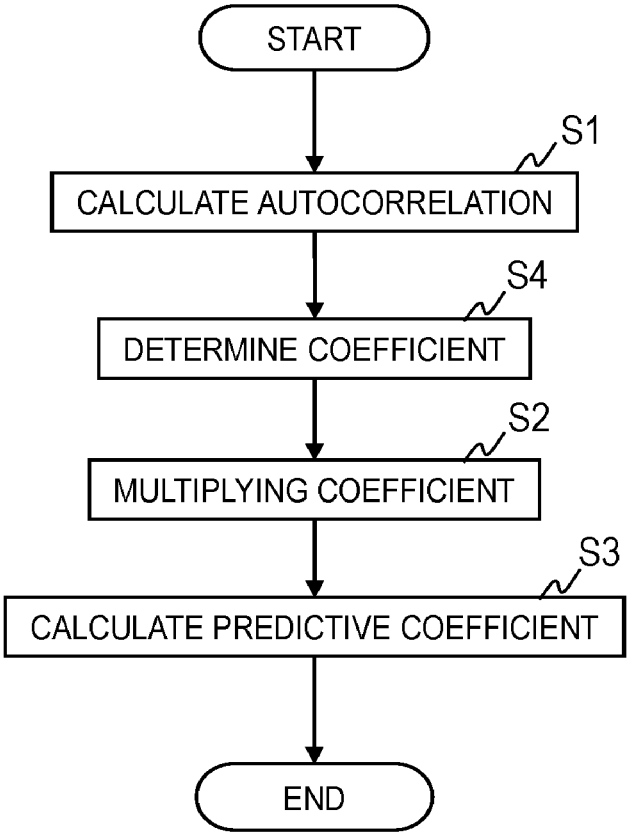
FIG. 2 is a flowchart for explaining an example of a linear predictive analysis method.

The operation of the linear predictive analysis apparatus 2 will be described below. FIG. 2 is a flowchart of a linear predictive analysis method by the linear predictive analysis apparatus 2.

[Autocorrelation Calculating Part 21]

The autocorrelation calculating part 21 calculates autocorrelation $R_o(i)$ (i=0, 1, . . . , $P_{max}$) from the input signal $X_o(n)$ (n=0, 1, . . . , N−1) which is a digital audio signal or a digital acoustic signal in a time domain for each frame of inputted N samples (step S1). $P_{max}$ is a maximum order of a coefficient which can be converted into a linear predictive coefficient, obtained by the predictive coefficient calculating part 23, and is a predetermined positive integer less than N. The calculated autocorrelation $R_o(i)$ (i=0, 1, . . . , $P_{max}$) is provided to the coefficient multiplying part 22.

The autocorrelation calculating part 21 calculates and outputs autocorrelation $R_o(i)$ (i=0, 1, . . . , $P_{max}$) defined by, for example, equation (14A) using the input signal $X_o(n)$. That is, the autocorrelation calculating part 21 calculates autocorrelation $R_o(i)$ between the input time series signal $X_o(n)$ of the current frame and an input time series signal $X_o(n-i)$ sample before the input time series signal $X_o(n)$.

[Formula 4]

$$R_o(i) = \sum_{n=i}^{N-1} X_o(n) \times X_o(n-i) \tag{14A}$$

Alternatively, the autocorrelation calculating part 21 calculates the autocorrelation $R_o(i)$ (i=0, 1, . . . , $P_{max}$) through, for example, equation (14B) using the input signal $X_o(n)$. That is, the autocorrelation calculating part 21 calculates the autocorrelation $R_o(i)$ between the input time series signal $X_o(n)$ of the current frame and an input time series signal $X_o(n+i)$ i sample after the input time series signal $X_o(n)$.

[Formula 5]

$$R_o(i) = \sum_{n=0}^{N-1-i} X_o(n) \times X_o(n+i) \tag{14B}$$

Alternatively, the autocorrelation calculating part 21 may calculate the autocorrelation $R_o(i)$ (i=0, 1, . . . , $P_{max}$) according to Wiener-Khinchin theorem after obtaining a power spectrum corresponding to the input signal $X_o(n)$. Further, in any method, the autocorrelation $R_o(i)$ may be calculated using part of input signals such as input signals $X_o(n)$ (n=−Np, −Np+1, . . . , −1, 0, 1, . . . , N−1, N, . . . , N−1+Nn), of frames before and after the current frame. Here, Np and Nn are respectively predetermined positive integers which satisfy Np<N and Nn<N. Alternatively, it is also possible to use as a substitute an MDCT series as an approximation of the power spectrum and obtain autocorrelation from the approximated power spectrum. In this manner, any publicly known technique which is commonly used may be employed as a method for calculating autocorrelation.

[Coefficient Determining Part 24]

The coefficient determining part 24 determines a coefficient $w_o(i)$ (i=0, 1, . . . , $P_{max}$) using the inputted information regarding the fundamental frequency and the inputted information regarding the pitch gain (step S4). The coefficient $w_o(i)$ is a coefficient for modifying the autocorrelation $R_o(i)$. The coefficient $w_o(i)$ is also referred to as a lag window $w_o(i)$ or a lag window coefficient $w_o(i)$ in a field of signal processing. Because the coefficient $w_o(i)$ is a positive value, when the coefficient $w_o(i)$ is greater/smaller than a predetermined value, it is sometimes expressed that the magnitude of the coefficient $w_o(i)$ is larger/smaller than that of the predetermined value. Further, the magnitude of $w_o(i)$ means a value of $w_o(i)$.

The information regarding the fundamental frequency inputted to the coefficient determining part 24 is information which specifies the fundamental frequency obtained from all or part of the input signal of the current frame and/or the input signals of frames near the current frame. That is, the fundamental frequency used to determine the coefficient $w_o(i)$ is a fundamental frequency obtained from all or part of the input signal of the current frame and/or the input signals of the frames near the current frame.

The information regarding the pitch gain inputted to the coefficient determining part 24 is information for specifying a pitch gain obtained from all or part of the input signal of the current frame and/or input signals of frames near the current frame. That is, the pitch gain to be used to determine the coefficient $w_o(i)$ is a pitch gain obtained from all or part of the input signal of the current frame and/or the input signals of the frames near the current frame.

The fundamental frequency corresponding to the information regarding the fundamental frequency and the pitch gain corresponding to the information regarding the pitch gain may be calculated from input signals in the same frame or may be calculated from input signals in different frames.

The coefficient determining part 24 determines values which may be smaller when the fundamental frequency corresponding to the information regarding the fundamental frequency is greater, and which may be smaller when the pitch gain corresponding to the information regarding the pitch gain is larger in all or part of a possible range of the fundamental frequency corresponding to the information regarding the fundamental frequency and the pitch gain corresponding to the information regarding the pitch gain for all or part of orders from the zero-order to $P_{max}$-order, as coefficients $w_o(0)$, $w_o(1)$, . . . , $w_o(P_{max})$. Further, the coefficient determining part 24 may determine these coefficients $w_o(0)$, $w_o(1)$, . . . , $w_o(P_{max})$ using the value having positive correlation with the fundamental frequency in place of the fundamental frequency and/or using the value having positive correlation with the pitch gain in place of the pitch gain.

That is, the coefficients $w_o(i)$ (i=0, 1, . . . , $P_{max}$) are determined so as to comprise a case where, for at least part of prediction order i, the magnitude of the coefficient $w_o(i)$ corresponding to the order i monotonically decreases as the value having positive correlation with the fundamental frequency in a signal section comprising all or part of the input signal $X_o(n)$ of the current frame increases, and a case where the magnitude of the coefficient $w_o(i)$ monotonically decreases as the value having positive correlation with the pitch gain increases. In other words, as will be described later, according to the order i, a case where the magnitude of the coefficient $w_o(i)$ does not monotonically decrease as the fundamental frequency increases and/or a case where the magnitude of the coefficient $w_o(i)$ does not monotonically decrease as the value having positive correlation with the pitch gain increases, may be comprised.

Further, in the possible range of the value having positive correlation with the fundamental frequency, while the magnitude of the coefficient $w_o(i)$ may be fixed in some range regardless of increase of the value having positive correlation with the fundamental frequency, the magnitude of the coefficient $w_o(i)$ is set to monotonically decrease as the value having positive correlation with the fundamental frequency increases in other ranges. Further, in the possible range of the value having positive correlation with the pitch gain, while the magnitude of the coefficient $w_o(i)$ may be fixed in some range regardless of increase of the value having positive correlation with the pitch gain, the magnitude of the coefficient $w_o(i)$ is set to monotonically decrease as the value having positive correlation with the pitch gain increases in other ranges.

The coefficient determining part 24, for example, determines the coefficient $w_o(i)$ using a monotonically nonincreasing function for a weighted sum of the fundamental frequency and the pitch gain respectively corresponding to the inputted information regarding the fundamental frequency and the inputted pitch gain. For example, the coefficient determining part 24 determines the coefficient $w_o(i)$ using the following equation (1). In the following equation (1), f(G) is a function for obtaining a frequency having positive correlation with the pitch gain G, H is a sum of results obtained by respectively multiplying the fundamental frequency P and f(G) by weights δ and ϵ, that is, H=δ×P+ϵ×f(G). It should be noted that weighting coefficients δ and ϵ are positive values. That is, H means a weighted sum of the fundamental frequency and the pitch gain.

[Formula 6]

$$w_o(i) = \exp\left(-\frac{1}{2}\left(\frac{2\pi Hi}{f_s}\right)^2\right),\ i = 0, 1, \ldots, P_{max} \tag{1}$$

Alternatively, the coefficient $w_o(i)$ may be determined using the following equation (2) which uses α which is a value defined in advance greater than zero. α is a value for adjusting a width of a lag window when the coefficient $w_o(i)$ is regarded as a lag window, in other words, intensity of the lag window. α defined in advance may be determined by, for example, encoding and decoding an audio signal or an acoustic signal for a plurality of candidate values for α at an encoding apparatus comprising the linear predictive analysis apparatus 2 and at a decoding apparatus corresponding to the encoding apparatus and selecting a candidate value whose subjective quality or objective quality of the decoded audio signal or the decoded acoustic signal is favorable as α.

[Formula 7]

$$w_o(i) = \exp\left(-\frac{1}{2}\left(\frac{2\pi\alpha Hi}{f_s}\right)^2\right),\ i = 0, 1, \ldots, P_{max} \tag{2}$$

Alternatively, the coefficient $w_o(i)$ may be determined using the following equation (2A) which uses a function f(P, G) defined in advance for both the fundamental frequency P and the pitch gain G. The function f(P, G) has positive correlation with the fundamental frequency P and has positive correlation with the pitch gain G. In other words, the function f(P, G) is a function which monotonically nondecreases for the fundamental frequency P and monotonically nondecreases for the pitch gain G. For example, when the function $f_P(P)$ is set such that $f_P(P)=\alpha_P\times P+\beta_P$ (where $\alpha_P$ is a positive value and $\beta_P$ is an arbitrary value), $f_P(P)=\alpha_P\times P^2+\beta_P\times P+\gamma_P$ (where $\alpha_P$ is a positive value and $\beta_P$ and $\gamma_P$ are arbitrary values) or the like, and the function $f_G(G)$ is set such that $f_G(G)=\alpha_G\times G+\beta_G$ (where $\alpha_G$ is a positive value and $\beta_G$ is an arbitrary value), $f_G(G)=\alpha_G\times G^2+\beta_G+\gamma_G$ (where $\alpha_G$ is a positive value and $\beta_G$ and $\gamma_G$ are arbitrary values), or the like, the function f(P, G) is such that $f(P, G)=\delta\times f_P(P)+\epsilon\times f_G(G)$, or the like.

[Formula 8]

$$w_o(i) = \exp\left(-\frac{1}{2}\left(\frac{2\pi f(P, G)i}{f_s}\right)^2\right),\ i = 0, 1, \ldots, P_{max} \tag{2A}$$

Further, an equation for determining the coefficient $w_o(i)$ using the fundamental frequency P and the pitch gain G is not limited to the above-described equations (1), (2) and (2A), and any equation may be employed if the equation can describe monotonically nonincreasing relationship with respect to increase of the value having positive correlation with the fundamental frequency and monotonically nonincreasing relationship with respect to increase of the value having positive correlation with the pitch gain. For example, the coefficient $w_o(i)$ may be determined using any of the following equations (3) to (6). In the following equations (3) to (6), a is set as a real number determined depending on the weighted sum of the fundamental frequency and the pitch gain, and m is set as a natural number determined depending on the weighted sum of the fundamental frequency and the pitch gain. For example, a is set as a value having negative correlation with the weighted sum of the fundamental frequency and the pitch gain, and m is set as a value having negative correlation with the weighted sum of the fundamental frequency and the pitch gain. τ is a sampling period.

[Formula 9]

$$w_o(i) = 1 - \tau i/a,\ i = 0, 1, \ldots, P_{max} \tag{3}$$

$$w_o(i) = \binom{2m}{m-i} \Big/ \binom{2m}{m},\ i = 0, 1, \ldots, P_{max} \tag{4}$$

$$w_o(i) = \left(\frac{\sin a\tau i}{a\tau i}\right)^2,\ i = 0, 1, \ldots, P_{max} \tag{5}$$

$$w_o(i) = \left(\frac{\sin a\tau i}{a\tau i}\right),\ i = 0, 1, \ldots, P_{max} \tag{6}$$

The equation (3) is a window function in a form called "Bartlett window", the equation (4) is a window function in a form called "Binomial window" defined using a binomial coefficient, the equation (5) is a window function in a form called "Triangular in frequency domain window", and the equation (6) is a window function in a form called "Rectangular in frequency domain window".

It can be known that in any example of equation (1) to equation (6), the value of the coefficient $w_o(i)$ when the weighted sum H of the fundamental frequency and the pitch gain is small is greater than the coefficient $w_o(i)$ when H is great.

It should be noted that the coefficient $w_o(i)$ may monotonically decrease as the value having positive correlation with the fundamental frequency increases or as the value having positive correlation with the pitch gain increases not for each i of $0\le i\le P_{max}$, but only for at least part of order i. In other words, depending on the order i, the magnitude of the coefficient $w_o(i)$ does not have to monotonically decrease as the value having positive correlation with the fundamental frequency increases, or does not have to monotonically decrease as the value having positive correlation with the pitch gain increases.

For example, when i=0, the value of the coefficient $w_o(0)$ may be determined using any of the above-described equation (1) to equation (6), or a fixed value, such as $w_o(0)=1.0001$, $w_o(0)=1.003$ as also used in ITU-T G.718, or the like, which does not depend on the value having positive correlation with the fundamental frequency or the value having positive correlation with the pitch gain and which is empirically obtained, may be used. That is, for each i of $1\le i\le P_{max}$, while the value of the coefficient $w_o(i)$ is smaller as the value having positive correlation with the fundamental frequency or the value having positive correlation with the pitch gain is greater, the coefficient when i=0 is not limited to this, and a fixed value may be used.

Further, the value used to determine the coefficient is not limited to the weighted sum of the fundamental frequency and the pitch gain, and a value having positive correlation with both the fundamental frequency and the pitch gain, such as a value obtained by multiplying the fundamental frequency by the pitch gain may be used. In short, it is only necessary to use at least one of a coefficient $w_o(i)$ which is smaller as the fundamental frequency is greater, and a coefficient $w_o(i)$ which is smaller as the pitch gain is larger based on both the fundamental frequency and the pitch gain.

[Coefficient Multiplying Part 22]

The coefficient multiplying part 22 obtains modified autocorrelation $R'_o(i)$ ($i=0, 1, \ldots, P_{max}$) by multiplying the autocorrelation $R_o(i)$ ($i=0, 1, \ldots, P_{max}$) obtained at the autocorrelation calculating part 21 by the coefficient $w_o(i)$ ($i=0, 1, \ldots, P_{max}$) determined at the coefficient determining part 24 for each of the same i (step S2). That is, the coefficient multiplying part 22 calculates the autocorrelation $R'_o(i)$ through the following equation (7). The calculated autocorrelation $R'_o(i)$ is provided to the predictive coefficient calculating part 23.

[Formula 10]

$$R'_o(i)=R_o(i)\times w_o(i) \tag{7}$$

[Predictive Coefficient Calculating Part 23]

The predictive coefficient calculating part 23 obtains a coefficient which can be converted into a linear predictive coefficient using the modified autocorrelation $R'_o(i)$ outputted from the coefficient multiplying part 22 (step S3).

For example, the predictive coefficient calculating part 23 calculates and outputs PARCOR coefficients $K_o(1)$, $K_o(2), \ldots, K_o(P_{max})$ and linear predictive coefficients $a_o(1)$, $a_o(2), \ldots, a_o(P_{max})$ from the first-order to the $P_{max}$-order which is a prediction order defined in advance using the modified autocorrelation $R'_o(i)$ using a Levinson-Durbin method, or the like.

According to the linear predictive analysis apparatus 2 according to the first embodiment, according to the value having positive correlation with the fundamental frequency and the pitch gain, by obtaining modified autocorrelation by multiplying the autocorrelation by the coefficient $w_o(i)$ which comprises a case where, for at least part of the prediction order i, the magnitude of the coefficient $w_o(i)$ corresponding the order i monotonically decreases as the value having positive correlation with the fundamental frequency in a signal section comprising all or part of the input signal $X_o(n)$ of the current frame increases and a case where the magnitude of the coefficient $w_o(i)$ monotonically decreases as the value having positive correlation with the pitch gain increases, and obtaining a coefficient which can be converted into a linear predictive coefficient, even when the fundamental frequency and the pitch gain of the input signal are high, it is possible to obtain a coefficient which can be converted into a linear predictive coefficient in which occurrence of a peak of a spectrum due to a pitch component is suppressed, and, even when the fundamental frequency and the pitch gain of the input signal are low, it is possible to obtain a coefficient which can be converted into a linear predictive coefficient which can express a spectral envelope, so that it is possible to realize analysis precision higher than that of the conventional one. Therefore, quality of a decoded audio signal or a decoded acoustic signal obtained by encoding and decoding an audio signal or an acoustic signal at an encoding apparatus comprising the linear predictive analysis apparatus 2 of the first embodiment and at a decoding apparatus corresponding to the encoding apparatus is higher than quality of a decoded audio signal or a decoded acoustic signal obtained by encoding and decoding an audio signal or an acoustic signal at an encoding apparatus comprising the conventional linear predictive analysis apparatus and at a decoding apparatus corresponding to the encoding apparatus.

Modified Example of First Embodiment

In a modified example of the first embodiment, the coefficient determining part 24 determines the coefficient $w_o(i)$ based on a value having negative correlation with the fundamental frequency and the value having positive correlation with the pitch gain instead of the value having positive correlation with the fundamental frequency and the pitch gain.

The value having negative correlation with the fundamental frequency is, for example, a period, an estimate value of the period or a quantization value of the period. For example, when the period is T, the fundamental frequency is P and the sampling frequency is $f_s$, because $T=f_s/P$, the period has negative correlation with the fundamental frequency. An example where the coefficient $w_o(i)$ is determined based on the value having negative correlation with the fundamental frequency and the value having positive correlation with the pitch gain will be described as the modified example of the first embodiment.

A functional configuration of the linear predictive analysis apparatus 2 and a flowchart of a linear predictive analysis method by the linear predictive analysis apparatus 2 according to the modified example of the first embodiment are the same as those of the first embodiment and illustrated in FIG. 1 and FIG. 2. The linear predictive analysis apparatus 2 according to the modified example of the first embodiment is the same as the linear predictive analysis apparatus 2 according to the first embodiment except for portions of the processing of the coefficient determining part 24 which differ.

To the linear predictive analysis apparatus 2, information regarding a period of a digital audio signal or a digital acoustic signal for each frame is also inputted. The information regarding the period is obtained at the period calculating part 940 located outside the linear predictive analysis apparatus 2.

[Period Calculating Part 940]

The period calculating part 940 obtains a period T from all or part of the input signal $X_o$ of the current frame and/or input signals of frames near the current frame. The period calculating part 940, for example, obtains the period T of the digital audio signal or the digital acoustic signal in a signal section comprising all or part of the input signal $X_o(n)$ of the current frame and outputs information which can specify the period T as the information regarding the period. Because there are various publicly known methods for obtaining a period, any publicly known method may be used. Further, it is also possible to employ a configuration where the obtained period T is encoded to obtain a period code, and output the period code as the information regarding the period. Still further, it is also possible to employ a configuration where a quantization value $\hat{T}$ of the period corresponding to the period code is obtained, and output the quantization value $\hat{T}$ of the period as the information regarding the period. A specific example of the period calculating part 940 will be described below.

<Specific Example 1 of Period Calculating Part 940>

Specific example 1 of the period calculating part 940 is an example in the case where the input signal $X_o(n)$ ($n=0, 1, \ldots, N-1$) of the current frame is constituted with a plurality of subframes, and in the case where the period calculating part 940 performs operation prior to the linear predictive analysis apparatus 2 for the same frame. The period calculating part 940 first obtains respective periods $T_{s1}, \ldots, T_{sM}$ of M subframes $X_{Os1}(n)$ (n=0, 1, . . . , N/M−1), . . . , $X_{OsM}(n)$ (n=(M−1)N/M, (M−1)N/M+1, . . . , N−1) where M is an integer equal to or greater than two. It is assumed that N is divisible by M. The period calculating part 940 outputs information which can specify a minimum value $\min(T_{s1}, \ldots, T_{sM})$ among periods $T_{s1}, \ldots, T_{sM}$ of M subframes constituting the current frame as the information regarding the period.

<Specific Example 2 of Period Calculating Part 940>

Specific example 2 of the period calculating part 940 is an example in the case where a signal section comprising a look-ahead portion is constituted with the input signal $X_o(n)$ (n=0, 1, . . . , N−1) of the current frame and an input signal $X_o(n)$ (n=N, N+1, . . . , N+Nn−1) (where Nn is a predetermined positive integer which satisfies Nn<N) of part of the frame one frame after the current frame as the signal section of the current frame, and in the case where the period calculating part 940 performs operation after the linear predictive analysis apparatus 2 for the same frame. The period calculating part 940 obtains respective periods $T_{now}$ and $T_{next}$ of the input signal $X_o(n)$ (n=0, 1, . . . , N−1) of the current frame and the input signal $X_o(n)$ (n=N, N+1, . . . , N+Nn−1) of part of the frame one frame after the current frame for the signal section of the current frame and stores the period $T_{next}$ in the period calculating part 940. Further, the period calculating part 940 outputs information which can specify the period $T_{next}$ which is obtained for a signal section of the frame one frame before the current frame and stored in the period calculating part 940, that is, a period obtained for the input signal $X_o(n)$ (n=0, 1, . . . , Nn−1) of part of the current frame in the signal section of the frame one frame before the current frame, as the information regarding the period. It should be noted that, as with specific example 1, it is also possible to obtain a period for each of a plurality of subframes for the current frame.

<Specific Example 3 of Period Calculating Part 940>

Specific example 3 of the period calculating part 940 is an example in the case where the input signal $X_o(n)$ (n=0, 1, . . . , N−1) of the current frame itself is constituted as the signal section of the current frame and in the case where the period calculating part 940 performs operation after the linear predictive analysis apparatus 2 for the same frame. The period calculating part 940 obtains the period T of the input signal $X_o(n)$ (n=0, 1, . . . , N−1) of the current frame which is the signal section of the current frame and stores the period T in the period calculating part 940. The period calculating part 940 further outputs information which can specify the period T which is obtained for the signal section of the frame one frame before the current frame, that is, the input signal $X_o(n)$ (n=−N, −N+1, . . . , −1) of the frame one frame before the current frame and stored in the period calculating part 940 as the information regarding the period.

Further, as with the first embodiment, to the linear predictive analysis apparatus 2, information regarding the pitch gain is also inputted. The information regarding the pitch gain is obtained at a pitch gain calculating part 950 located outside the linear predictive analysis apparatus 2 as with the first embodiment.

Among the operation of the linear predictive analysis apparatus 2 according to the modified example of the first embodiment, processing of the coefficient determining part 24 which is different from that of the linear predictive analysis apparatus 2 in the first embodiment will be described below.

[Coefficient Determining Part 24 of Modified Example]

The coefficient determining part 24 of the linear predictive analysis apparatus 2 according to the modified example of the first embodiment determines the coefficient $w_o(i)$ (i=0, 1, . . . , $P_{max}$) using the inputted information regarding the period and the inputted information regarding the pitch gain (step S4).

The information regarding the period inputted to the coefficient determining part 24 is information for specifying the period obtained from all or part of the input signal of the current frame and input signals of frames near the current frame. That is, the period used to determine the coefficient $w_o(i)$ is a period obtained from all or part of the input signal of the current frame and/or the input signals of the frames near the current frame.

The information regarding the pitch gain inputted to the coefficient determining part 24 is information for specifying a pitch gain obtained from all or part of the input signal of the current frame and/or the input signals of the frames near the current frame. That is, the pitch gain used to determine the coefficient $w_o(i)$ is a pitch gain obtained from all or part of the input signal of the current frame and/or the input signals of the frames near the current frame.

The period corresponding to the information regarding the period and the pitch gain corresponding to the information regarding the pitch gain may be calculated from input signals in the same frame or may be calculated from input signals in different frames.

The coefficient determining part 24 determines values which may be greater as the period corresponding to the information regarding the period is greater and which may be smaller as the pitch gain corresponding to the information regarding the pitch gain is larger in all or part of a possible range of the period corresponding to the information regarding the period and the pitch gain corresponding to the information regarding the pitch gain as coefficients $w_o(0)$, $w_o(1)$, . . . , $w_o(P_{max})$ for all or part of orders from the zero-order to the $P_{max}$-order. Further, the coefficient determining part 24 may determine the values as such coefficients $w_o(0)$, $w_o(1)$, . . . , $w_o(P_{max})$ using the value having positive correlation with the period in place of the period and/or the value having positive correlation with the pitch gain in place of the pitch gain.

That is, the coefficient $w_o(i)$ (i=0, 1, . . . , $P_{max}$) is determined so as to comprise a case where, for at least part of prediction order i, the magnitude of the coefficient $w_o(i)$ corresponding to the order i monotonically increases as the value having negative correlation with the fundamental frequency in the signal section comprising all or part of the input signal $X_o(n)$ of the current frame increases and a case where the magnitude of the coefficient $w_o(i)$ monotonically decreases as the value having positive correlation with the pitch gain in the signal section comprising all or part of the input signal $X_o(n)$ of the current frame increases.

In other words, according to the order i, a case where the magnitude of the coefficient $w_o(i)$ does not monotonically increase as the value having negative correlation with the fundamental frequency increases and/or a case where the magnitude of the coefficient $w_o(i)$ does not monotonically decrease as the value having positive correlation with the pitch gain increases, may be comprised.

Further, in a possible range of the value having negative correlation with the fundamental frequency, while the magnitude of the coefficient $w_o(i)$ may be fixed regardless of increase of the value having negative correlation with the fundamental frequency in some range, the magnitude of the coefficient $w_o(i)$ is set to monotonically increase in other ranges as the value having negative correlation with the fundamental frequency increases. Further, in a possible range of the value having positive correlation with the pitch gain, while the magnitude of the coefficient $w_o(i)$ may be fixed regardless of increase of the value having positive correlation with the pitch gain in some range, the magnitude of the coefficient $w_o(i)$ is set to monotonically decrease in other ranges as the value having positive correlation with the pitch gain increases.

The coefficient determining part 24 determines the coefficient $w_o(i)$ using, for example, these equations in which H in the above-described equation (1) and equation (2) is substituted with the following H'.

$$H'=\zeta\times f_s/T+\epsilon\times F(G)$$

where $\zeta$ and $\epsilon$ are weighting coefficients and positive values. That is, as T is greater, the value of H' is smaller, and as F(G) is greater, the value of H' is greater.

Alternatively, the coefficient $w_o(i)$ may be determined using the following equation (2B) which uses a function f(T, G) defined in advance for both the period T and the pitch gain G. The function f(T, G) is a function having negative correlation with the period T and having positive correlation with the pitch gain G. In other words, the function f(T, G) is a function which monotonically nonincreases for the period T, and which monotonically nondecreases for the pitch gain G. For example, when $f_T(T)$ is set such that $f_T(T)=\alpha_T\times T+\beta_T$ (where $\alpha_T$ is a positive value and $\beta_T$ is an arbitrary value), $f_T(T)=\alpha_T\times T^2+\beta_T\times T+\gamma_T$ (where $\alpha_T$ is a positive value, and $\beta_T$ and $\gamma_T$ are arbitrary values), or the like, and the function $f_G(G)$ is set such that $f_G(G)=\alpha_G\times G+\beta_G$ (where $\alpha_G$ is a positive value, and $\beta_G$ is an arbitrary value), $f_G(G)=\alpha_G\times G^2+\beta_G\times G+\gamma_G$ (where $\alpha_G$ is a positive value, and $\beta_G$ and $\gamma_G$ are arbitrary values), or the like, the function f(T, G) is such that $f(T, G)=\zeta\times f_s/f_T(T)+\epsilon\times f_G(G)$, or the like.

[Formula 11]

$$w_o(i) = \exp\left(-\frac{1}{2}\left(\frac{2\pi f(T, G)i}{f_s}\right)^2\right),\ i = 0, 1, \ldots, P_{max} \tag{2B}$$

It should be noted that the coefficient $w_o(i)$ may monotonically increase as the value having negative correlation with the fundamental frequency increases or may monotonically decrease as the value having positive correlation with the pitch gain increases not for each i of $0\le i\le P_{max}$, but for at least part of order i. In other words, according to order i, the magnitude of the coefficient $w_o(i)$ does not have to monotonically increase as the value having negative correlation with the fundamental frequency increases, or does not have to monotonically decrease as the value having positive correlation with the pitch gain increases.

For example, when i=0, the value of the coefficient $w_o(0)$ may be determined using the above-described equation (1), equation (2) and equation (2B), or a fixed value, such as $w_o(0)=1.0001$, $w_o(0)=1.003$ as also used in ITU-T G.718, or the like, which does not depend on the value having negative correlation with the fundamental frequency and the value having positive correlation with the pitch gain and which is empirically obtained, may be used. That is, for each i of $1\le i\le P_{max}$, while the value of the coefficient $w_o(i)$ is greater as the value having negative correlation with the fundamental frequency is greater, and the value of the coefficient $w_o(i)$ is smaller as the value having positive correlation with the pitch gain is greater, the coefficient when i=0 is not limited to this, and a fixed value may be used.

In short, it is only necessary to use at least either a coefficient $w_o(i)$ which is greater as the period is greater or a coefficient $w_o(i)$ which is smaller as the pitch gain is larger based on both the period and the pitch gain.

According to the linear predictive analysis apparatus 2 according to the modified example of the first embodiment, according to the value having negative correlation with the fundamental frequency and the value having positive correlation with the pitch gain, by obtaining a modified autocorrelation function by multiplying the autocorrelation function by the coefficient $w_o(i)$ which comprises a case where, for at least part of the prediction order i, the magnitude of the coefficient $w_o(i)$ corresponding to the order i monotonically increases as the value having negative correlation with the fundamental frequency in a signal section comprising all or part of the input signal $X_o(n)$ of the current frame increases and a case where the magnitude of the coefficient $w_o(i)$ monotonically decreases as the value having positive correlation with the pitch gain in the same signal section increases, and obtaining a coefficient which can be converted into a linear predictive coefficient, even when the fundamental frequency and the pitch gain of the input signal are high, it is possible to obtain a coefficient which can be converted into a linear predictive coefficient in which occurrence of a peak of a spectrum due to a pitch component is suppressed, and, even when the fundamental frequency and the pitch gain of the input signal are low, it is possible to obtain a coefficient which can be converted into a linear predictive coefficient which can express a spectral envelope, so that it is possible to realize linear prediction with higher analysis precision than that of the conventional one. Therefore, quality of a decoded audio signal or a decoded acoustic signal obtained by encoding and decoding an audio signal or an acoustic signal at an encoding apparatus comprising the linear predictive analysis apparatus 2 according to the modified example of the first embodiment and a decoding apparatus corresponding to the encoding apparatus is more favorable than quality of a decoded audio signal or a decoded acoustic signal obtained by encoding and decoding an audio signal or an acoustic signal at an encoding apparatus comprising a conventional linear predictive analysis apparatus and a decoding apparatus corresponding to the encoding apparatus.

Second Embodiment

In the second embodiment, a value having positive or negative correlation with a fundamental frequency of an input signal in a current frame or a past frame is compared with a predetermined threshold, a value having positive correlation with the pitch gain is compared with a predetermined threshold, and the coefficient $w_o(i)$ is determined according to these comparison results. The second embodiment is different from the first embodiment only in a method for determining the coefficient $w_o(i)$ at the coefficient determining part 24, and is the same as the first embodiment in other points. A portion different from the first embodiment will be mainly described below, and overlapped explanation of a portion which is the same as the first embodiment will be omitted.

Here, an example where the value having positive correlation with the fundamental frequency is compared with the predetermined threshold, then, the value having positive correlation with the pitch gain is compared with the predetermined threshold, and the coefficient $w_o(i)$ is determined according to these comparison results will be first described, and an example where the value having negative correlation with the fundamental frequency is compared with the predetermined threshold, then, the value having positive correlation with the pitch gain is compared with the predetermined threshold, and the coefficient $w_o(i)$ is determined according to these comparison results will be described in a first modified example of the second embodiment.

A functional configuration of the linear predictive analysis apparatus 2 of the second embodiment and a flowchart of a linear predictive analysis method according to the linear predictive analysis apparatus 2 are the same as those of the first embodiment and illustrated in FIG. 1 and FIG. 2. The linear predictive analysis apparatus 2 of the second embodiment is the same as the linear predictive analysis apparatus 2 of the first embodiment except processing of the coefficient determining part 24.

Figure 3:
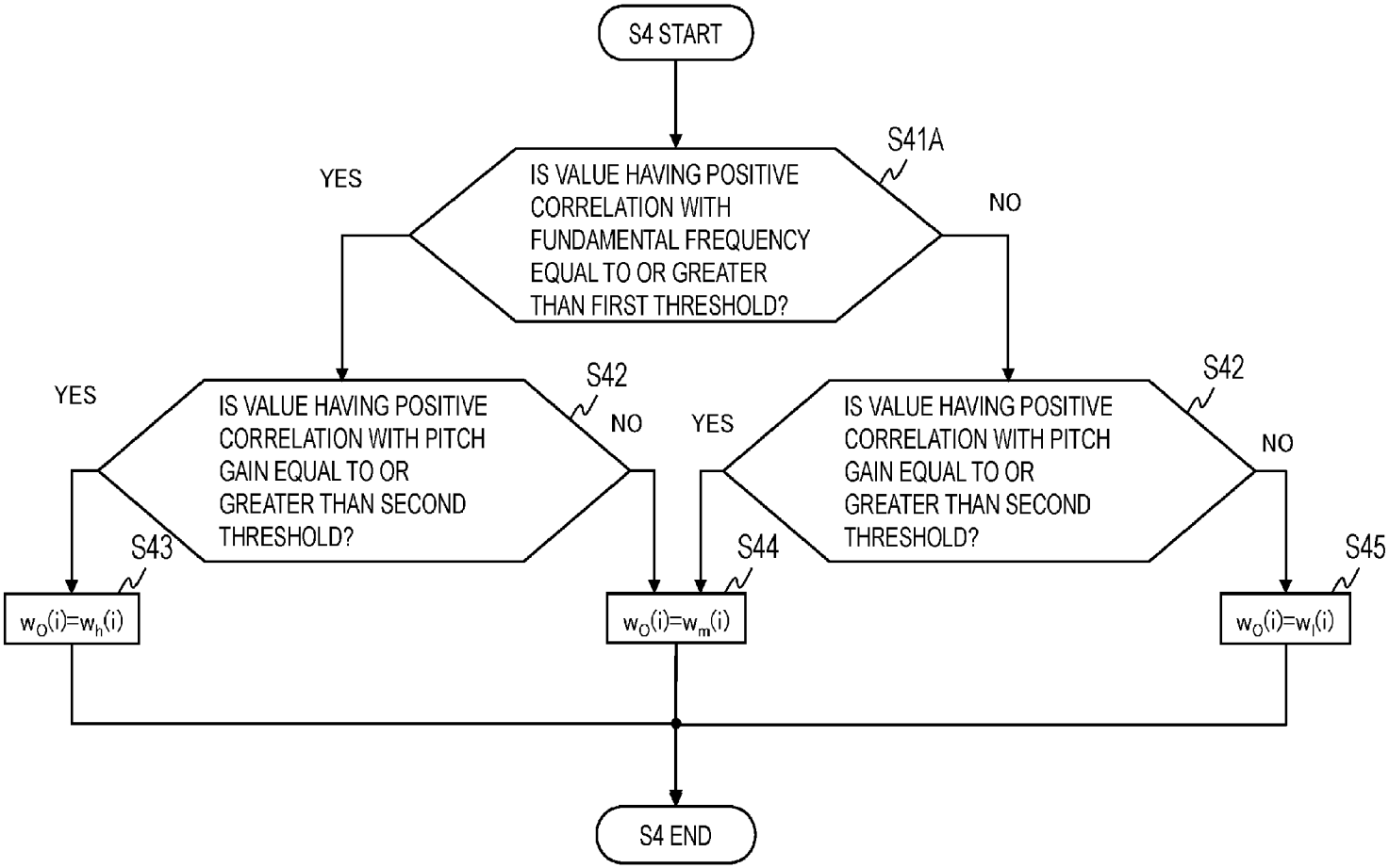
FIG. 3 is a flowchart for explaining an example of a linear predictive analysis method according to the second embodiment.

An example of flow of processing of the coefficient determining part 24 of the second embodiment is illustrated in FIG. 3. The coefficient determining part 24 of the second embodiment performs, for example, processing of each step S41A, step S42, step S43, step S44 and step S45 in FIG. 3.

The coefficient determining part 24 compares the value having positive correlation with the fundamental frequency corresponding to the inputted information regarding the fundamental frequency with a predetermined first threshold (step S41A), and compares the value having positive correlation with the pitch gain corresponding to the inputted information regarding the pitch gain with a predetermined second threshold (step S42).

The value having positive correlation with the fundamental frequency corresponding to the inputted information regarding the fundamental frequency is, for example, the fundamental frequency corresponding to the inputted information regarding the fundamental frequency itself. Further the value having positive correlation with the pitch gain corresponding to the inputted information regarding the pitch gain is, for example, the pitch gain corresponding to the inputted information regarding the pitch gain itself.

The coefficient determining part 24 determines that the fundamental frequency is high when the value having positive correlation with the fundamental frequency is equal to or greater than the predetermined first threshold, otherwise, determines that the fundamental frequency is low. Further, the coefficient determining part 24 determines that the pitch gain is larger when the value having positive correlation with the pitch gain is equal to or greater than the predetermined second threshold, otherwise, determines that the pitch gain is small.

The coefficient determining part 24 then determines the coefficient $w_h(i)$ $(i=0, 1, \ldots, P_{max})$ according to a rule defined in advance when it is determined that the fundamental frequency is high and the pitch gain is large, and sets the determined coefficient $w_h(i)$ $(i=0, 1, \ldots, P_{max})$ as $w_o(i)$ $(i=0, 1, \ldots, P_{max})$ (step S43). Further, when it is determined that the fundamental frequency is high and the pitch gain is small, or when it is determined that the fundamental frequency is low and the pitch gain is large, the coefficient determining part 24 determines a coefficient $w_m(i)$ $(i=0, 1, \ldots, P_{max})$ according to a rule defined in advance and sets the determined coefficient $w_m(i)$ $(i=0, 1, \ldots, P_{max})$ as $w_o(i)$ $(i=0, 1, \ldots, P_{max})$ (step S44). Further, when it is determined that the fundamental frequency is low and the pitch gain is small, the coefficient determining part 24 determines a coefficient $w_l(i)$ $(i=0, 1, \ldots, P_{max})$ according to a rule defined in advance and sets the determined coefficient $w_l(i)$ $(i=0, 1, \ldots, P_{max})$ as $w_o(i)$ $(i=0, 1, \ldots, P_{max})$ (step S45).

Here, $w_h(i)$, $w_m(i)$ and $w_l(i)$ are determined so as to satisfy relationship of $w_h(i)<w_m(i)<w_l(i)$ for at least part of each i. Here, at least part of each i is, for example, i other than zero (that is, $1 \le i \le P_{max}$). Alternatively, $w_h(i)$, $w_m(i)$ and $w_l(i)$ are determined so as to satisfy relationship of $w_h(i)<w_m(i) \le w_1(i)$ for at least part of each i, $w_h(i) \le w_m(i)<w_l(i)$ for at least part of each i among other i, and $w_h(i) \le w_m(i) \le w_l(i)$ for the remaining at least part of each i. Each of $w_h(i)$, $w_m(i)$ and $w_l(i)$ is determined such that the value of each $w_h(i)$, $w_m(i)$ and $w_l(i)$ becomes smaller as i becomes greater. For example, $w_h(i)$, $w_m(i)$ and $w_l(i)$ are obtained according to the rules defined in advance such that $w_o(i)$ when $H1=\delta \times P1+\epsilon \times f(G1)$ which is H when the fundamental frequency is P1 and the pitch gain is G1 is H in equation (1) is obtained as $w_h(i)$, $w_o(i)$ when $H2=\delta \times P2+\epsilon \times f(G2)$ which is H when the fundamental frequency is P2 (where P1>P2) and the pitch gain is G2 (where G1>G2) is H in equation (1) is obtained as $w_m(i)$, and $w_o(i)$ when $H3=\delta \times P3+\epsilon \times f(G3)$ which is H when the fundamental frequency is P3 (where P2>P3) and the pitch gain is G3 (where G2>G3) is H in equation (1) is obtained as $w_l(i)$.

It should be noted that it is also possible to employ a configuration where $w_h(i)$, $w_m(i)$ and $w_l(i)$ obtained in advance according to any of these rules are stored in a table and any of $w_h(i)$, $w_m(i)$ and $w_l(i)$ is selected from the table by comparing the value having positive correlation with the fundamental frequency with the predetermined threshold and comparing the value having positive correlation with the pitch gain with the predetermined threshold. It should be noted that the coefficient $w_m(i)$ between the $w_h(i)$ and $w_l(i)$ may be determined using $w_h(i)$ and $w_l(i)$. That is, it is also possible to determine $w_m(i)$ through $w_m(i)=\beta' \times w_h(i)+(1-\beta') \times w_l(i)$. Here, $\beta'$ is a value of $0 \le \beta' \le 1$, which is obtained from the fundamental frequency P and the pitch gain G using a function $\beta'=c(P, G)$ through which the value of $\beta'$ becomes greater as the fundamental frequency P or the pitch gain G are higher and the value of $\beta'$ becomes smaller as the fundamental frequency P or the pitch gain G are lower. By obtaining $w_m(i)$ in this manner, by storing only two tables of a table in which $w_h(i)$ $(i=0, 1, \ldots, P_{max})$ is stored and a table in which $w_l(i)$ $(i=0, 1, \ldots, P_{max})$ is stored in the coefficient determining part 24, it is possible to obtain a coefficient close to $w_h(i)$ when the fundamental frequency is high or the pitch gain is large among a case where it is determined that the fundamental frequency P is high and the pitch gain G is small, and a case where it is determined that the fundamental frequency P is low and the pitch gain G is large, and, inversely, it is possible to obtain a coefficient close to $w_l(i)$ when the fundamental frequency is low or the pitch gain is small among a case where it is determined that the fundamental frequency is high and the pitch gain is small and a case where it is determined that the fundamental frequency is low and the pitch gain is large.

It should be noted that $w_h(0)$, $w_m(0)$ and $w_l(0)$ when i=0 do not have to necessarily satisfy relationship of $w_h(0) \le w_m(0) \le w_l(0)$, and values which satisfy $w_h(0)>w_m(0)$ or/and $w_m(0)>w_l(0)$ may be used.

Also according to the second embodiment, as with the first embodiment, even when the fundamental frequency and the pitch gain of the input signal are high, it is possible to obtain a coefficient which can be converted into a linear predictive coefficient in which occurrence of a peak of a spectrum due to a pitch component is suppressed, and, even when the fundamental frequency and the pitch gain of the input signal are low, it is possible to obtain a coefficient which can be converted into a linear predictive coefficient which can express a spectral envelope, so that it is possible to realize linear prediction with higher analysis precision than that of the conventional one.

It should be noted that, while, in the above description, there are three types of coefficients $w_h(i)$, $w_m(i)$ and $w_l(i)$, the number of types of the coefficients may be two. For example, only two types of coefficients $w_h(i)$ and $w_l(i)$ may be used. In other words, in the above description, $w_m(i)$ may be equal to $w_h(i)$ or $w_l(i)$.

For example, the coefficient determining part 24 determines the coefficient $w_h(i)$ ($i=0, 1, \ldots, P_{max}$) when it is determined that the fundamental frequency is high and the pitch gain is large, and sets the determined coefficient $w_h(i)$ ($i=0, 1, \ldots, P_{max}$) as the coefficient $w_o(i)$ ($i=0, 1, \ldots, P_{max}$). In other cases, the coefficient determining part 24 determines the coefficient $w_l(i)$ ($i=0, 1, \ldots, P_{max}$) and sets the determined coefficient $w_l(i)$ ($i=0, 1, \ldots, P_{max}$) as $w_o(i)$ ($i=0, 1, \ldots, P_{max}$).

The coefficient determining part 24 may determine the coefficient $w_l(i)$ ($i=0, 1, \ldots, P_{max}$) when it is determined that the fundamental frequency is low and the pitch gain is small, and set the determined coefficient $w_l(i)$ ($i=0, 1, \ldots, P_{max}$) as $w_o(i)$ ($i=0, 1, \ldots, P_{max}$), and, otherwise, may determine the coefficient $w_h(i)$ ($i=0, 1, \ldots, P_{max}$) and set the determined coefficient $w_h(i)$ ($i=0, 1, \ldots, P_{max}$) as $w_o(i)$ ($i=0, 1, \ldots, P_{max}$). Other processing is the same as described above.

First Modified Example of Second Embodiment

In the first modified example of the second embodiment, instead of the value having positive correlation with the fundamental frequency, the value having negative correlation with the fundamental frequency is compared with a predetermined threshold, the value having positive correlation with the pitch gain is compared with a predetermined threshold, and $w_o(i)$ is determined according to these comparison results. The predetermined threshold to be compared with the value having negative correlation with the fundamental frequency in the first modified example of the second embodiment is different from the predetermined threshold to be compared with the value having positive correlation with the fundamental frequency in the second embodiment.

A functional configuration and a flowchart of the linear predictive analysis apparatus 2 according to the first modified example of the second embodiment is the same as those of the modified example of the first embodiment and illustrated in FIG. 1 and FIG. 2. The linear predictive analysis apparatus 2 according to the first modified example of the second embodiment is the same as the linear predictive analysis apparatus 2 according to the modified example of the first embodiment except for portions of the processing of the coefficient determining part 24 which differ.

Figure 4:
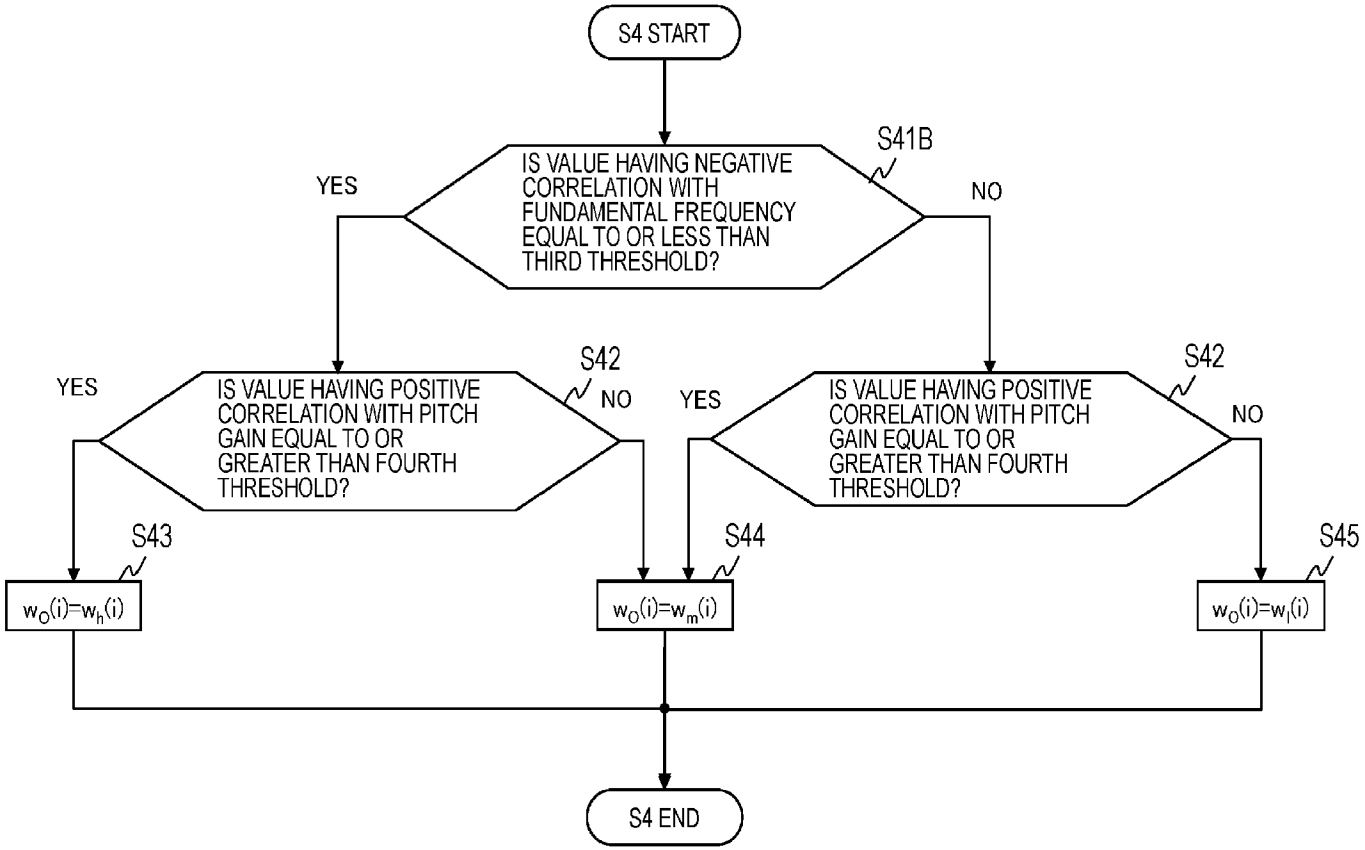
FIG. 4 is a flowchart for explaining an example of a linear predictive analysis method according to a second embodiment.

An example of flow of the processing of the coefficient determining part 24 according to the first modified example of the second embodiment is illustrated in FIG. 4. The coefficient determining part 24 according to the first modified example of the second embodiment performs, for example, processing of each step S41B, step S42, step S43, step S44 and step S45 in FIG. 4.

The coefficient determining part 24 compares the value having negative correlation with the fundamental frequency corresponding to the inputted information regarding the period with a predetermined third threshold (step S41B), and compares the value having positive correlation with the pitch gain corresponding to the inputted information regarding the pitch gain with a predetermined fourth threshold (step S42).

The value having negative correlation with the fundamental frequency corresponding to the inputted information regarding the period is, for example, the period corresponding to the inputted information regarding the period itself. Further, the value having positive correlation with the pitch gain corresponding to the inputted information regarding the pitch gain is, for example, the pitch gain corresponding to the inputted information regarding the pitch gain itself.

The coefficient determining part 24 determines that the period is short when the value having negative correlation with the fundamental frequency is equal to or less than the predetermined third threshold, otherwise, determines that the period is long. Further, the coefficient determining part 24 determines that the pitch gain is large when the pitch gain is equal to or greater than the predetermined fourth threshold, otherwise, determines that the pitch gain is small.

The coefficient determining part 24 determines the coefficient $w_h(i)$ ($i=0, 1, \ldots, P_{max}$) according to a rule defined in advance when it is determined that the period is short and the pitch gain is large, and sets the determined coefficient $w_h(i)$ ($i=0, 1, \ldots, P_{max}$) as $w_o(i)$ ($i=0, 1, \ldots, P_{max}$) (step S43). Further, when it is determined that the period is short and the pitch gain is small or when it is determined that the period is long and the pitch gain is large, the coefficient determining part 24 determines the coefficient $w_m(i)$ ($i=0, 1, \ldots, P_{max}$) according to a rule defined in advance, and sets the determined coefficient $w_m(i)$ ($i=0, 1, \ldots, P_{max}$) as $w_o(i)$ ($i=0, 1, \ldots, P_{max}$) (step S44). Further, when it is determined that the period is long and the pitch gain is small, the coefficient determining part 24 determines the coefficient $w_l(i)$ ($i=0, 1, \ldots, P_{max}$) according to a rule defined in advance and sets the determined coefficient $w_l(i)$ ($i=0, 1, \ldots, P_{max}$) as $w_o(i)$ ($i=0, 1, \ldots, P_{max}$) (step S45).

Here, for at least part of each i, $w_h(i)$, $w_m(i)$ and $w_l(i)$ are determined so as to satisfy relationship of $w_h(i)<w_m(i)<w_l(i)$. Here, at least part of each i is, for example, i other than zero (that is, $1 \le i \le P_{max}$). Alternatively, for at least part of each i, $w_h(i)$, $w_m(i)$ and $w_l(i)$ are determined so as to satisfy relationship of $w_h(i)<w_m(i) \le w_l(i)$, and for at least part of each i among other i, $w_h(i)$, $w_m(i)$ and $w_l(i)$ are determined so as to satisfy relationship of $w_h(i) \le w_m(i)<w_l(i)$, and for the remaining at least part of each i, $w_h(i)$, $w_m(i)$ and $w_l(i)$ are determined so as to satisfy relationship of $w_h(i) \le w_m(i) \le w_l(i)$. Each of $w_h(i)$, $w_m(i)$ and $w_l(i)$ is determined such that each value of $w_h(i)$, $w_m(i)$ and $w_l(i)$ becomes smaller as i becomes greater.

For example, $w_h(i)$, $w_m(i)$ and $w_l(i)$ are obtained according to rules defined in advance such that $w_o(i)$ when $H1'=\zeta \times f_s/T1+\epsilon \times f(G1)$ which is H' when the period is T1 and the pitch gain is G1 is H in equation (1) is obtained as $w_h(i)$, $w_o(i)$ when $H2'=\zeta \times f_s/T2+\epsilon \times f(G2)$ which is H' when the period is T2 (where $T1<T2$) and the pitch gain is G2 (where $G1>G2$) is H in equation (1) is obtained as $w_m(i)$, and $w_o(i)$ when $H3'=\zeta \times f_s/T3+\epsilon \times f(G3)$ which is H' when the period is T3 (where $T2<T3$) and the pitch gain is G3 (where $G2>G3$) is H in equation (1) is obtained as $w_l(i)$.

It should be noted that it is also possible to employ a configuration where $w_h(i)$, $w_m(i)$ and $w_l(i)$ obtained in advance according to any of these rules are stored in a table, and any of $w_h(i)$, $w_m(i)$ and $w_l(i)$ is selected from the table by comparing the value having negative correlation with the fundamental frequency with the predetermined threshold and comparing the value having positive correlation with the pitch gain with the predetermined threshold. It should be noted that it is also possible to determine the coefficient $w_m(i)$ between $w_h(i)$ and $w_l(i)$ using $w_h(i)$ and $w_l(i)$. That is, it is also possible to determine $w_m(i)$ through $w_m(i)=(1-\beta) \times w_h(i)+\beta \times w_l(i)$. Here, $\beta$ is a value of $0 \le \beta \le 1$, which is obtained from the period T and the pitch gain G using a function $\beta=b(T, G)$ in which the value of $\beta$ becomes greater as the period T is longer or the pitch gain G is smaller and the value of $\beta$ becomes smaller as the period T is shorter or the pitch gain G is larger. By obtaining $w_m(i)$ in this manner, by storing only two tables of a table in which $w_h(i)$ $(i=0, 1, \ldots, P_{max})$ is stored and a table in which $w_l(i)$ $(i=0, 1, \ldots, P_{max})$ is stored in the coefficient determining part 24, it is possible to obtain a coefficient close to $w_h(i)$ when the period is short or the pitch gain is large among a case where it is determined that the period is short and the pitch gain is small and a case where it is determined that the period is long and the pitch gain is large, and, inversely, it is possible to obtain a coefficient close to $w_l(i)$ when the period is long or the pitch gain is small among a case where it is determined that the period is short and the pitch gain is small and a case where it is determined that the period is long and the pitch gain is large.

It should be noted that coefficients $w_h(0)$, $w_m(0)$ and $w_l(0)$ when i=0 do not have to satisfy relationship of $w_h(0) \leq w_m(0) \leq w_l(0)$, and may be values which satisfy relationship of $w_h(0) > w_m(0)$ or/and $w_m(0) > w_l(0)$.

Also according to the first modified example of the second embodiment, as with the modified example of the first embodiment, even when the fundamental frequency and the pitch gain of the input signal are high, it is possible to obtain a coefficient which can be converted into a linear predictive coefficient in which occurrence of a peak of a spectrum due to a pitch component is suppressed, and, even when the fundamental frequency and the pitch gain of the input signal are low, it is possible to obtain a coefficient which can be converted into a linear predictive coefficient which can express a spectral envelope, so that it is possible to realize linear prediction with higher analysis precision than that of the conventional one.

It should be noted that, while, in the above description, three types of coefficients $w_h(i)$, $w_m(i)$ and $w_l(i)$ are used, the number of types of coefficients may be two. For example, it is also possible to use only two types of coefficients $w_h(i)$ and $w_l(i)$. In other words, in the above description, $w_m(i)$ may be equal to $w_h(i)$ or $w_l(i)$.

For example, the coefficient determining part 24 determines the coefficient $w_h(i)$ $(i=0, 1, \ldots, P_{max})$ when it is determined that the period is short and the pitch gain is large, and sets the determined coefficient $w_h(i)$ $(i=0, 1, \ldots, P_{max})$ as $w_o(i)$ $(i=0, 1, \ldots, P_{max})$. In other cases, the coefficient determining part 24 determines the coefficient $w_l(i)$ $(i=0, 1, \ldots, P_{max})$ and sets the determined coefficient $w_l(i)$ $(i=0, 1, \ldots, P_{max})$ as $w_o(i)$ $(i=0, 1, \ldots, P_{max})$.

The coefficient determining part 24 may determine the coefficient $w_l(i)$ $(i=0, 1, \ldots, P_{max})$ when it is determined that the period is long and the pitch gain is small, and set the determined coefficient $w_l(i)$ $(i=0, 1, \ldots, P_{max})$ as $w_o(i)$ $(i=0, 1, \ldots, P_{max})$, and, otherwise, may determine the coefficient $w_h(i)$ $(i=0, 1, \ldots, P_{max})$ and set the determined coefficient $w_h(i)$ $(i=0, 1, \ldots, P_{max})$ as $w_o(i)$ $(i=0, 1, \ldots, P_{max})$. The other processing is the same as described above.

Second Modified Example of Second Embodiment

While, in the above-described second embodiment, the coefficient $w_o(i)$ is determined by comparing the value having positive correlation with the fundamental frequency with one threshold and comparing the value having positive correlation with the pitch gain with one threshold, in the second modified example of the second embodiment, the coefficient $w_o(i)$ is determined by comparing these values respectively with two or more thresholds. A method in which the coefficient $w_o(i)$ is determined by comparing the value having positive correlation with the fundamental frequency with two thresholds fth1' and fth2' and comparing the value having positive correlation with the pitch gain with two thresholds gth1 and gth2 will be described below as an example.

It is assumed that the thresholds fth1' and fth2' satisfy relationship of 0<fth1'<fth2', and the thresholds gth1 and gth2 satisfy relationship of 0<gth1<gth2.

The coefficient determining part 24 compares the value having positive correlation with the fundamental frequency corresponding to the inputted information regarding the fundamental frequency with the thresholds fth1' and fth2' and compares the value having positive correlation with the pitch gain corresponding to the inputted information regarding the pitch gain with the thresholds gth1 and gth2.

The value having positive correlation with the fundamental frequency corresponding to the inputted information regarding the fundamental frequency is, for example, the fundamental frequency corresponding to the inputted information regarding the fundamental frequency itself. Further, the value having positive correlation with the pitch gain corresponding to the inputted information regarding the pitch gain is, for example, the pitch gain corresponding to the inputted information regarding the pitch gain itself.

The coefficient determining part 24 determines that the fundamental frequency is high when the value having positive correlation with the fundamental frequency is greater than the threshold fth2', determines that the fundamental frequency is medium when the value having positive correlation with the fundamental frequency is greater than the threshold fth1' and equal to or less than the threshold fth2', and determines that the fundamental frequency is low when the value having positive correlation with the fundamental frequency is equal to or less than the threshold fth1'. Further, the coefficient determining part 24 determines that the pitch gain is large when the value having positive correlation with the pitch gain is greater than the threshold gth2, determines that the pitch gain is medium when the value having positive correlation with the pitch gain is greater than the threshold gth1 and equal to or less than the threshold gth2, and determines that the pitch gain is small when the value having positive correlation with the pitch gain is equal to or less than the threshold gth1.

The coefficient determining part 24 then determines the coefficient $w_l(i)$ $(i=0, 1, \ldots, P_{max})$ according to a rule defined in advance regardless of the magnitude of the pitch gain when the fundamental frequency is low, and sets the determined coefficient $w_l(i)$ $(i=0, 1, \ldots, P_{max})$ as $w_o(i)$ $(i=0, 1, \ldots, P_{max})$. Further, the coefficient determining part 24 determines the coefficient $w_l(i)$ $(i=0, 1, \ldots, P_{max})$ according to a rule defined in advance when the fundamental frequency is medium and the pitch gain is small and sets the determined coefficient $w_l(i)$ $(i=0, 1, \ldots, P_{max})$ as $w_o(i)$ $(i=0, 1, \ldots, P_{max})$. Still further, the coefficient determining part 24 determines the coefficient $w_m(i)$ $(i=0, 1, \ldots, P_{max})$ according to a rule defined in advance when the fundamental frequency is medium and the pitch gain is large or medium and sets the determined coefficient $w_m(i)$ $(i=0, 1, \ldots, P_{max})$ as $w_o(i)$ $(i=0, 1, \ldots, P_{max})$. Further, the coefficient determining part 24 determines the coefficient $w_m(i)$ $(i=0, 1, \ldots, P_{max})$ according to a rule defined in advance when the fundamental frequency is high and the pitch gain is small or medium and sets the determined coefficient $w_m(i)$ $(i=0, 1, \ldots, P_{max})$ as $w_o(i)$ $(i=0, 1, \ldots, P_{max})$. Still further, the coefficient determining part 24 determines the coefficient $w_h(i)$ $(i=0, 1, \ldots, P_{max})$ according to a rule defined in advance when the fundamental frequency is high and the pitch gain is large and sets the determined coefficient $w_h(i)$ ($i=0, 1, \ldots, P_{max}$) as $w_o(i)$ ($i=0, 1, \ldots, P_{max}$).

Here, $w_h(i)$, $w_m(i)$ and $w_l(i)$ are determined so as to satisfy relationship of $w_h(i)<w_m(i)<w_l(i)$ for at least part of each i. Here, at least part of each i is, for example, i other than zero (that is, $1 \le i \le P_{max}$). Alternatively, $w_h(i)$, $w_m(i)$ and $w_l(i)$ are determined so as to satisfy relationship of $w_h(i)<w_m(i) \le w_l(i)$ for at least part of each i, $w_h(i) \le w_m(i)<w_l(i)$ for at least part of each i among other i, and $w_h(i) \le w_m(i) \le w_l(i)$ for the remaining at least part of each i. Each of $w_h(i)$, $w_m(i)$ and $w_l(i)$ is determined such that each value of $w_h(i)$, $w_m(i)$ and $w_l(i)$ becomes smaller as i becomes greater.

It should be noted that the coefficients $w_h(0)$, $w_m(0)$ and $w_l(0)$ when i=0 do not have to necessarily satisfy relationship of $w_h(0) \le w_m(0) \le w_l(0)$, and values which satisfy relationship of $w_h(0)>w_m(0)$ or/and $w_m(0)>w_l(0)$ may be used.

FIG. 5 illustrates summary of the above-described relationship. It should be noted that, in this example, an example is illustrated where, when the fundamental frequency is low, the same coefficient is selected regardless of the magnitude of the pitch gain, the present invention is not limited to this, and, when the fundamental frequency is low, the coefficient may be determined such that the coefficient becomes greater as the pitch gain is smaller. In short, a case where, in at least two ranges among three ranges constituting a possible range of a value of the pitch gain, for at least part of each i, the coefficient determined when the fundamental frequency is low is greater than the coefficient determined when the fundamental frequency is high, and a case where, in at least two ranges among three ranges constituting a possible range of a value of the fundamental frequency, the coefficient determined when the pitch gain is small is greater than the coefficient determined when the pitch gain is large, are comprised.

It should be noted that it is also possible to store $w_h(i)$, $w_m(i)$ and $w_l(i)$ obtained in advance according to any of these rules in a table and select any of $w_h(i)$, $w_m(i)$ and $w_l(i)$ from the table by comparing the value having positive correlation with the fundamental frequency with a predetermined threshold and comparing the value having positive correlation with the pitch gain with a predetermined threshold. It should be noted that the coefficient $w_m(i)$ between $w_h(i)$ and $w_l(i)$ may be determined using $w_h(i)$ and $w_l(i)$. That is, it is also possible to determine $w_m(i)$ through $w_m(i)=\beta' \times w_h(i)+(1-\beta') \times w_l(i)$. Here, $\beta'$ is a value of $0 \le \beta' \le 1$ and obtained from the fundamental frequency P and the pitch gain G using a function $\beta'=c(P, G)$ in which the value of $\beta'$ becomes greater as the value of the fundamental frequency P or the pitch gain G is greater, and the value of $\beta'$ becomes smaller as the value of the fundamental frequency P or the pitch gain G is smaller. By obtaining $w_m(i)$ in this manner, by storing only two tables of a table in which $w_h(i)$ ($i=0, 1, \ldots, P_{max}$) is stored and a table in which $w_l(i)$ ($i=0, 1, \ldots, P_{max}$) is stored in the coefficient determining part 24, it is possible to obtain a coefficient close to $w_h(i)$ when the fundamental frequency P is high and the pitch gain G is large among a case where the fundamental frequency P is medium and the pitch gain G is large or medium, and a case where the fundamental frequency P is high and the pitch gain G is small or medium, and, inversely, it is possible to obtain a coefficient close to $w_l(i)$ when the fundamental frequency P is low and the pitch gain G is small among a case where the fundamental frequency P is medium and the pitch gain G is large or medium and a case where the fundamental frequency P is high and the pitch gain G is small or medium.

Also according to the second modified example of the second embodiment, as with the second embodiment, even when the fundamental frequency and the pitch gain of the input signal are high, it is possible to obtain a coefficient which can be converted into a linear predictive coefficient in which occurrence of a peak of a spectrum due to a pitch component is suppressed, and, even when the fundamental frequency and the pitch gain of the input signal are low, it is possible to obtain a coefficient which can be converted into a linear predictive coefficient which can express a spectral envelope, so that it is possible to realize linear prediction with higher analysis precision than that of the conventional one.

Third Modified Example of Second Embodiment

While, in the above-described first modified example of the second embodiment, the coefficient $w_o(i)$ is determined by comparing the value having negative correlation with the fundamental frequency with one threshold and comparing the value having positive correlation with the pitch gain with one threshold, in the third modified example of the second embodiment, the coefficient $w_o(i)$ is determined using two or more thresholds respectively for these values. A method in which the coefficient is determined using two thresholds fth1 and fth2 and two thresholds gth1 and gth2 respectively for these values will be described below as an example.

A functional configuration and a flowchart of the linear predictive analysis apparatus 2 according to the third modified example of the second embodiment are the same as those of the first modified example of the second embodiment, and illustrated in FIG. 1 and FIG. 2. The linear predictive analysis apparatus 2 according to the third modified example of the second embodiment is the same as the linear predictive analysis apparatus 2 according to the first modified example of the second embodiment except for portions of the processing of the coefficient determining part 24 which differ.

It is assumed that the thresholds fth1 and fth2 satisfy relationship of $0<fth1<fth2$, and the thresholds gth1 and gth2 satisfy relationship of $0<gth1<gth2$.

The coefficient determining part 24 compares the value having negative correlation with the fundamental frequency corresponding to the inputted information regarding the period with the thresholds fth1 and fth2 and compares the value having positive correlation with the pitch gain corresponding to the inputted information regarding the pitch gain with the thresholds gth1 and gth2.

The value having negative correlation with the fundamental frequency corresponding to the inputted information regarding the period is, for example, a period corresponding to the inputted information regarding the period itself. Further, the value having positive correlation with the pitch gain corresponding to the inputted information regarding the pitch gain is, for example, the pitch gain corresponding to the inputted information regarding the pitch gain itself.

The coefficient determining part 24 determines that the period is short when the value having negative correlation with the fundamental frequency is less than the threshold fth1, determines that the length of the period is medium when the value having negative correlation with the fundamental frequency is equal to or greater than the threshold fth1 and less than the threshold fth2, and determines that the period is long when the value having negative correlation with the fundamental frequency is equal to or greater than the threshold fth2. Further, the coefficient determining part 24 determines that the pitch gain is large when the value having positive correlation with the pitch gain is greater than the threshold gth2, determines that the pitch gain is medium when the value having positive correlation with the pitch gain is greater than the threshold gth1 and equal to or less than the threshold gth2, and determines that the pitch gain is small when the value having positive correlation with the pitch gain is equal to or less than the threshold gth1.

The coefficient determining part 24 then determines the coefficient $w_l(i)$ (i=0, 1, . . . , $P_{max}$) according to a rule defined in advance regardless of the magnitude of the pitch gain when the period is long and sets the determined coefficient $w_l(i)$ (i=0, 1, . . . , $P_{max}$) as $w_o(i)$ (i=0, 1, . . . , $P_{max}$). Further, the coefficient determining part 24 determines the coefficient $w_l(i)$ (i=0, 1, . . . , $P_{max}$) according to a rule defined in advance when the length of the period is medium and the pitch gain is small and sets the determined coefficient $w_l(i)$ (i=0, 1, . . . , $P_{max}$) as $w_o(i)$ (i=0, 1, . . . , $P_{max}$). Still further, the coefficient determining part 24 determines the coefficient $w_m(i)$ (i=0, 1, . . . , $P_{max}$) according to a rule defined in advance when the length of the period is medium and the pitch gain is large or medium and sets the determined coefficient $w_m(i)$ (i=0, 1, . . . , $P_{max}$) as $w_o(i)$ (i=0, 1, . . . , $P_{max}$). Further, the coefficient determining part 24 determines the coefficient $w_m(i)$ (i=0, 1, . . . , $P_{max}$) according to a rule defined in advance when the period is short and the pitch gain is small or medium and sets the determined coefficient $w_m(i)$ (i=0, 1, . . . , $P_{max}$) as $w_o(i)$ (i=0, 1, . . . , $P_{max}$). Still further, the coefficient determining part 24 determines the coefficient $w_h(i)$ (i=0, 1, . . . , $P_{max}$) according to a rule defined in advance when the period is short and the pitch gain is large and sets the determined coefficient $w_h(i)$ (i=0, 1, . . . , $P_{max}$) as $w_o(i)$ (i=0, 1, . . . , $P_{max}$).

Here, $w_h(i)$, $w_m(i)$ and $w_l(i)$ are determined so as to satisfy relationship of $w_h(i)<w_m(i)<w_l(i)$ for at least part of each i. Here, at least part of each i is, for example, i other than zero (that is, $1 \le i \le P_{max}$). Alternatively, $w_h(i)$, $w_m(i)$ and $w_l(i)$ are determined so as to satisfy $w_h(i)<w_m(i) \le w_l(i)$ for at least part of each i, $w_h(i) \le w_m(i)<w_l(i)$ for at least part of each i among other i, and $w_h(i) \le w_m(i) \le w_l(i)$ for the remaining at least part of each i. Each of $w_h(i)$, $w_m(i)$ and $w_l(i)$ is determined such that each value of $w_h(i)$, $w_m(i)$ and $w_l(i)$ becomes smaller as i becomes greater.

It should be noted that the coefficients $w_h(0)$, $w_m(0)$ and $w_l(0)$ when i=0 do not have to necessarily satisfy relationship of $w_h(0) \le w_m(0) \le w_l(0)$, and values which satisfy relationship of $w_h(0)>w_m(0)$ or/and $w_m(0)>w_l(0)$ may be used.

It should be noted that it is also possible to store $w_h(i)$, $w_m(i)$ and $w_l(i)$ obtained in advance according to any of these rules in a table and select any of $w_h(i)$, $w_m(i)$ and $w_l(i)$ from the table by comparing the value having negative correlation with the fundamental frequency with a predetermined threshold and comparing the value having positive correlation with the pitch gain with a predetermined threshold. It should be noted that the coefficient $w_m(i)$ between $w_h(i)$ and $w_l(i)$ may be determined using $w_h(i)$ and $w_l(i)$. That is, $w_m(i)$ may be determined through $w_m(i)=(1-\beta)\times w_h(i)+\beta\times w_l(i)$. Here, β is a value of $0 \le \beta \le 1$ which is obtained from the period T and the pitch gain G using a function $\beta=b(T, G)$ in which the value of β becomes greater as the period T is longer or the pitch gain G is smaller, and the value of β becomes smaller as the period T is shorter or the pitch gain G is larger. By obtaining $w_m(i)$ in this manner, by storing only two tables of a table in which $w_h(i)$ (i=0, 1, . . . , $P_{max}$) is stored and a table in which $w_l(i)$ (i=0, 1, . . . , $P_{max}$) is stored in the coefficient determining part 24, it is possible to obtain a coefficient close to $w_h(i)$ when the period T is short and the pitch gain G is large among a case where the period T is medium and the pitch gain G is large or medium and a case where the period T is short and the pitch gain G is small or medium, and, inversely, it is possible to obtain a coefficient close to $w_l(i)$ when the period T is long and the pitch gain G is small among a case where the period T is medium and the pitch gain G is large or medium and a case where the period T is short and the pitch gain G is small or medium.

FIG. 6 illustrates summary of the above-described relationship. It should be noted that, while, in this example, an example is illustrated where, when the period is long, the same coefficient is selected regardless of the magnitude of the pitch gain, the present invention is not limited to this, and when the period is long, the coefficient may be determined such that the coefficient becomes greater as the pitch gain becomes smaller. In short, a case where, in at least two ranges among three ranges constituting a possible range of the value of the pitch gain, for at least part of each i, the coefficient determined when the period is long is greater than the coefficient determined when the period is short, and in at least two ranges among the period of three ranges constituting a possible range of the value of the period, the coefficient determined when the pitch gain is small is greater than the coefficient determined when the pitch gain is large, are comprised.

Also according to the third modified example of the second embodiment, as with the first modified example of the second embodiment, even when the fundamental frequency and the pitch gain of the input signal are high, it is possible to obtain a coefficient which can be converted into a linear predictive coefficient in which occurrence of a peak of a spectrum due to a pitch component is suppressed, and, even when the fundamental frequency and the pitch gain of the input signal are low, it is possible to obtain a coefficient which can be converted into a linear predictive coefficient which can express a spectral envelope, so that it is possible to realize linear prediction with higher analysis precision than that of the conventional one.

Third Embodiment

In the third embodiment, the coefficient $w_o(i)$ is determined using a plurality of coefficient tables. The third embodiment is different from the first embodiment only in a method for determining the coefficient $w_o(i)$ at the coefficient determining part 24, and is the same as the first embodiment in other points. A portion different from the first embodiment will be mainly described below, and overlapped explanation of a portion which is the same as the first embodiment will be omitted.

Figure 7:
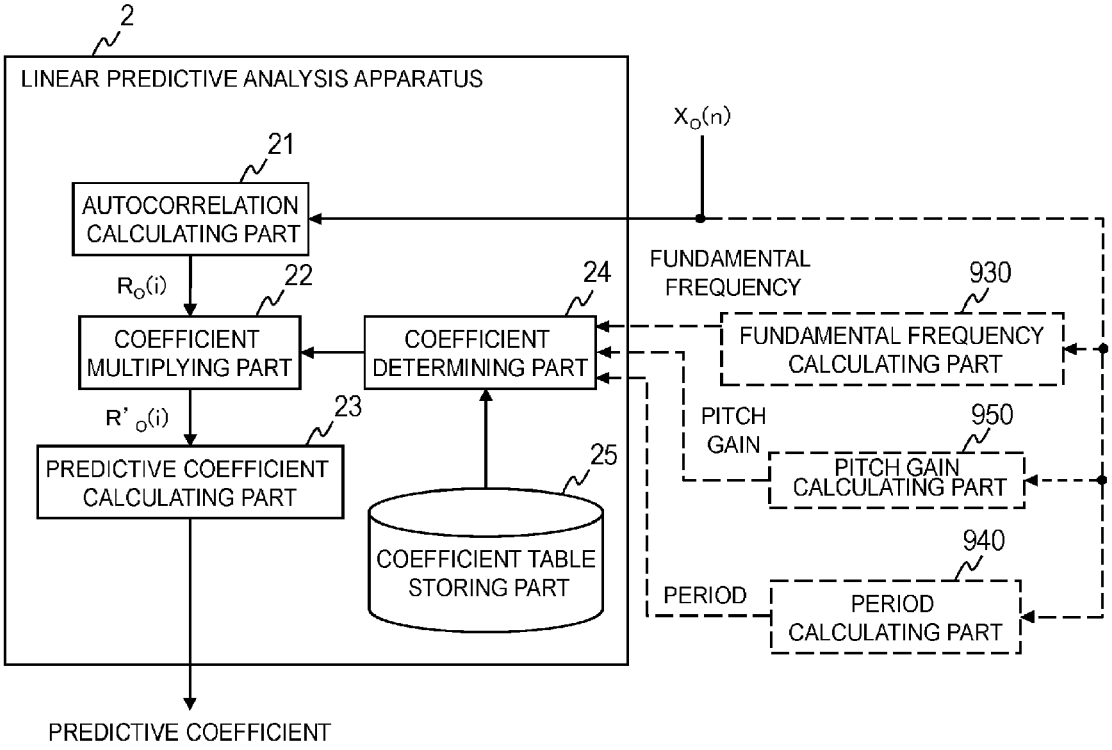
FIG. 7 is a block diagram for explaining an example of a linear predictive apparatus according to a third embodiment.

The linear predictive analysis apparatus 2 of the third embodiment is the same as the linear predictive analysis apparatus 2 of the first embodiment except processing of the coefficient determining part 24 and except that, as illustrated in FIG. 7, a coefficient table storing part 25 is further provided. In the coefficient table storing part 25, two or more coefficient tables are stored. An example where three or more coefficient tables are stored in the coefficient table storing part 25 will be first described below.

Figure 8:
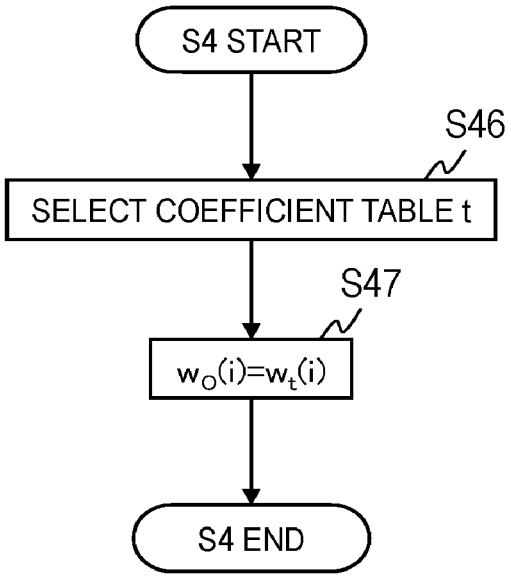
FIG. 8 is a flowchart for explaining an example of a linear predictive analysis method according to the third embodiment.

An example of flow of processing of the coefficient determining part 24 of the third embodiment is illustrated in FIG. 8. The coefficient determining part 24 of the third embodiment performs, for example, processing of step S46 and step S47 in FIG. 8.

First, the coefficient determining part 24 selects one coefficient table t according to the value having positive correlation with the fundamental frequency and the value having positive correlation with the pitch gain from three or more coefficient tables stored in the coefficient table storing part 25 using the value having positive correlation with the fundamental frequency corresponding to the inputted information regarding the fundamental frequency and the value having positive correlation with the pitch gain corresponding to the inputted information regarding the pitch gain (step S46). For example, the value having positive correlation with the fundamental frequency corresponding to the information regarding the fundamental frequency is the fundamental frequency corresponding to the information regarding the fundamental frequency, and the value having positive correlation with the pitch gain corresponding to the information regarding the pitch gain is the pitch gain corresponding to the information regarding the pitch gain.

It is, for example, assumed that three different coefficient tables t0, t1 and t2 are stored in the coefficient table storing part 25, a coefficient $w_{t0}(i)$ (i=0, 1, . . . , $P_{max}$) is stored in the coefficient table t0, a coefficient $w_{t1}(i)$ (i=0, 1, . . . , $P_{max}$) is stored in the coefficient table t1, and a coefficient $w_o(i)$ (i=0, 1, . . . , $P_{max}$) is stored in the coefficient table t2. It is assumed that the coefficient $w_{t0}(i)$ (i=0, 1, . . . , $P_{max}$), the coefficient $w_{t1}(i)$ (i=0, 1, . . . , $P_{max}$) and the coefficient $w_{t2}(i)$ (i=0, 1, . . . , $P_{max}$) which are determined such that $w_{t0}(i) < w_{t1}(i) \leq w_{t2}(i)$ for at least part of each i, $w_{t0}(i) \leq w_{t1}(i) < w_{t2}(i)$ for at least part of each i among other i, and $w_{t0}(i) \leq w_{t1}(i) \leq w_{t2}(i)$ for the remaining each i are stored in each of the three coefficient tables t0, t1 and t2.

At this time, the coefficient determining part 24 selects the coefficient table t0 as the coefficient table t when the value having positive correlation with the fundamental frequency is equal to or greater than a predetermined first threshold and the value having positive correlation with the pitch gain is equal to or greater than a predetermined second threshold, selects the coefficient table t1 as the coefficient table t when the value having positive correlation with the fundamental frequency is less than the predetermined first threshold and the value having positive correlation with the pitch gain is equal to or greater than the predetermined second threshold or when the value having positive correlation with the fundamental frequency is equal to or greater than the predetermined first threshold and the value having positive correlation with the pitch gain is less than the predetermined second threshold, and selects the coefficient table t2 as the coefficient table t when the value having positive correlation with the fundamental frequency is less than the predetermined first threshold and the value having positive correlation with the pitch gain is less than the predetermined second threshold.

That is, when the value having positive correlation with the fundamental frequency is equal to or greater than the predetermined first threshold and the value having positive correlation with the pitch gain is equal to or greater than the predetermined second threshold, that is, when it is determined that the fundamental frequency is high and the pitch gain is large, the coefficient table t0 in which a coefficient for each i is the smallest is selected as the coefficient table t, and, when the value having positive correlation with the fundamental frequency is less than the predetermined first threshold and the value having positive correlation with the pitch gain is less than the predetermined second threshold, that is, when it is determined that the fundamental frequency is low and the pitch gain is small, the coefficient table t2 in which a coefficient for each i is the greatest is selected as the coefficient table t.

In other words, assuming that, among the three coefficient tables stored in the coefficient table storing part 25, the coefficient table t0 selected by the coefficient determining part 24 when the value having positive correlation with the fundamental frequency is a first value and the value having positive correlation with the pitch gain is a third value is a first coefficient table t0, and the coefficient table t2 selected by the coefficient determining part 24 when the value having positive correlation with the fundamental frequency is a second value which is smaller than the first value and the value having positive correlation with the pitch gain is a fourth value which is smaller than the third value is a second coefficient table t2, for at least part of each order i, the magnitude of the coefficient corresponding to each order i in the second coefficient table t2 is greater than the magnitude of the coefficient corresponding to each order i in the first coefficient table t0. Here, it is assumed that the second value<the predetermined first threshold≤the first value, and the fourth value<the predetermined second threshold≤the third value.

Further, assuming that the coefficient table t1 which is a coefficient table selected when the first coefficient table t0 and the second coefficient table t2 are not selected is a third coefficient table t1, for at least part of each order i, the coefficient corresponding to each order i in the third coefficient table t1 is greater than the coefficient corresponding to each order i in the first coefficient table t0 and is less than the coefficient corresponding to each order i in the second coefficient table t2.

The coefficient determining part 24 then sets the coefficient $w_t(i)$ of each order i stored in the selected coefficient table t as the coefficient $w_o(i)$ (step S47). That is, $w_o(i)=w_t(i)$. In other words, the coefficient determining part 24 acquires the magnitude of the coefficient $w_t(i)$ corresponding to each order i from the selected coefficient table t and sets the coefficient $w_t(i)$ having the acquired magnitude corresponding to each order i as $w_o(i)$.

In the third embodiment, unlike with the first embodiment and the second embodiment, because it is not necessary to calculate the coefficient $w_o(i)$ based on the equation having positive correlation with the fundamental frequency and the pitch gain, it is possible to perform operation with a less operation processing amount.

It should be noted that the number of coefficient tables stored in the coefficient table storing part 25 may be two.

For example, it is assumed that two coefficient tables t0 and t2 are stored in the coefficient table storing part 25. In this case, the coefficient determining part 24 determines the coefficient $w_o(i)$ based on these two coefficient tables t0 and t2 as follows.

For example, the coefficient determining part 24 selects the coefficient table t0 as the coefficient table t when the value having positive correlation with the fundamental frequency is equal to or greater than the predetermined first threshold and the value having positive correlation with the pitch gain is equal to or greater than the predetermined second threshold, that is, when it is determined that the fundamental frequency is high and the pitch gain is large. In other cases, the coefficient determining part 24 selects the coefficient table t2 as the coefficient table t.

The coefficient determining part 24 may select the coefficient table t2 as the coefficient table t when the value having positive correlation with the fundamental frequency is less than the predetermined first threshold and the value having positive correlation with the pitch gain is less than the predetermined second threshold, that is, when it is determined that the fundamental frequency is low and the pitch gain is small, otherwise, may select the coefficient table t0 as the coefficient table t.

Also in the case where two coefficient tables t0 and t2 are stored in the coefficient table storing part 25, it can be said that the magnitude of the coefficient corresponding to each order i in the second coefficient table t2 which is the coefficient table t2 selected by the coefficient determining part 24 when the value having positive correlation with the fundamental frequency is a second value which is smaller than a first value and the value having positive correlation with the pitch gain is a fourth value which is smaller than a third value is greater than the magnitude of the coefficient corresponding to each order i in the first coefficient table t0 which is the coefficient table t0 selected by the coefficient determining part 24 when the value having positive correlation with the fundamental frequency is the first value and the value having positive correlation with the pitch gain is the third value. Here, it is assumed that the second value<the predetermined first threshold≤the first value, and the fourth value<the predetermined second threshold≤the third value.

First Modified Example of Third Embodiment

In the first modified example of the third embodiment, the coefficient determining part 24 selects one coefficient table t according to the inputted value having negative correlation with the fundamental frequency and value having positive correlation with the pitch gain from two or more coefficient tables stored in the coefficient table storing part 25 using the inputted value having negative correlation with the fundamental frequency and value having positive correlation with the pitch gain.

A functional configuration and a flowchart of the linear predictive analysis apparatus 2 according to the first modified example of the third embodiment are the same as those in the third embodiment and illustrated in FIG. 7 and FIG. 8. The linear predictive analysis apparatus 2 according to the first modified example of the third embodiment is the same as the linear predictive analysis apparatus 2 of the third embodiment except for portions of the processing of the coefficient determining part 24 which differ.

An example where one coefficient table t is selected from three coefficient tables t0, t1 and t2 stored in the coefficient table storing part 25 will be first described below.

First, the coefficient determining part 24 selects one coefficient table t according to the value having negative correlation with the fundamental frequency and the value having positive correlation with the pitch gain from three coefficient tables stored in the coefficient table storing part 25 using the value having negative correlation with the fundamental frequency corresponding to the inputted information regarding the period and the value having positive correlation with the pitch gain corresponding to the inputted information regarding the pitch gain (step S46). In this case, the coefficient determining part 24 selects the coefficient table t2 as the coefficient table t when the value having negative correlation with the fundamental frequency is equal to or greater than a predetermined third threshold and the value having positive correlation with the pitch gain is less than a predetermined fourth threshold, selects the coefficient table t1 as the coefficient table t when the value having negative correlation with the fundamental frequency is less than the predetermined third threshold and the value having positive correlation with the pitch gain is less than the predetermined fourth threshold or the value having negative correlation with the fundamental frequency is equal to or greater than the predetermined third threshold and the value having positive correlation with the pitch gain is equal to or greater than the predetermined fourth threshold, and selects the coefficient table t0 as the coefficient table t when the value having negative correlation with the fundamental frequency is less than the predetermined third threshold and the value having positive correlation with the pitch gain is equal to or greater than the fourth threshold.

That is, when the value having negative correlation with the fundamental frequency is less than the predetermined third threshold and the value having positive correlation with the pitch gain is equal to or greater than the predetermined fourth threshold, that is, when it is determined that the period is short and the pitch gain is large, the coefficient table t0 in which the coefficient for each i is the smallest is selected as the coefficient table t, and, when the value having negative correlation with the fundamental frequency is equal to or greater than the predetermined third threshold and the value having positive correlation with the pitch gain is less than the predetermined fourth threshold, that is, when it is determined that the period is long and the pitch gain is small, the coefficient table t2 in which the coefficient for each i is the greatest is selected as the coefficient table t.

In other words, assuming that, among three coefficient tables stored in the coefficient table storing part 25, the coefficient table t0 selected by the coefficient determining part 24 when the value having negative correlation with the fundamental frequency is a first value and the value having positive correlation with the pitch gain is a third value is a first coefficient table t0, among three coefficient tables stored in the coefficient table storing part 25, and the coefficient table t2 selected by the coefficient determining part 24 when the value having negative correlation with the fundamental frequency is a second value which is greater than the first value and the value having positive correlation with the pitch gain is a fourth value which is smaller than the third value is a second coefficient table t2, for at least part of each order i, the magnitude of the coefficient corresponding to each order i in the second coefficient table t2 is greater than the magnitude of the coefficient corresponding to each order i in the first coefficient table t0. Here, it is assumed that the first value<the predetermined third threshold≤the second value, and the fourth value<the predetermined fourth threshold≤the third value.

Further, assuming that the coefficient table t1 which is the coefficient table selected when the first coefficient table t0 and the second coefficient table t2 are not selected is a third coefficient table, for at least part of each order i, the coefficient corresponding to each order i in the third coefficient table t1 is greater than the coefficient corresponding to each order i in the first coefficient tablet t0 and less than the coefficient corresponding to each order i in the second coefficient table t2.

In the first modified example of the third embodiment, unlike with the modified example of the first embodiment and the first modified example of the second embodiment, because it is not necessary to calculate the coefficient $w_o(i)$ based on the equation having negative correlation with the fundamental frequency and having positive correlation with the pitch gain, it is possible to perform operation with a less operation processing amount.

Also in the first modified example of the third embodiment, the number of coefficient tables stored in the coefficient table storing part 25 may be two.

For example, it is assumed that two coefficient tables t0 and t2 are stored in the coefficient table storing part 25. In this case, the coefficient determining part 24 determines the coefficient $w_o(i)$ based on these two coefficient tables t0 and t2 as follows.

For example, the coefficient determining part 24 selects the coefficient table t0 as the coefficient table t when the value having negative correlation with the fundamental frequency is less than the predetermined third threshold and the value having positive correlation with the pitch gain is equal to or greater than the predetermined fourth threshold, that is, when it is determined that the period is short and the pitch gain is large. In other cases, the coefficient determining part 24 selects the coefficient table t2 as the coefficient table t.

The coefficient determining part 24 may select the coefficient table t2 as the coefficient table t when the value having negative correlation with the fundamental frequency is equal to or greater than the predetermined third threshold and the value having positive correlation with the pitch gain is less than the predetermined fourth threshold, that is, when it is determined that the period is long and the pitch gain is small, and, otherwise, may select the coefficient table t0 as the coefficient table t.

Also in the case where two coefficient tables t0 and t2 are stored in this coefficient table storing part 25, it can be said that the magnitude of the coefficient corresponding to each order i in the first coefficient table t0 which is the coefficient table t0 selected by the coefficient determining part 24 when the value having negative correlation with the fundamental frequency is a first value and the value having positive correlation with the pitch gain is a third value is greater than the magnitude of the coefficient corresponding to each order i in the second coefficient table t2 which is the coefficient table t2 selected by the coefficient determining part 24 when the value having negative correlation with the fundamental frequency is a second value which is greater than the first value and the value having positive correlation with the pitch gain is a fourth value which is smaller than the third value. Here, it is assumed that the first value<the predetermined third threshold≤the second value, and the fourth value<the predetermined fourth threshold≤the third value.

Second Modified Example of Third Embodiment

While, in the third embodiment, the coefficient table is determined by comparing the value having positive correlation with the fundamental frequency with one threshold and comparing the value having positive correlation with the pitch gain with one threshold, in the second modified example of the third embodiment, each of these values is compared with two or more thresholds, and the coefficient $w_o(i)$ is determined according to these comparison results.

A functional configuration and a flowchart of the linear predictive analysis apparatus 2 according to the second modified example of the third embodiment are the same as those of the third embodiment and illustrated in FIG. 7 and FIG. 8. The linear predictive analysis apparatus 2 according to the second modified example of the third embodiment is the same as the linear predictive analysis apparatus 2 according to the third embodiment except for portions of the processing of the coefficient determining part 24 which differ.

The coefficient tables t0, t1 and t2 are stored in the coefficient table storing part 25. In the three coefficient tables t0, t1 and t2, the coefficient $w_{t0}(i)$ (i=0, 1, . . . , $P_{max}$), the coefficient $w_{t1}(i)$ (i=0, 1, . . . , $P_{max}$) and the coefficient $w_{t2}(i)$ (i=0, 1, . . . , $P_{max}$) which are determined such that $w_{t0}(i)<w_{t1}(i)\leq w_{t2}(i)$ for at least part of i, $wt_0(i)\leq w_{t1}(i)<w_{t2}(i)$ for at least part of each i among other i, and $w_{t0}(i)\leq w_{t1}(i)\leq w_{t2}(i)$ for the remaining each i are respectively stored. However, $w_{t0}(0)$, $w_{t1}(0)$ and $w_{t2}(0)$ when i=0 do not have to necessarily satisfy relationship of $w_{t0}(0)\leq w_{t1}(0)\leq w_{t2}(0)$, and may be values having relationship of $w_{t0}(0)>w_{t1}(0)$ or/and $w_{t1}(0)>w_{t2}(0)$.

Here, it is assumed that thresholds fth1' and fth2' which satisfy relationship of 0<fth1'<fth2' and thresholds gth1 and gth2 which satisfy relationship of 0<gth1<gth2 are defined.

The coefficient determining part 24 selects the coefficient table stored in the coefficient table storing part 25 so as to comprise a case where, in at least two ranges among three ranges constituting a possible range of the value having positive correlation with the fundamental frequency, the coefficient determined when the value having positive correlation with the pitch gain is greater than the coefficient determined when the value having positive correlation with the pitch gain is great, and a case where, in at least two ranges among three ranges constituting a possible range of the value having positive correlation with the pitch gain, the coefficient determined when the value having positive correlation with the fundamental frequency is small is greater than the coefficient determined when the value having positive correlation with the fundamental frequency is great, and obtains a coefficient stored in the selected coefficient table as the coefficient $w_o(i)$.

Three ranges constituting a possible range of the value having positive correlation with the fundamental frequency are, for example, three ranges of a range of the value having positive correlation with the fundamental frequency>fth2' (that is, a range where the value having positive correlation with the fundamental frequency is great), a range of fth1'<the value having positive correlation with the fundamental frequency≤fth2' (that is, a range where the value having positive correlation with the fundamental frequency is medium) and a range of fth1'≥the value having positive correlation with the fundamental frequency (that is, a range where the value having positive correlation with the fundamental frequency is small).

Further, three ranges constituting a possible range of the value having positive correlation with the pitch gain are, for example, three ranges of a range of the value having positive correlation with the pitch gain≤gth1 (that is, a range where the value having positive correlation with the pitch gain is small), a range of gth1<the value having positive correlation with the pitch gain≤gth2 (that is, a range where the value having positive correlation with the pitch gain is medium), and a range of gth2<the value having positive correlation with the pitch gain (that is, a range where the value having positive correlation with the pitch gain is great).

The coefficient determining part 24, for example, selects the coefficient $w_o(i)$ from the coefficient tables stored in the coefficient table storing part 25 so that (1) when the value having positive correlation with the fundamental frequency is greater than the threshold fth2' and the value having positive correlation with the pitch gain is greater than the threshold gth2, that is, when it is determined that the fundamental frequency is high and the pitch gain is large, each coefficient $w_{t0}(i)$ in the coefficient table t0 is selected as the coefficient $w_o(i)$, (2) when the value having positive correlation with the fundamental frequency is greater than the threshold fth2' and the value having positive correlation with the pitch gain is greater than the threshold gth1 and equal to or less than the threshold gth2, that is, when it is determined that the fundamental frequency is high and the pitch gain is medium, each coefficient in any of the coefficient tables t0, t1 and t2 is selected as the coefficient $w_o(i)$, (3) when the value having positive correlation with the fundamental frequency is greater than the threshold fth2' and the value having positive correlation with the pitch gain is equal to or less than the threshold gth1, that is, when it is determined that the fundamental frequency is high and the pitch gain is small, each coefficient in any of the coefficient tables t0, t1 and t2 is selected as the coefficient $w_o(i)$, (4) when the value having positive correlation with the fundamental frequency is greater than the threshold fth1' and equal to or less than the threshold fth2' and the value having positive correlation with the pitch gain is greater than the threshold gth2, that is, when it is determined that the fundamental frequency is medium and the pitch gain is large, each coefficient in any of the coefficient tables t0, t1 and t2 is selected as the coefficient $w_o(i)$, (5) when the value having positive correlation with the fundamental frequency is greater than the threshold fth1' and equal to or less than the threshold fth2' and the value having positive correlation with the pitch gain is greater than the threshold gth1 and equal to or less than the threshold gth2, that is, when it is determined that the fundamental frequency is medium and the pitch gain is medium, each coefficient in any of the coefficient tables t0, t1 and t2 is selected as the coefficient $w_o(i)$, (6) when the value having positive correlation with the fundamental frequency is greater than the threshold fth1' and equal to or less than the threshold fth2' and the value having positive correlation with the pitch gain is equal to or less than the threshold gth1, that is, when it is determined that the fundamental frequency is medium and the pitch gain is small, each coefficient in any of the coefficient tables t0, t1 and t2 is selected as the coefficient $w_o(i)$, (7) when the value having positive correlation with the fundamental frequency is equal to or less than the threshold fth1' and the value having positive correlation with the pitch gain is greater than the threshold gth2, that is, when it is determined that the fundamental frequency is low and the pitch gain is large, each coefficient in any of the coefficient tables t0, t1 and t2 is selected as the coefficient $w_o(i)$, (8) when the value having positive correlation with the fundamental frequency is equal to or less than the threshold fth1' and the value having positive correlation with the pitch gain is greater than the threshold gth1 and equal to or less than the threshold gth2, that is, when it is determined that the fundamental frequency is low and the pitch gain is medium, each coefficient in any of the coefficient tables t0, t1 and t2 is selected as the coefficient $w_o(i)$, and (9) when the value having positive correlation with the fundamental frequency is equal to or less than the threshold fth1' and the value having positive correlation with the pitch gain is equal to or less than the threshold gth1, that is, when it is determined that the fundamental frequency is low and the pitch gain is small, each coefficient $w_{t2}(i)$ in the coefficient table t2 is selected as the coefficient $w_o(i)$.

In other words, in the case of (1), a coefficient is acquired from the coefficient table t0 by the coefficient determining part 24, in the case of (9), a coefficient is acquired from the coefficient table t2 by the coefficient determining part 24, and in the case of (2), (3), (4), (5), (6), (7) and (8), a coefficient is acquired from any of the coefficient tables t0, t1 and t2 by the coefficient determining part 24.

Further, in the case of at least one of (2), (3), (4), (5), (6), (7) and (8), a coefficient is acquired from the coefficient table t1 by the coefficient determining part 24.

Further, assuming that an identification number of a coefficient table $tj_k$ from which a coefficient is acquired in the coefficient determining step in the case of (k) where k=1, 2, . . . , 9 is $j_k$, $j_1 \le j_2 \le j_3$, $j_4 \le j_5 \le j_6$, $j_7 \le j_8 \le j_9$, and $j_1 \le j_4 \le j_7$, $j_2 \le j_5 \le j_8$ and $j_3 \le j_6 \le j_9$.

Specific Example of Second Modified Example of Third Embodiment

A specific example of the second modified example of the third embodiment will be described below.

To the linear predictive analysis apparatus 2, an input signal $X_o(n)$ (n=0, 1, . . . , N−1) which is a digital acoustic signal of N samples per one frame which passes through a high-pass filter, subjected to sampling conversion to 12.8 kHz and subjected to pre-emphasis processing, a fundamental frequency P obtained at the fundamental frequency calculating part 930 for an input signal $X_o(n)$ (n=0, 1, . . . , Nn) (where Nn is a predetermined positive integer which satisfies relationship of Nn<N) of part of a current frame as the information regarding the fundamental frequency, and a pitch gain G obtained at the pitch gain calculating part 950 for the input signal $X_o(n)$ (n=0, 1, . . . , Nn) of part of the current frame as the information regarding the pitch gain are inputted.

The autocorrelation calculating part 21 obtains autocorrelation $R_o(i)$ (i=0, 1, . . . , $P_{max}$) from the input signal $X_o(n)$ using the following equation (8).

[Formula 12]

$$R_o(i) = \sum_{n=i}^{N-1} X_o(n) \times X_o(n-i) \tag{8}$$

It is assumed that the coefficient table t0, the coefficient table t1 and the coefficient table t2 are stored in the coefficient table storing part 25.

The coefficient table t0 is a coefficient table which is the same as $f_0$=60 Hz in a conventional method of equation (13), and the coefficient $w_{t0}(i)$ of each order is defined as follows.

$w_{t0}(i)$=[1.0001, 0.999566371, 0.998266613, 0.996104103, 0.993084457, 0.989215493, 0.984507263, 0.978971839, 0.972623467, 0.96547842, 0.957554817, 0.948872864, 0.939454317, 0.929322779, 0.918503404, 0.907022834, 0.894909143]

The coefficient table t1 is a table of $f_0$=40 Hz in a conventional method of equation (13), and the coefficient $w_{t1}(i)$ of each order is defined as follows.

$w_{t1}(i)$ [1.0001, 0.999807253, 0.99922923, 0.99826661, 0.99692050, 0.99519245, 0.99308446, 0.99059895, 0.98773878, 0.98450724, 0.98090803, 0.97694527, 0.97262346, 0.96794752, 0.96292276, 0.95755484, 0.95184981]

The coefficient table t2 is a table of $f_0$=20 Hz in a conventional method of equation (13), and the coefficient $w_{t2}(i)$ of each order is defined as follows.

$w_{t2}(i)$=[1.0001, 0.99995181, 0.99980725, 0.99956637, 0.99922923, 0.99879594, 0.99826661, 0.99764141, 0.99692050, 0.99610410, 0.99519245, 0.99418581, 0.99308446, 0.99188872, 0.99059895, 0.98921550, 0.98773878]

Here, in the above-described lists of $w_{t0}(i)$, $w_{t1}(i)$ and $w_{t2}(i)$, magnitudes of the coefficient corresponding to i are arranged from the left in order of i=0, 1, 2, . . . , 16 assuming that $P_{max}$=16. That is, in the above-described example, for example, $w_{t0}(0)$=1.001, and $w_{t0}(3)$=0.996104103.

Figure 9:
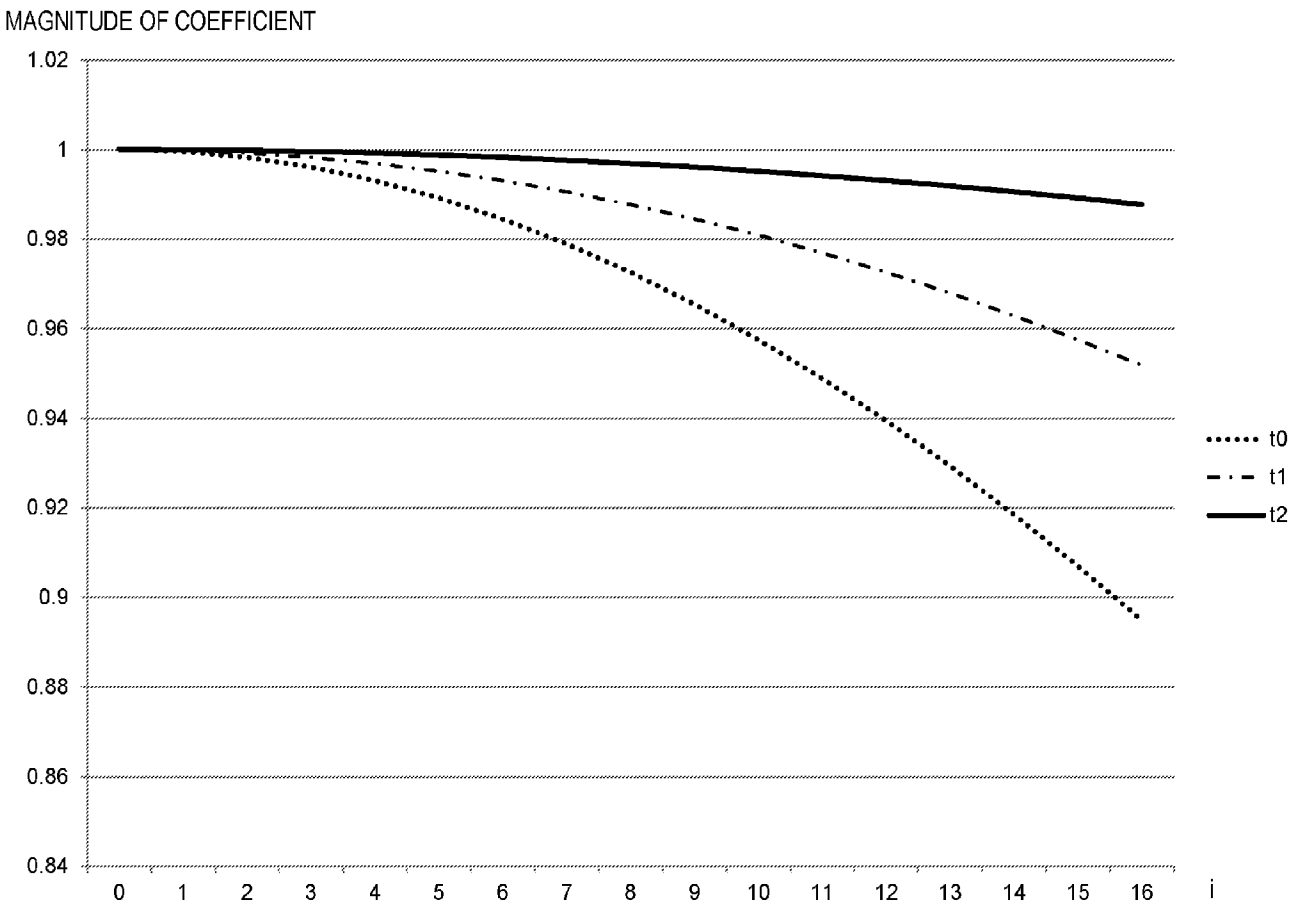
FIG. 9 is a diagram for explaining a specific example of the third embodiment.

FIG. 9 is a graph illustrating magnitudes of coefficients $w_{t0}(i)$, $w_{t1}(i)$ and $w_{t2}(i)$ of the coefficient tables t0, t1 and t2. A dotted line in the graph of FIG. 9 indicates the magnitude of the coefficient $w_{t0}(i)$ of the coefficient table t0, a dashed-dotted line in the graph of FIG. 9 indicates the magnitude of the coefficient $w_{t1}(i)$ of the coefficient table t1, and a solid line in the graph of FIG. 9 indicates the magnitude of the coefficient $w_{t2}(i)$ of the coefficient table t2. FIG. 9 illustrates an order i on the horizontal axis and illustrates the magnitudes of the coefficients on the vertical axis. As can be seen from this graph, in each coefficient table, the magnitudes of the coefficients monotonically decrease as the value of i increases. Further, when the magnitudes of the coefficients are compared in different coefficient tables corresponding to the same value of i, for $i \geq 1$, relationship of $w_{t0}(i)<w_{t1}(i)<w_{t2}(i)$ is satisfied. The plurality of coefficient tables stored in the coefficient table storing part 25 are not limited to the above-described examples if a table has such relationship.

Further, as disclosed in Non-patent literature 1 and Non-patent literature 2, it is also possible to make an exception for only a coefficient when i=0 and use an experimental value such as $w_{t0}(0)=w_{t1}(0)=w_{t2}(0)=1.0001$ or $w_{t0}(0)=w_{t1}(0)=w_{t2}(0)=1.003$. It should be noted that i=0 does not have to satisfy relationship of $w_{t0}(i)<w_{t1}(i)<w_{t2}(i)$, and $w_{t0}(0)$, $w_{t1}(0)$ and $w_{t2}(0)$ do not necessarily have to be the same value. For example, magnitude relationship of two or more values among $w_{t0}(0)$, $w_{t1}(0)$ and $w_{t2}(0)$ does not have to satisfy relationship of $w_{t0}(i)<w_{t1}(i)<w_{t2}(i)$ only concerning i=0.

In the present specific example, the threshold fth1' is 80, the threshold fth2' is 160, the threshold gth1 is 0.3 and the threshold gth2 is 0.6.

To the coefficient determining part 24, the fundamental frequency P and the pitch gain G are inputted.

The coefficient determining part 24 selects the coefficient table t2 as the coefficient table t when the fundamental frequency is equal to or less than the threshold fth1'=80 Hz, that is, when the fundamental frequency is low.

Further, the coefficient determining part 24 selects the coefficient table t2 as the coefficient table t when the fundamental frequency is greater than the threshold fth1'=80 Hz and is equal to or less than fth2'=160 Hz and the pitch gain is equal to or less than the threshold gth1=0.3, that is, when the fundamental frequency is medium and the pitch gain is small.

Further, the coefficient determining part 24 selects the coefficient table t1 as the coefficient table t when the fundamental frequency is greater than the threshold fth1'=80 Hz and is equal to or less than fth2'=160 Hz and the pitch gain is greater than the threshold gth1=0.3, that is, the fundamental frequency is medium and the pitch gain is large or medium.

Further, the coefficient determining part 24 selects the coefficient table t1 as the coefficient table t when the fundamental frequency is greater than the threshold fth2'=160 Hz and the pitch gain is equal to or less than gth2=0.6, that is, when the fundamental frequency is high and the pitch gain is medium or small.

Still further, the coefficient determining part 24 selects the coefficient table t0 as the coefficient table t when the fundamental frequency is greater than the threshold fth2'=160 Hz and the pitch gain is greater than the threshold gth1=0.6, that is, when the fundamental frequency is high and the pitch gain is large.

Relationship between the fundamental frequency and the pitch gain, and the selected table is illustrated in FIG. 10.

The coefficient determining part 24 sets each coefficient $w_t(i)$ in the selected coefficient table t as the coefficient $w_o(i)$. That is, $w_o(i)=w_t(i)$. In other words, the coefficient determining part 24 acquires the magnitude of the coefficient $w_t(i)$ corresponding to each order i from the selected coefficient table t and sets the acquired coefficient $w_t(i)$ corresponding to each order i as $w_o(i)$.

The coefficient determining part 24 then obtains modified autocorrelation $R'_o(i)$ by multiplying the autocorrelation $R_o(i)$ by the coefficient $w_o(i)$ in a similar manner to the first embodiment.

Third Modified Example of Third Embodiment

While, in the first modified example of the third embodiment, the coefficient table is determined by comparing the value having negative correlation with the fundamental frequency with one threshold and comparing the value having positive correlation with the pitch gain with one threshold, in the third modified example of the third embodiment, each of these values is compared with two or more thresholds, and the coefficient $w_o(i)$ is determined according to these comparison results.

A functional configuration and a flowchart of the linear predictive analysis apparatus 2 according to the third modified example of the third embodiment are the same as those of the third embodiment and illustrated in FIG. 7 and FIG. 8. The linear predictive analysis apparatus 2 according to the third modified example of the third embodiment is the same as the linear predictive analysis apparatus 2 according to the third embodiment except for portions of the processing of the coefficient determining part 24 which differ.

In the coefficient table storing part 25, the coefficient tables t0, t1 and t2 are stored. In the three coefficient tables t0, t1 and t2, a coefficient $w_{t0}(i)$ ($i=0, 1, \ldots, P_{max}$), a coefficient $w_{t1}(i)$ ($i=0, 1, \ldots, P_{max}$) and a coefficient $w_{t2}(i)$ ($i=0, 1, \ldots, P_{max}$) which are determined such that $w_{t0}(i)<w_{t1}(i)\leq w_{t2}(i)$ for at least part of i, $w_{t0}(i)\leq w_{t1}(i)<w_{t2}(i)$ for at least part of each i among other i, and $w_{t0}(i)\leq w_{t1}(i)\leq w_{t2}(i)$ for the remaining each i, are respectively stored. However, $w_{t0}(0)$, $w_{t1}(0)$ and $w_{t2}(0)$ when i=0 do not have to necessarily satisfy relationship of $w_{t0}(0)\leq w_{t1}(0)\leq w_{t2}(0)$, and may be values having relationship of $w_{t0}(0)>w_{t1}(0)$ or/and $w_{t1}(0)>w_{t2}(0)$.

Here, it is assumed that the thresholds fth1 and fth2 which satisfy relationship of 0<fth1<fth2 and the thresholds gth1 and gth2 which satisfy relationship of 0<gth1<gth2 are defined.

The coefficient determining part 24 selects a coefficient table stored in the coefficient table storing part 25 so as to comprise a case where, in at least two ranges among three ranges constituting a possible range of the value having negative correlation with the period, the quantization value of the period or the fundamental frequency, the coefficient determined when the value having positive correlation with the pitch gain is small is greater than the coefficient determined when the value having positive correlation with the pitch gain is great, and a case where, in at least two ranges among three ranges constituting a possible range of the value having positive correlation with the pitch gain, the coefficient determined when the value having negative correlation with the period, the quantization value of the period or the fundamental frequency is small is greater than the coefficient determined when the value having negative correlation with the period, the quantization value of the period or the fundamental frequency is small, and obtains a coefficient stored in the selected coefficient table as the coefficient $w_o(i)$.

Here, the three ranges constituting a possible range of the value having negative correlation with the period, the quantization value of the period or the fundamental frequency are, for example, three ranges of a range of the value having negative correlation with the fundamental frequency<fth1 (that is, a range where the value having negative correlation with the period, the quantization value of the period or the fundamental frequency is small), a range of fth1≤the value having negative correlation with the fundamental frequency≤fth2 (that is, a range where the value having negative correlation with the period, the quantization value of the period or the fundamental frequency is medium), and a range of fth2≤the value having negative correlation with the fundamental frequency (that is, a range where the value having negative correlation with the period, the quantization value of the period or the fundamental frequency is great).

Further, the three ranges constituting a possible range of the value having positive correlation with the pitch gain are, for example, three ranges of a range of the value having positive correlation with the pitch gain≤gth1 (that is, a range where the value having positive correlation with the pitch gain is small), a range of gth1<the value having positive correlation with the pitch gain≤gth2 (that is, a range where the value having positive correlation with the pitch gain is medium), and a range of gth2<the value having positive correlation with the pitch gain (that is, a range where the value having positive correlation with the pitch gain is great).

The coefficient determining part 24, for example, selects the coefficient $w_o(i)$ from coefficient tables stored in the coefficient table storing part 25 so that (1) when the value having negative correlation with the fundamental frequency is less than the threshold fth1 and the value having positive correlation with the pitch gain is greater than the threshold gth2, that is, when the period is short and the pitch gain is large, each coefficient $w_{t0}(i)$ in the coefficient table t0 is selected as the coefficient $w_o(i)$, (2) when the value having negative correlation with the fundamental frequency is less than the threshold fth1 and the value having positive correlation with the pitch gain is greater than the threshold gth1 and equal to or less than the threshold gth2, that is, when the period is short and the pitch gain is medium, each coefficient in any of the coefficient tables t0, t1 and t2 is selected as the coefficient $w_o(i)$, (3) when the value having negative correlation with the fundamental frequency is less than the threshold fth1 and the value having positive correlation with the pitch gain is equal to or less than the threshold gth1, that is, when the period is short and the pitch gain is small, each coefficient in any of the coefficient tables t0, t1 and t2 is selected as the coefficient $w_o(i)$, (4) when the value having negative correlation with the fundamental frequency is equal to or greater than the threshold fth1 and less than the threshold fth2 and the value having positive correlation with the pitch gain is greater than the threshold gth2, that is, when the period is medium and the pitch gain is large, each coefficient in any of the coefficient tables t0, t1 and t2 is selected as the coefficient $w_o(i)$, (5) when the value having negative correlation with the fundamental frequency is equal to or greater than the threshold fth1 and less than the threshold fth2 and the value having positive correlation with the pitch gain is greater than the threshold gth1 and equal to or less than the threshold gth2, that is, when the period is medium and the pitch gain is medium, each coefficient in any of the coefficient tables t0, t1 and t2 is selected as the coefficient $w_o(i)$, (6) when the value having negative correlation with the fundamental frequency is equal to or greater than the threshold fth1 and equal to or less than the threshold fth2 and the value having positive correlation with the pitch gain is equal to or less than the threshold gth1, that is, when the period is medium and the pitch gain is small, each coefficient in any of the coefficient tables t0, t1 and t2 is selected as the coefficient $w_o(i)$, (7) when the value having negative correlation with the fundamental frequency is equal to or greater than the threshold fth2 and the value having positive correlation with the pitch gain is greater than the threshold gth2, that is, when the period is long and the pitch gain is large, each coefficient in any of the coefficient tables t0, t1 and t2 is selected as the coefficient $w_o(i)$, (8) when the value having negative correlation with the fundamental frequency is equal to or greater than the threshold fth2 and the value having positive correlation with the pitch gain is greater than the threshold gth1 and equal to or less than the threshold gth2, that is, when the period is long and the pitch gain is medium, each coefficient in any of the coefficient tables t0, t1 and t2 is selected as the coefficient $w_o(i)$, and (9) when the value having negative correlation with the fundamental frequency is equal to or greater than the threshold fth2 and the value having positive correlation with the pitch gain is equal to or less than the threshold gth1, that is, when the period is long and the pitch gain is small, each coefficient $w_{t2}(i)$ in the coefficient table t2 is selected as the coefficient $w_o(i)$.

In other words, in the case of (1), a coefficient is acquired from the coefficient table t0 by the coefficient determining part 24, in the case of (9), a coefficient is acquired from the coefficient table t2 by the coefficient determining part 24, and in the case of (2), (3), (4), (5), (6), (7) and (8), a coefficient is acquired from any of the coefficient tables t0, t1 and t2 by the coefficient determining part 24.

Further, in the case of at least one of (2), (3), (4), (5), (6), (7) and (8), a coefficient is acquired from the coefficient table t1 by the coefficient determining part 24.

Further, assuming that an identification number of the coefficient table $tj_k$ from which the coefficient is acquired in the coefficient determining step in the case of (k) where k=1, 2, . . . , 9 is $j_k$, $j_1 \le j_2 \le j_3$, $j_4 \le j_5 \le j_6$, $j_7 \le j_8 \le j_9$, $j_1 \le j_4 \le j_7$, $j_2 \le j_5 \le j_8$ and $j_3 \le j_6 \le j_9$.

Specific Example of Third Modified Example of Third Embodiment

A specific example of the third modified example of the third embodiment will be described below. Here, a portion different from the specific example of the second modified example of the third embodiment will be mainly described.

To the linear predictive analysis apparatus 2, an input signal $X_o(n)$ (n=0, 1, . . . , N−1) which is a digital acoustic signal of N samples per frame and which passes through a high-pass filter, subjected to sampling conversion to 12.8 kHz, and subjected to pre-emphasis processing, a period T obtained at the period calculating part 940 for an input signal $X_o(n)$ (n=0, 1, . . . , Nn) (where Nn is a predetermined positive integer which satisfies relationship of Nn<N) of part of a current frame as the information regarding the period, and a pitch gain G obtained at the pitch gain calculating part 950 for the input signal $X_o(n)$ (n=0, 1, . . . , Nn) of part of the current frame as the information regarding the pitch gain, are inputted.

In the present specific example, the threshold fth1 is 80, the threshold fth2 is 160, the threshold gth1 is 0.3, and the threshold gth2 is 0.6.

To the coefficient determining part 24, the period T and the pitch gain G are inputted.

The coefficient determining part 24 selects the coefficient table t0 as the coefficient table t when the period T is less than the threshold fth1=80, and the pitch gain G is greater than the threshold gth2=0.6, that is, when the period is short and the pitch gain is large.

Further, the coefficient determining part 24 selects the coefficient table t1 as the coefficient table t when the period T is less than the threshold fth1=80 and the pitch gain G is equal to or smaller than the threshold gth2=0.6, that is, when the period is short and the pitch gain is medium or small.

Further, the coefficient determining part 24 selects the coefficient table t1 as the coefficient table t when the period T is equal to or greater than the threshold fth1=80 and less than fth2=160 and the pitch gain G is greater than the threshold gth1=0.3, that is, when the period is medium and the pitch gain is large or medium.

Further, the coefficient determining part 24 selects the coefficient table t2 as the coefficient table t when the period T is equal to or greater than the threshold fth1=80 and less than fth2=160 and the pitch gain G is equal to or less than the threshold gth1=0.3, that is, the period is medium and the pitch gain is small.

Further, the coefficient determining part 24 selects the coefficient table t2 as the coefficient table t when the period T is equal to or greater than the threshold fth2=160, that is, when the period is long.

Fourth Modified Example of Third Embodiment

While, in the third embodiment, a coefficient stored in any one table among the plurality of coefficient tables is determined as the coefficient $w_o(i)$, the fourth modified example of the third embodiment further comprises a case where the coefficient $w_o(i)$ is determined through operation processing based on coefficients stored in the plurality of coefficient tables in addition to the above-described case.

A functional configuration and a flowchart of the linear predictive analysis apparatus 2 according to the fourth modified example of the third embodiment are the same as those of the third embodiment and illustrated in FIG. 7 and FIG. 8. The linear predictive analysis apparatus 2 according to the fourth modified example of the third embodiment is the same as the linear predictive analysis apparatus 2 according to the third embodiment except for portions of the processing of the coefficient determining part 24 which differ and portions of the coefficient tables stored in the coefficient table storing part 25 which differ.

Only the coefficient tables t0 and t2 are stored in the coefficient table storing part 25, and the coefficient $w_{t0}(i)$ ($i=0, 1, \ldots, P_{max}$) is stored in the coefficient table t0, and the coefficient $w_{t2}(i)$ ($i=0, 1, \ldots, P_{max}$) is stored in the coefficient table t2. In each of the two coefficient tables t0 and t2, the coefficient $w_{t0}(i)$ ($i=0, 1, \ldots, P_{max}$) and the coefficient $w_{t2}(i)$ ($i=0, 1, \ldots, P_{max}$) determined so that $w_{t0}(i)<w_{t2}(i)$ for at least part of each i, and $w_{t0}(i)\leq w_{t2}(i)$ for the remaining each i, are stored. However, $w_{t0}(0)$ and $w_{t2}(0)$ when i=0 do not have to necessarily satisfy relationship of $w_{t0}(0)\leq w_{t2}(0)$, and may be values having relationship of $w_{t0}(0)>w_{t2}(0)$.

Here, it is assumed that the thresholds fth1' and fth2' which satisfy relationship of 0<fth1'<fth2' and the thresholds gth1 and gth2 which satisfy relationship of 0<gth1<gth2 are defined.

The coefficient determining part 24, for example, selects or obtains the coefficient $w_o(i)$ from the coefficient table stored in the coefficient table storing part 25 so that (1) when the value having positive correlation with the fundamental frequency is greater than the threshold fth2' and the value having positive correlation with the pitch gain is greater than the threshold gth2, that is, when it is determined that the fundamental frequency is high and the pitch gain is large, each coefficient $w_{t0}(i)$ in the coefficient table t0 is selected as the coefficient $w_o(i)$, (2) when the value having positive correlation with the fundamental frequency is greater than the threshold fth2' and the value having positive correlation with the pitch gain is greater than the threshold gth1 and equal to or less than the threshold gth2, that is, when it is determined that the fundamental frequency is high and the pitch gain is medium, each coefficient in any of the coefficient tables t0 and t2 is selected as the coefficient $w_o(i)$ and a coefficient obtained from respective coefficients in the coefficient tables t0 and t2 is set as the coefficient $w_o(i)$, (3) when the value having positive correlation with the fundamental frequency is greater than the threshold fth2' and the value having positive correlation with the pitch gain is equal to or less than the threshold gth1, that is, when it is determined that the fundamental frequency is high and the pitch gain is small, each coefficient in any of the coefficient tables t0 and t2 is selected as the coefficient $w_o(i)$ or a coefficient obtained from respective coefficients in the coefficient tables t0 and t2 is set as the coefficient $w_o(i)$, (4) when the value having positive correlation with the fundamental frequency is greater than the threshold fth1' and equal to or less than the threshold fth2' and the value having positive correlation with the pitch gain is greater than the threshold gth2, that is, when it is determined that the fundamental frequency is medium and the pitch gain is large, each coefficient in any of the coefficient tables t0 and t2 is selected as the coefficient $w_o(i)$ or a coefficient obtained from respective coefficients in the coefficient tables t0 and t2 is set as the coefficient $w_o(i)$, (5) when the value having positive correlation with the fundamental frequency is greater than the threshold fth1' and equal to or less than the threshold fth2' and the value having positive correlation with the pitch gain is greater than the threshold gth1 and equal to or less than the threshold gth2, that is, when it is determined that the fundamental frequency is medium and the pitch gain is medium, each coefficient in any of the coefficient tables t0 and t2 is selected as the coefficient $w_o(i)$ or a coefficient obtained from respective coefficients in the coefficient tables t0 and t2 is set as the coefficient $w_o(i)$, (6) when the value having positive correlation with the fundamental frequency is greater than the threshold fth1' and equal to or less than the threshold fth2' and the value having positive correlation with the pitch gain is equal to or less than the threshold gth1, that is, when it is determined that the fundamental frequency is medium and the pitch gain is small, each coefficient in any of the coefficient tables t0 and t2 is selected as the coefficient $w_o(i)$ or a coefficient obtained from respective coefficients in the coefficient tables t0 and t2 is set as the coefficient $w_o(i)$, (7) when the value having positive correlation with the fundamental frequency is equal to or less than the threshold fth1' and the value having positive correlation with the pitch gain is greater than the threshold gth2, that is, when it is determined that the fundamental frequency is low and the pitch gain is large, each coefficient in any of the coefficient tables t0 and t2 is selected as the coefficient $w_o(i)$, or a coefficient obtained from respective coefficients in the coefficient tables t0 and t2 is set as the coefficient $w_o(i)$, (8) when the value having positive correlation with the fundamental frequency is equal to or less than the threshold fth1' and the value having positive correlation with the pitch gain is greater than the threshold gth1 and equal to or less than the threshold gth2, that is, when it is determined that the fundamental frequency is low and the pitch gain is medium, each coefficient in any of the coefficient tables t0 and t2 is selected as the coefficient $w_o(i)$, or a coefficient obtained from respective coefficients in the coefficient tables t0 and t2 is set as the coefficient $w_o(i)$, and (9) when the value having positive correlation with the fundamental frequency is equal to or less than the threshold fth1' and the value having positive correlation with the pitch gain is equal to or less than the threshold gth1, that is, when it is determined that the fundamental frequency is low and the pitch gain is small, each coefficient $w_{t2}(i)$ in the coefficient table t2 is selected as the coefficient $w_o(i)$.

In other words, in the case of (1), a coefficient is acquired from the coefficient table t0 by the coefficient determining part 24, in the case of (9), a coefficient is acquired from the coefficient table t2 by the coefficient determining part 24, in the case of (2), (3), (4), (5), (6), (7) and (8), a coefficient is acquired from any of the coefficient tables t0 and t2 by the coefficient determining part 24 or a coefficient is obtained from respective coefficients acquired from the coefficient tables t0 and t2, and in the case of at least one of (2), (3), (4), (5), (6), (7) and (8), a coefficient is obtained from respective coefficients acquired from the coefficient tables t0 and t2 by the coefficient determining part 24.

Further, assuming that an identification number of the coefficient table $tj_k$ from which the coefficient is acquired in the coefficient determining step in the case of (k) where k=1, 2, . . . , 9 is $j_k$, $j_1 \le j_2 \le j_3$, $j_4 \le j_5 \le j_6$, $j_7 \le j_8 \le j_9$, $j_1 \le j_4 \le j_7$, $j_2 \le j_5 \le j_8$, and $j_3 \le j_6 \le j_9$.

As a method for obtaining a coefficient from respective coefficients acquired from the coefficient tables t0 and t2, there is, for example, a method in which the coefficient $w_o(i)$ is determined through $w_o(i)=\beta' \times w_{t0}(i)+(1-\beta') \times w_{t2}(i)$ using each coefficient $w_{t0}(i)$ in the coefficient table t0 and each coefficient $w_{t2}(i)$ in the coefficient table t2.

Here, $\beta'$ is a value of $0 \le \beta' \le 1$, which is obtained from the fundamental frequency P and the pitch gain G using a function $\beta'=c(P, G)$ in which the value of $\beta'$ becomes greater as the fundamental frequency P is higher and the pitch gain G is larger, and the value of $\beta'$ becomes smaller as the fundamental frequency P is lower and the pitch gain G is smaller.

By obtaining $w_o(i)$ in this manner, by storing only two tables of a table in which $w_{t0}(i)$ (i=0, 1, . . . , $P_{max}$) is stored and a table in which $w_{t2}(i)$ (i=0, 1, . . . , $P_{max}$) is stored in the coefficient determining part 24, it is possible to obtain a coefficient close to $w_h(i)$ when the fundamental frequency P is high and the pitch gain G is large among a case where the coefficient is obtained from respective coefficients acquired from the coefficient tables t0 and t2, and, inversely, it is possible to obtain a coefficient close to $w_l(i)$ when the fundamental frequency P is low and the pitch gain G is small among a case where the coefficient is obtained from respective coefficients acquired from the coefficient tables t0 and t2.

Fifth Modified Example of Third Embodiment

While, in the third embodiment, a coefficient stored in any of a plurality of coefficient tables is determined as the coefficient $w_o(i)$, in the fifth modified example of the third embodiment, in addition to this, a case is comprised where the coefficient $w_o(i)$ is determined through arithmetic processing based on coefficients stored in the plurality of coefficient tables.

A functional configuration and a flowchart of the linear predictive analysis apparatus 2 according to the fifth modified example of the third embodiment are the same as those of the third embodiment and illustrated in FIG. 7 and FIG. 8. The linear predictive analysis apparatus 2 according to the fifth modified example of the third embodiment is the same as the linear predictive analysis apparatus 2 according to the third embodiment except for portions of the processing of the coefficient determining part 24 which differ and portions of the coefficient tables stored in the coefficient table storing part 25 which differ.

Only coefficient tables t0 and t2 are stored in the coefficient table storing part 25, and the coefficient $w_{t0}(i)$ (i=0, 1, . . . , $P_{max}$) is stored in the coefficient table t0, and the coefficient $w_{t2}(i)$ (i=0, 1, . . . , $P_{max}$) is stored in the coefficient table t2. In the two coefficient tables t0 and t2, the coefficient $w_{t0}(i)$ (i=0, 1, . . . , $P_{max}$) and the coefficient $w_{t2}(i)$ (i=0, 1, . . . , $P_{max}$) which are defined such that for at least part of each i, $w_{t0}(i)<w_{t2}(i)$, and for remaining each i, $w_{t0}(i) \le w_{t2}(i)$ are respectively stored.

Here, it is assumed that the thresholds fth1 and fth2 which satisfy relationship of 0<fth1<fth2 and the thresholds gth1 and gth2 which satisfy relationship of 0<gth1<gth2 are defined.

The coefficient determining part 24, for example, selects or obtains the coefficient $w_o(i)$ from the coefficient tables stored in the coefficient table storing part 25 so that (1) when the value having negative correlation with the fundamental frequency is less than the threshold fth1 and the value having positive correlation with the pitch gain is greater than the threshold gth2, that is, when the period is short and the pitch gain is large, each coefficient $w_{t0}(i)$ in the coefficient table t0 is selected as the coefficient $w_o(i)$, (2) when the value having negative correlation with the fundamental frequency is less than the threshold fth1 and the value having positive correlation with the pitch gain is greater than the threshold gth1 and equal to or less than the threshold gth2, that is, when the period is short and the pitch gain is medium, each coefficient in any of the coefficient tables t0 and t2 is selected as the coefficient $w_o(i)$ or a coefficient obtained from respective coefficients in the coefficient tables t0 and t2 is set as the coefficient $w_o(i)$, (3) when the value having negative correlation with the fundamental frequency is less than the threshold fth1 and the value having positive correlation with the pitch gain is equal to or less than the threshold gth1, that is, when the period is short and the pitch gain in small, each coefficient in any of the coefficient tables t0 and t2 is selected as the coefficient $w_o(i)$ or a coefficient obtained from respective coefficients in the coefficient tables t0 and t2 is set as the coefficient $w_o(i)$, (4) when the value having negative correlation with the fundamental frequency is equal to or greater than the threshold fth1 and less than the threshold fth2 and the value having positive correlation with the pitch gain is greater than the threshold gth2, that is, when the period is medium and the pitch gain is large, each coefficient in any of the coefficient tables t0 and t2 is selected as the coefficient $w_o(i)$ or a coefficient obtained from respective coefficients in the coefficient tables t0 and t2 is set as the coefficient $w_o(i)$, (5) when the value having negative correlation with the fundamental frequency is equal to or greater than the threshold fth1 and less than the threshold fth2 and the value having positive correlation with the pitch gain is greater than the threshold gth1 and equal to or less than the threshold gth2, that is, when the period is medium and the pitch gain is medium, each coefficient in any of the coefficient tables t0 and t2 is selected as the coefficient $w_o(i)$ or a coefficient obtained from respective coefficients in the coefficient tables t0 and t2 is set as the coefficient $w_o(i)$, (6) when the value having negative correlation with the fundamental frequency is equal to or greater than the threshold fth1 and less than the threshold fth2 and the value having positive correlation with the pitch gain is equal to or less than the threshold gth1, that is, when the period is medium and the pitch gain is small, each coefficient in any of the coefficient tables t0 and t2 is selected as the coefficient $w_o(i)$ or a coefficient obtained from respective coefficients in the coefficient tables t0 and t2 is set as the coefficient $w_o(i)$, (7) when the value having negative correlation with the fundamental frequency is equal to or greater than the threshold fth2 and the value having positive correlation with the pitch gain is greater than the threshold gth2, that is, when the period is long and the pitch gain is large, each coefficient in any of the coefficient tables t0 and t2 is selected as the coefficient $w_o(i)$ or a coefficient obtained from respective coefficients in the coefficient tables t0 and t2 is set as the coefficient $w_o(i)$, (8) when the value having negative correlation with the fundamental frequency is equal to or greater than the threshold fth2 and the value having positive correlation with the pitch gain is greater than the threshold gth1 and equal to or less than the threshold gth2, that is, when the period is long and the pitch gain is medium, each coefficient in any of the coefficient tables t0 and t2 is selected as the coefficient $w_o(i)$ or a coefficient obtained from respective coefficient tables t0 and t2 is set as the coefficient $w_o(i)$, and (9) when the value having negative correlation with the fundamental frequency is equal to or greater than the threshold fth2 and the value having positive correlation with the pitch gain is equal to or less than the threshold gth1, that is, when the period is long and the pitch gain is small, each coefficient $w_{t2}(i)$ in the coefficient table t2 is selected as the coefficient $w_o(i)$.

In other words, in the case of (1), a coefficient is acquired from the coefficient table t0 by the coefficient determining part 24, in the case of (9), a coefficient is acquired from the coefficient table t2 by the coefficient determining part 24, in the case of (2), (3), (4), (5), (6), (7) and (8), a coefficient is acquired in any of the coefficient tables t0 and t2 by the coefficient determining part 24 or a coefficient is obtained from respective coefficients acquired from the coefficient tables t0 and t2, and in the case of at least any of (2), (3), (4), (5), (6), (7) and (8), a coefficient is obtained from respective coefficients acquired from the coefficient tables t0 and t2 by the coefficient determining part 24.

Further, assuming that an identification number of the coefficient table $tj_k$ from which the coefficient is acquired in the coefficient determining step in the case of (k) where k=1, 2, . . . , 9 is $j_k$, $j_1 \le j_2 \le j_3$, $j_4 \le j_5 \le j_6$, $j_7 \le j_8 \le j_9$, $j_1 \le j_4 \le j_7$, $j_2 \le j_5 \le j_8$, and $j_3 \le j_6 \le j_9$.

As a method for obtaining a coefficient from respective coefficients acquired from the coefficient tables t0 and t2, there is, for example, a method in which the coefficient $w_o(i)$ is determined through $w_o(i)=(1-\beta)\times w_{t0}(i)+\beta\times w_{t2}(i)$ using each coefficient $w_{t0}(i)$ in the coefficient table t0 and each coefficient $w_{t2}(i)$ in the coefficient table t2.

Here, $\beta$ is a value of $0 \le \beta \le 1$, which is obtained from the period T and the pitch gain G using a function $\beta=b(T, G)$ in which the value of $\beta$ becomes greater as the period T is longer and the pitch gain G is smaller, and the value of $\beta$ becomes smaller as the period T is shorter and the pitch gain G is larger.

By obtaining $w_o(i)$ in this manner, by storing only two tables of a table in which $w_{t0}(i)$ (i=0, 1, . . . , $P_{max}$) is stored and a table in which $w_{t2}(i)$ (i=0, 1, . . . , $P_{max}$) is stored in the coefficient determining part 24, it is possible to obtain a coefficient close to $w_h(i)$ when the period T is short and the pitch gain G is large among a case where a coefficient is obtained from respective coefficients acquired from the coefficient tables t0 and t2, and, inversely, it is possible to obtain a coefficient close to $w_l(i)$ when the period T is long and the pitch gain G is small among a case where a coefficient is obtained from respective coefficients acquired from the coefficient tables t0 and t2.

Modified Example Common to First Embodiment to Third Embodiment

Figure 11:
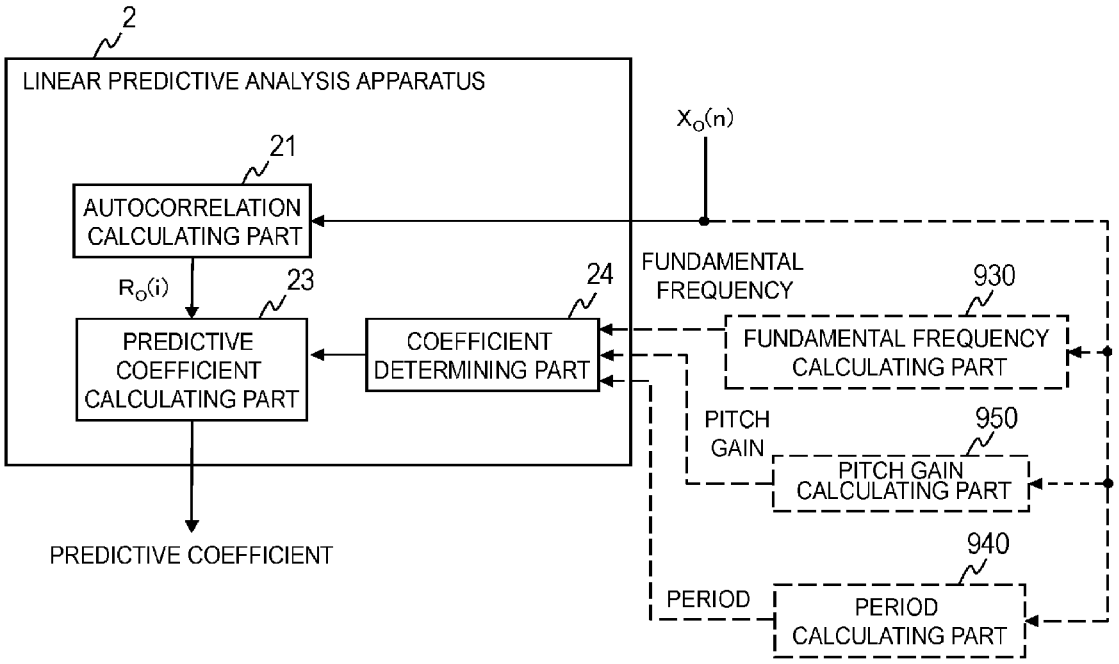
FIG. 11 is a block diagram for explaining a modified example.
Figure 12:
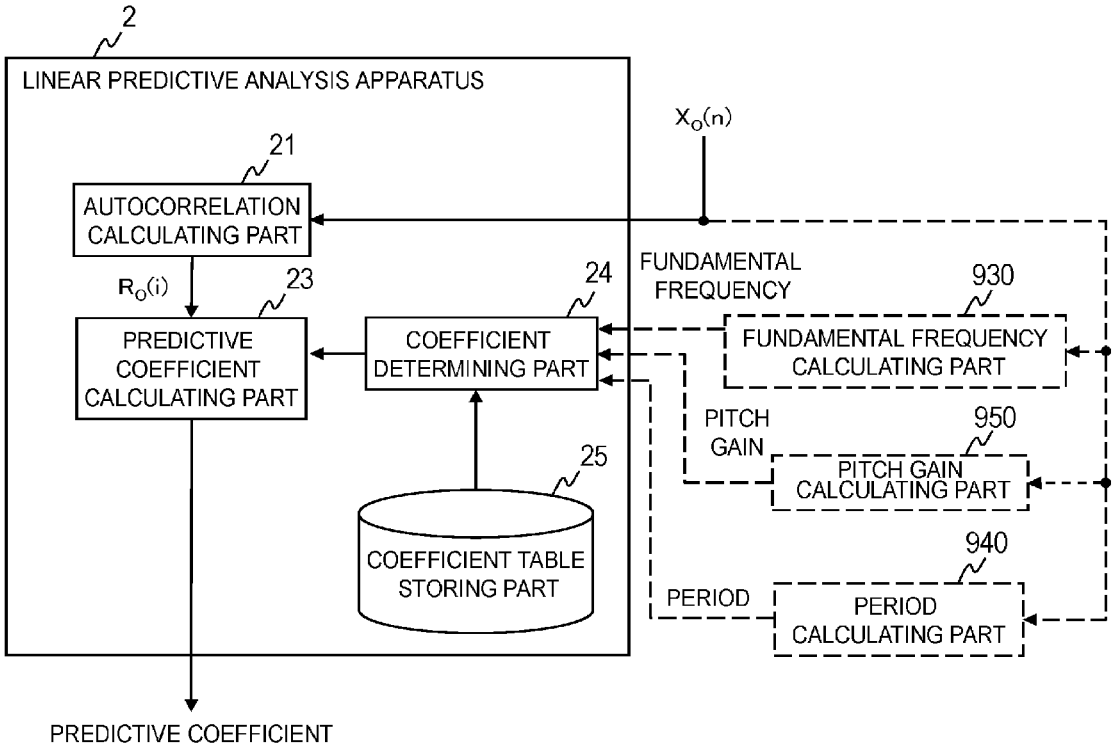
FIG. 12 is a block diagram for explaining a modified example.
Figure 13:
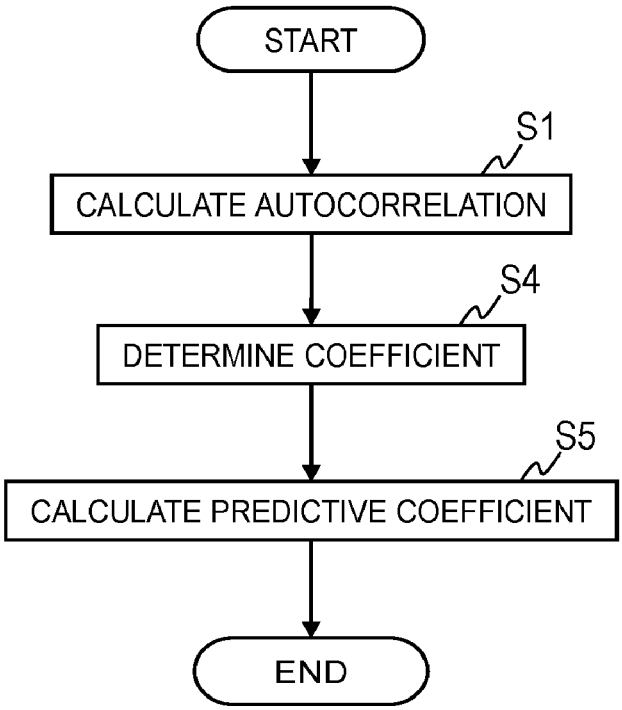
FIG. 13 is a flowchart for explaining a modified example.

As illustrated in FIG. 11 and FIG. 12, in all the above-described embodiments and modified examples, it is also possible to perform linear predictive analysis using the coefficient $w_o(i)$ and the autocorrelation $R_o(i)$ at the predictive coefficient calculating part 23 without comprising the coefficient multiplying part 22. FIG. 11 and FIG. 12 illustrate configuration examples of the linear predictive analysis apparatus 2 respectively corresponding to FIG. 1 and FIG. 7. In this case, as illustrated in FIG. 13, the predictive coefficient calculating part 23 performs linear predictive analysis directly using the coefficient $w_o(i)$ and the autocorrelation $R_o(i)$ instead of using the modified autocorrelation $R'_o(i)$ obtained by multiplying the autocorrelation $R_o(i)$ by the coefficient $w_o(i)$ (step S5).

Fourth Embodiment

In the fourth embodiment, linear predictive analysis is performed on the input signal $X_o(n)$ using the conventional linear predictive analysis apparatus, and a fundamental frequency and a pitch gain are respectively obtained at a fundamental frequency calculating part and a pitch gain calculating part using the result of the linear predictive analysis, and a coefficient which can be converted into a linear predictive coefficient is obtained using the coefficient $w_o(i)$ based on the obtained fundamental frequency and pitch gain by the linear predictive analysis apparatus of the present invention.

Figure 14:
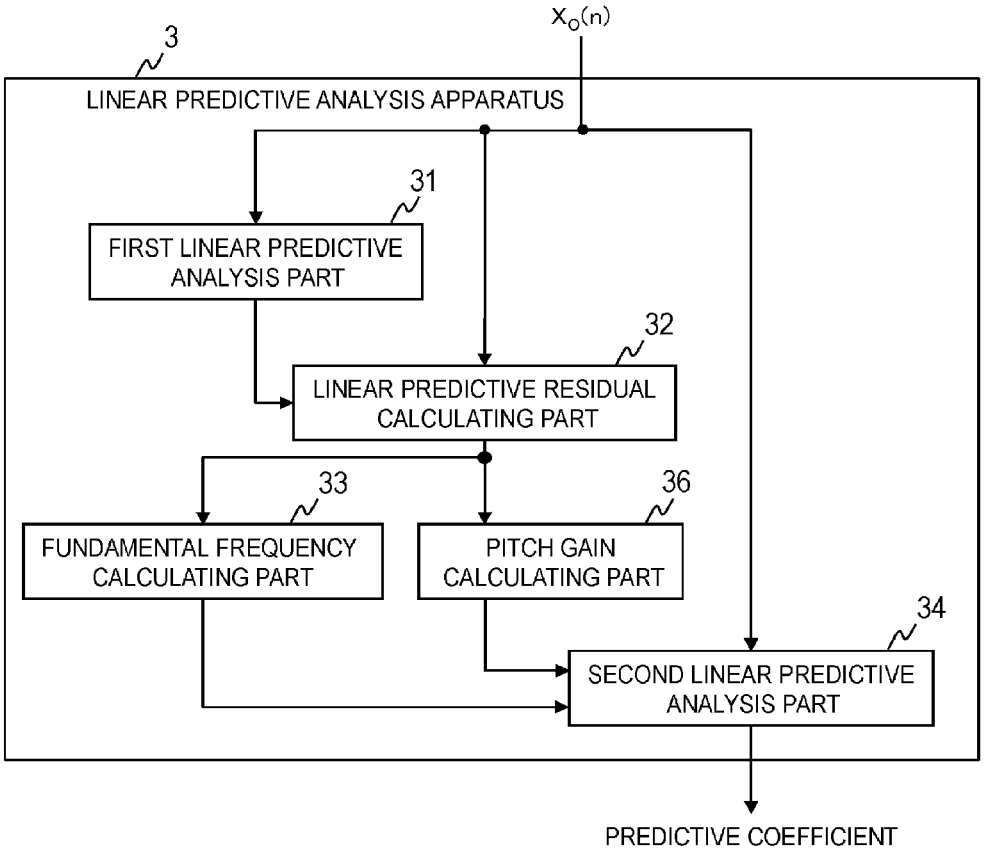
FIG. 14 is a block diagram for explaining an example of a linear predictive analysis apparatus according to a fourth embodiment.

As illustrated in FIG. 14, a linear predictive analysis apparatus 3 according to the fourth embodiment comprises, for example, a first linear predictive analysis part 31, a linear predictive residual calculating part 32, a fundamental frequency calculating part 33, a pitch gain calculating part 36 and a second linear predictive analysis part 34.

[First Linear Predictive Analysis Part 31]

The first linear predictive analysis part 31 performs the same operation as that of the conventional linear predictive analysis apparatus 1. That is, the first linear predictive analysis part 31 obtains autocorrelation $R_o(i)$ (i=0, 1, . . . , $P_{max}$) from the input signal $X_o(n)$, obtains modified autocorrelation $R'_o(i)$ (i=0, 1, . . . , $P_{max}$) by multiplying the autocorrelation $R_o(i)$ (i=0, 1, . . . , $P_{max}$) by the coefficient $w_o(i)$ (i=0, 1, . . . , $P_{max}$) defined in advance for each of the same i, and obtains a coefficient which can be converted into linear predictive coefficients from the first-order to the $P_{max}$-order which is a maximum order defined in advance from the modified autocorrelation $R'_o(i)$ (i=0, 1, . . . , $P_{max}$).

[Linear Predictive Residual Calculating Part 32]

The linear predictive residual calculating part 32 obtains a linear predictive residual signal $X_R(n)$ by performing linear prediction based on the coefficient which can be converted into linear predictive coefficients from the first-order to the $P_{max}$-order or performing filtering processing which is equivalent to or similar to the linear prediction on the input signal $X_o(n)$. Because the filtering processing can be referred to as weighting processing, the linear predictive residual signal $X_R(n)$ can be referred to as a weighted input signal.

[Fundamental Frequency Calculating Part 33]

The fundamental frequency calculating part 33 obtains the fundamental frequency P of the linear predictive residual signal $X_R(n)$ and outputs the information regarding the fundamental frequency. Because there are various publicly known methods as a method for obtaining the fundamental frequency, any publicly known method may be used. The fundamental frequency calculating part 33, for example, obtains a fundamental frequency for each of a plurality of subframes constituting the linear predictive residual signal $X_R(n)$ (n=0, 1, . . . , N−1) of the current frame. That is, the fundamental frequency calculating part 33 obtains fundamental frequencies $P_{s1}, \ldots, P_{sM}$ of M subframes $X_{Rs1}(n)$ (n=0, 1, . . . , N/M−1), . . . , $X_{RsM}(n)$ (n=(M−1)N/M, (M−1)N/M+1, . . . , N−1) where M is an integer equal to or greater than two. It is assumed that N is divisible by M. The fundamental frequency calculating part 33 next outputs information which can specify a maximum value max $(P_{s1}, \ldots, P_{sM})$ among fundamental frequencies $P_{s1}, \ldots, P_{sM}$ of M subframes constituting the current frame as the information regarding the fundamental frequency.

[Pitch Gain Calculating Part 36]

The pitch gain calculating part 36 obtains the pitch gain G of the linear predictive residual signal $X_R(n)$ and outputs information regarding the pitch gain. Because there are various publicly known methods for obtaining a pitch gain, any publicly known method may be used. The pitch gain calculating part 36, for example, obtains a pitch gain for each of a plurality of subframes constituting the linear predictive residual signal $X_R(n)$ (n=0, 1, . . . , N−1) of the current frame. That is, the pitch gain calculating part 36 obtains $G_{s1}, \ldots, G_{sM}$ which are respective pitch gains of $X_{Rs1}(n)$ (n=0, 1, . . . , N/M−1), . . . , $X_{RsM}(n)$ (n=(M−1)N/M, (M−1)N/M+1, . . . , N−1) which are M subframes where M is two or more integers. It is assumed that N is divisible by M. The pitch gain calculating part 36 subsequently outputs information which can specify a maximum value max $(G_{s1}, \ldots, G_{sM})$ among $G_{s1}, \ldots, G_{sM}$ which are pitch gains of M subframes constituting the current frame as the information regarding the pitch gain.

[Second Linear Predictive Analysis Part 34]

The second linear predictive analysis part 34 performs the same operation as any of the linear predictive analysis apparatus 2 according to the first embodiment of the present invention, the linear predictive analysis apparatus 2 according to the second embodiment, the linear predictive analysis apparatus 2 according to the second modified example of the second embodiment, the linear predictive analysis apparatus 2 according to the third embodiment, the linear predictive analysis apparatus 2 according to the second modified example of the third embodiment, the linear predictive analysis apparatus 2 according to the fourth modified example of the third embodiment, and the linear predictive analysis apparatus 2 according to the modified example common to the first embodiment to the third embodiment. That is, the second linear predictive analysis part 34 obtains autocorrelation $R_o(i)$ (i=0, 1, . . . , $P_{max}$) from the input signal $X_o(n)$, determines the coefficient $w_o(i)$ (i=0, 1, . . . , $P_{max}$) based on the information regarding the fundamental frequency outputted from the fundamental frequency calculating part 33 and the information regarding the pitch gain outputted from the pitch gain calculating part 36, and obtains a coefficient which can be converted into linear predictive coefficients from the first-order to the $P_{max}$-order which is a maximum order defined in advance, using the autocorrelation $R_o(i)$ (i=0, 1, . . . , $P_{max}$) and the determined coefficient $w_o(i)$ (i=0, 1, . . . , $P_{max}$).

Modified Example of Fourth Embodiment

In the modified example of the fourth embodiment, linear predictive analysis is performed on the input signal $X_o(n)$ using the conventional linear predictive analysis apparatus, the period and the pitch gain are respectively obtained at a period calculating part and a pitch gain calculating part using the result of the linear predictive analysis, and a coefficient which can be converted into a linear predictive coefficient is obtained by the linear predictive analysis apparatus of the present invention using the coefficient $w_o(i)$ based on the obtained period and pitch gain.

Figure 15:
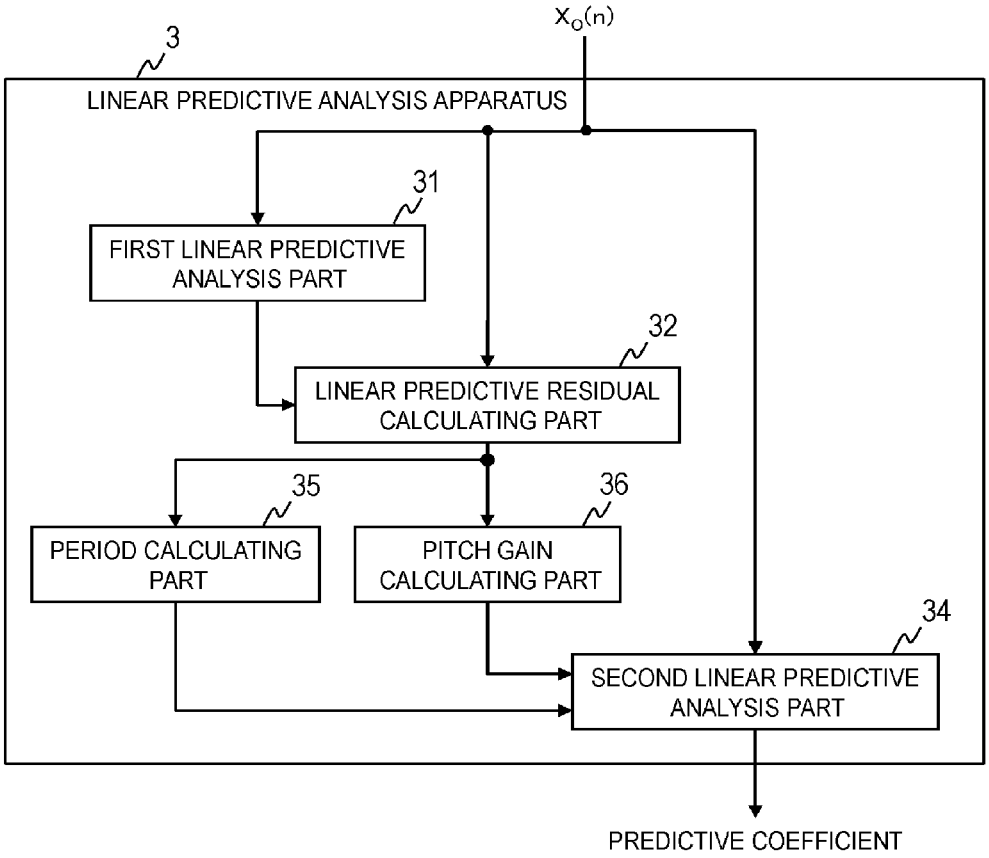
FIG. 15 is a block diagram for explaining an example of a linear predictive analysis apparatus according to a modified example of a fourth embodiment.
Figure 16:
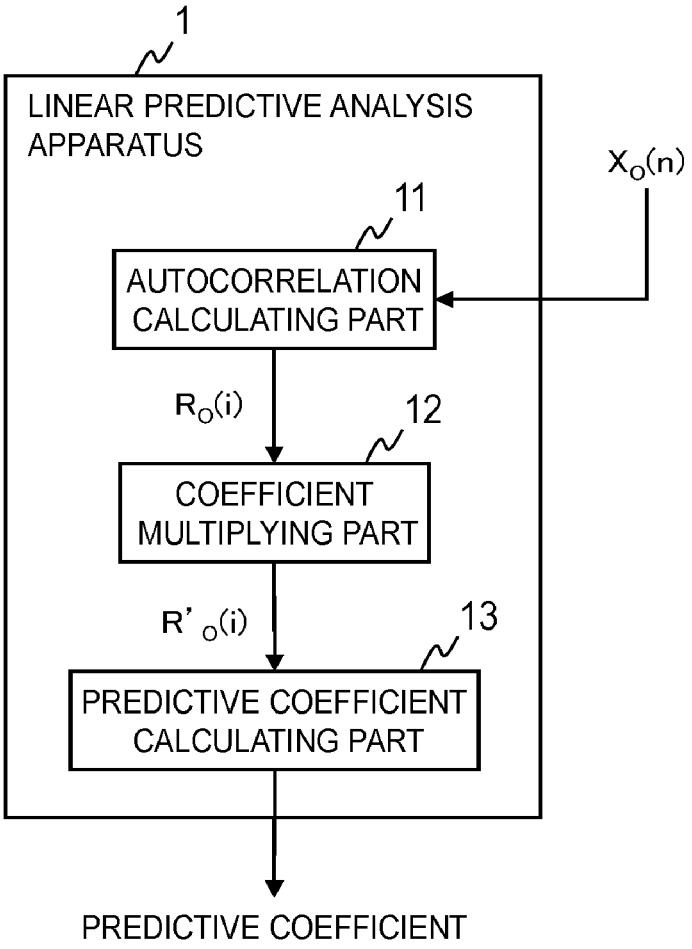
FIG. 16 is a block diagram for explaining an example of a conventional linear predictive apparatus.

As illustrated in FIG. 15, the linear predictive analysis apparatus 3 according to the modified example of the fourth embodiment comprises, for example, a first linear predictive analysis part 31, a linear predictive residual calculating part 32, a period calculating part 35, a pitch gain calculating part 36 and a second linear predictive analysis part 34. Each of the first linear predictive analysis part 31 and the linear predictive residual calculating part 32 of the linear predictive analysis apparatus 3 according to the modified example of the fourth embodiment is the same as the linear predictive analysis apparatus 3 according to the fourth embodiment. A portion different from the fourth embodiment will be mainly described.

[Period Calculating Part 35]

The period calculating part 35 obtains a period T of the linear predictive residual signal $X_R(n)$ and outputs the information regarding the period. Because there are various publicly known methods as a method for obtaining the period, any publicly known method may be used. The period calculating part 35, for example, obtains a period for each of a plurality of subframes constituting the linear predictive residual signal $X_R(n)$ (n=0, 1, . . . , N−1) of the current frame. That is, the period calculating part 35 obtains periods $T_{s1}, \ldots, T_{sM}$ of M subframes $X_{Rs1}(n)$ (n=0, 1, . . . , N/M−1), . . . , $X_{RsM}(n)$ (n=(M−1)N/M, (M−1)N/M+1, . . . , N−1) where M is an integer equal to or greater than two. It is assumed that N is divisible by M. The period calculating part 35 then outputs information which can specify a minimum value min$(T_{s1}, \ldots, T_{sM})$ among the periods $T_{s1}, \ldots, T_{sM}$ of M subframes which constitute the current frame as the information regarding the period.

[Second Linear Predictive Analysis Part 34 of Modified Example]

The second linear predictive analysis part 34 according to the modified example of the fourth embodiment performs the same operation as any of the linear predictive analysis apparatus 2 according to the modified example of the first embodiment of the present invention, the linear predictive analysis apparatus 2 according to the first modified example of the second embodiment, the linear predictive analysis apparatus 2 according to the third modified example of the second embodiment, the linear predictive analysis apparatus 2 according to the first modified example of the third embodiment, the linear predictive analysis apparatus 2 according to the third modified example of the third embodiment, the linear predictive analysis apparatus 2 according to the fifth modified example of the third embodiment and the linear predictive analysis apparatus 2 according to the modified example common to the first embodiment to the third embodiment. That is, the second linear predictive analysis part 34 obtains autocorrelation $R_o(i)$ (i=0, 1, . . . , $P_{max}$) from the input signal $X_o(n)$, determines the coefficient $w_o(i)$ (i=0, 1, . . . , $P_{max}$) based on the information regarding the period outputted from the period calculating part 35 and the information regarding the pitch gain outputted from the pitch gain calculating part 36 and obtains a coefficient which can be converted into linear predictive coefficients from the first-order to the $P_{max}$-order which is a maximum order defined in advance, using the autocorrelation $R_o(i)$ (i=0, 1, . . . , $P_{max}$) and the determined coefficient $w_o(i)$ (i=0, 1, . . . , $P_{max}$).

<Value Having Positive Correlation with Fundamental Frequency>

As described as specific example 2 of the fundamental frequency calculating part 930 in the first embodiment, as the value having positive correlation with the fundamental frequency, a fundamental frequency of a portion corresponding to a sample of the current frame among a sample portion utilized by being looked ahead, which is also called look-ahead, in signal processing of the previous frame may be used.

Further, as the value having positive correlation with the fundamental frequency, an estimate value of the fundamental frequency may be used. For example, an estimate value of the fundamental frequency regarding the current frame predicted from the fundamental frequencies of a plurality of past frames, or an average value, a minimum value or a maximum value of the fundamental frequencies of the plurality of past frames may be used as the estimate value of the fundamental frequency. Still further, an average value, a minimum value or a maximum value of the fundamental frequencies of the plurality of subframes may be used as the estimate value of the fundamental frequency.

Further, the quantization value of the fundamental frequency may be used as the value having positive correlation with the fundamental frequency. That is, a fundamental frequency before quantization may be used or a fundamental frequency after quantization may be used.

Still further, in the case of a plurality of channels such as stereo, a fundamental frequency regarding any of channels for which analysis is performed may be used as the value having positive correlation with the fundamental frequency.

<Value Having Negative Correlation with Fundamental Frequency>

As described in specific example 2 of the period calculating part 940 in the first embodiment, a period T of a portion corresponding to a sample of the current frame among a sample portion utilized by being looked ahead, which is also called look-ahead, in signal processing of the previous frame may be used as the value having negative correlation with the fundamental frequency.

Further, an estimate value of the period T may be used as the value having negative correlation with the fundamental frequency. For example, an estimate value of the period T for the current frame predicted from the fundamental frequencies of the plurality of past frames, or an average value, a minimum value or a maximum value of the period T regarding the plurality of past frames may be used as the estimate value of the period T. Further, an average value, a minimum value or a maximum value of the period T for the plurality of subframes may be used as the estimate value of the period T. Alternatively, an estimate value of the period T for the current frame predicted from a portion corresponding to a sample of the current frame among the fundamental frequencies of the plurality of past frames and a sample portion utilized by being looked ahead, which is also called look-ahead may be used, or, in a similar manner, an average value, a minimum value or a maximum value for the portion corresponding to the sample of the current frame among the fundamental frequencies of the plurality of past frames and the sample portion utilized by being looked ahead, which is also called look-ahead may be used as the estimate value.

Further, the quantization value of the period T may be used as the value having negative correlation with the fundamental frequency. That is, a period T before quantization may be used or a period T after quantization may be used.

Still further, in the case of a plurality of channels, such as stereo, a period T for any channels for which analysis is performed may be used as the value having negative correlation with the fundamental frequency.

<Concerning Value Having Positive Correlation with Pitch Gain>

As described as the specific example 2 of the pitch gain calculating part 950 in the first embodiment, it is also possible to use a pitch gain of a portion corresponding to a sample of the current frame among a sample portion to be looked ahead and utilized which is called a look-ahead portion in signal processing of the previous frame as the value having positive correlation with the pitch gain.

It should be noted that when the value having positive correlation with the fundamental frequency, the value having negative correlation with the fundamental frequency or the value having positive correlation with the pitch gain is compared with the threshold in the above-described embodiments and modified examples, it is only necessary to perform setting such that a case where the value having positive correlation with the fundamental frequency, the value having negative correlation with the fundamental frequency or the value having positive correlation with the pitch gain is the same as the threshold, is classified into either of two cases which are divided by the threshold. That is, a case where the value is equal to or greater than a given threshold may be made a case where the value is greater than the threshold, and a case where the value is smaller than the threshold may be made a case where the value is equal to or smaller than the threshold. Further, a case where the value is greater than a given threshold may be made a case where the value is equal to or greater than the threshold, and a case where the value is equal to or smaller than the threshold may be made a case where the value is smaller than the threshold.

The processing described in the above-described apparatus and method is not only executed in time series according to the order the processing is described, but may be executed in parallel or individually according to processing performance of the apparatus which executes the processing or as necessary.

Further, when each step in the linear predictive analysis method is implemented using a computer, processing content of a function of the linear predictive analysis method is described in a program. By this program being executed at the computer, each step is implemented on the computer.

The program which describes the processing content can be stored in a computer readable recording medium. As the computer readable recording medium, for example, any of a magnetic recording apparatus, an optical disc, a magnetooptical recording medium, a semiconductor memory, or the like, may be used.

Further, each processing part may be configured by causing a predetermined program to be executed on a computer, or at least part of the processing content may be implemented using hardware.

Other modifications are, of course, possible without deviating from the gist of the present invention.

What is claimed is:

1. A linear predictive analysis method for obtaining a coefficient which can be converted into a linear predictive coefficient corresponding to an input time series signal for each frame which is a predetermined time interval, the linear predictive analysis method comprising:

an autocorrelation calculating step of calculating autocorrelation $R_o(i)$ between an input time series signal $X_o(n)$ of a current frame and an input time series signal $X_o(n-i)$ i sample before the input time series signal $X_o(n)$ or an input time series signal $X_o(n+i)$ i sample after the input time series signal $X_o(n)$ for each of at least i=0, 1, . . . , $P_{max}$; and a predictive coefficient calculating step of obtaining a coefficient which can be converted into linear predictive coefficients from the first-order to the $P_{max}$-order using modified autocorrelation $R'_o(i)$ obtained by multiplying the autocorrelation $R_o(i)$ by a coefficient $w_o(i)$ for each corresponding i, wherein a case where, for at least part of each order i, the coefficient $w_o(i)$ corresponding to each order i monotonically increases as a period, a quantization value of the period or a value having negative correlation with a fundamental frequency based on an input time series signal in the current frame or a past frame increases, and a case where the coefficient $w_o(i)$ monotonically decreases as a value having positive correlation with intensity of periodicity or a pitch gain of the input time series signal in the current frame or the past frame increases, are comprised.

2. A linear predictive analysis method for obtaining a coefficient which can be converted into a linear predictive coefficient corresponding to an input time series signal for each frame which is a predetermined time interval, the linear predictive analysis method comprising:

an autocorrelation calculating step of calculating autocorrelation $R_o(i)$ between an input time series signal $X_o(n)$ of a current frame and an input time series signal $X_o(n-i)$ i sample before the input time series signal $X_o(n)$ or an input time series signal $X_o(n+i)$ i sample after the input time series signal $X_o(n)$ for each of at least i=0, 1, . . . , $P_{max}$; and a predictive coefficient calculating step of obtaining a coefficient which can be converted into linear predictive coefficients from the first-order to the $P_{max}$-order using modified autocorrelation $R'_o(i)$ obtained by multiplying the autocorrelation $R_o(i)$ by a coefficient $w_o(i)$ for each corresponding i, wherein a case where, for at least part of each order i, a coefficient $w_o(i)$ corresponding to the each order i monotonically decreases as a value having positive correlation with a fundamental frequency based on an input time series signal in the current frame or a past frame increases and a case where the coefficient $w_o(i)$ monotonically decreases as a value having positive correlation with a pitch gain increases, are comprised.

3. A linear predictive analysis apparatus which obtains a coefficient which can be converted into a linear predictive coefficient corresponding to an input time series signal for each frame which is a predetermined time interval, the linear predictive analysis apparatus comprising:

processing circuitry configured to calculate autocorrelation $R_o(i)$ between an input time series signal $X_o(n)$ of a current frame and an input time series signal $X_o(n-i)$ i sample before the input time series signal $X_o(n)$ or an input time series signal $X_o(n+i)$ i sample after the input time series signal $X_o(n)$ for each of at least i=0, 1, . . . , $P_{max}$; and obtain a coefficient which can be converted into linear predictive coefficients from the first-order to the $P_{max}$-order using modified autocorrelation $R'_o(i)$ obtained by multiplying the autocorrelation $R_o(i)$ by a coefficient $w_o(i)$ for each corresponding i, wherein a case where, for at least part of each order i, the coefficient $w_o(i)$ corresponding to each order i monotonically increases as a period, a quantization value of the period or a value having negative correlation with a fundamental frequency based on an input time series signal in the current frame or a past frame increases, and a case where the coefficient $w_o(i)$ monotonically decreases as a value having positive correlation with intensity of periodicity or a pitch gain of the input time series signal in the current frame or the past frame increases, are comprised.

4. A linear predictive analysis apparatus which obtains a coefficient which can be converted into a linear predictive coefficient corresponding to an input time series signal for each frame which is a predetermined time interval, the linear predictive analysis apparatus comprising:

processing circuitry configured to calculate autocorrelation $R_o(i)$ between an input time series signal $X_o(n)$ of a current frame and an input time series signal $X_o(n-i)$ i sample before the input time series signal $X_o(n)$ or an input time series signal $X_o(n+i)$ i sample after the input time series signal $X_o(n)$ for each of at least i=0, 1, . . . , $P_{max}$; and obtain a coefficient which can be converted into linear predictive coefficients from the first-order to the $P_{max}$-order using modified autocorrelation $R'_o(i)$ obtained by multiplying the autocorrelation $R_o(i)$ by a coefficient $w_o(i)$ for each corresponding i, wherein a case where, for at least part of each order i, a coefficient $w_o(i)$ corresponding to the each order i monotonically decreases as a value having positive correlation with a fundamental frequency based on an input time series signal in the current frame or a past frame increases and a case where the coefficient $w_o(i)$ monotonically decreases as a value having positive correlation with a pitch gain increases, are comprised.

5. A non-transitory computer readable recording medium in which a program causing a computer to execute each step of the linear predictive analysis method according to claim 1 or 2 is recorded.

* * * * *